US006131667A

United States Patent [19]

Jesadanont et al.

[11] Patent Number: 6,131,667

[45] Date of Patent: Oct. 17, 2000

[54] MANUAL AND AUTOMATIC FIRE EXTINGUISHING SYSTEMS

[75] Inventors: Mongkol Jesadanont; Apijade Jesadanont; Sukanya Jesadanont, all of Bangkok, Thailand

[73] Assignee: Safety Inventions, Ltd., Part., Bangkok, Thailand

[21] Appl. No.: 08/993,622

[22] Filed: Dec. 18, 1997

[51] Int. Cl.[7] ..... A62C 13/76

[52] U.S. Cl. ..... 169/89; 169/7; 169/16; 169/19; 169/30; 169/28; 169/57; 169/56; 169/66; 220/88.1

[58] Field of Search ..... 169/5, 16, 19, 169/23, 26, 28, 30, 56, 57, 58, 66, 60, 75, 89, 7; 220/88.1, 567.2, 560.03, 612, DIG. 22; 228/184

[56] References Cited

U.S. PATENT DOCUMENTS

| | | | |
|---|---|---|---|
| 3,594,894 | 7/1971 | Mayer, Jr. | 220/612 X |
| 4,433,733 | 2/1984 | Cunningham . | |
| 4,650,004 | 3/1987 | Wendling et al. . | |
| 4,658,481 | 4/1987 | Seyler et al. . | |
| 4,691,783 | 9/1987 | Stern et al. . | |
| 4,718,498 | 1/1988 | Davios et al. . | |
| 4,741,403 | 5/1988 | Nishimura . | |
| 4,790,745 | 12/1988 | Nakanishi et al. . | |
| 4,819,733 | 4/1989 | Aria et al. . | |
| 4,821,805 | 4/1989 | Saito et al. . | |
| 4,951,755 | 8/1990 | Barnett et al. . | |
| 5,330,009 | 7/1994 | Zhang . | |
| 5,505,266 | 4/1996 | Fujiki . | |

*Primary Examiner*—Andres Kashnikow
*Assistant Examiner*—Steven J. Ganey
*Attorney, Agent, or Firm*—Safety Inventions Ltd. Part

[57] ABSTRACT

A fire extinguisher which maintains a constantly high pressure inside a shell of the fire extinguisher through out a shelf-life of the fire extinguisher comprising an ejection chamber having internal threads at its lower edge and a shell having external threads at its upper edge to mate tightly with internal threads of ejection chamber where shell contains fire extinguishing agent in an absolutely closed system, and where there is a pressing element presses on top of a plate fillet welded to an inner lower wall of the ejection chamber. Upon destroying pressing element, pressure inside shell causes a hole being formed in said plate allowing ejection of fire extinguishing agent to put out fire. An automatic fire extinguishing system is described using newly invented fire extinguisher to extinguish fire immediately when a detector is actuated by any substances built-up during a fire to cause destroying of a plastic stopper cartridge at an end of a pipe resulting in opening up pipe end and also resulting in a hole being formed in said plate fillet welded to an inner lower wall of the ejection chamber of fire extinguisher to allow ejecting of fire extinguishing agent to put out fire starting in a room. A number of fire extinguishers can be connected in series with a pressure sensor installed in a pipe between each one, and from which fire extinguishing agent can be successively ejected out until fire is completely put out. An automatic fire extinguishing system for an oil storage tank is described.

3 Claims, 61 Drawing Sheets

MANUAL AND AUTOMATIC FIRE EXTINGUISHING SYSTEMS

Most of the presently available automatic fire extinguishing systems using water sprinklers or fire extinguisher chemicals are still far from practically effective. This, quite often, results in serious damage from fire despite tremendous budgets have been spent for installation of such systems. The water sprinkler system has its own several critical disadvantages which makes it fail most of the time, firstly electronic equipments, machines, tools, documents or clothes suffer greatly after the operation, secondly while quite often fire catches at a higher level such as at ceiling, water is insufficient yet sprinkled down at a lower level, thirdly to keep sufficiently large amount of water at all time at a very high level like in buildings with over thirty storeys is something not very likely and sometime almost impossible in several areas in the world, yet, most of the time water gets dried and clogged the sprinkler heads, fourthly water can spread the fire if fire caused by a flammable liquid. All of these serious disadvantages are now realized and make it unattractive to use automatic water sprinkler system. In those systems using powdered fire extinguisher chemicals, disadvantages are slightly less yet they can not put fire out as effectively as desire. Improvement have been proposed by several inventors (U.S. Pat. Nos. 5,505,266; 4,821,805; 4,819,733; 4,741,403 and 4,691,783), yet their systems still suffer from the fact that leakage of the propellant is continuous at all time from the fire extinguisher results in requiring laborious maintenance of system. Thus, to bring these systems into practice most effectively needs considerable improvement to make it work instantaneously in putting out fire, since the shorter the time needed the lesser is the damage which is most desirable. The present invention proposes construction of a maintenance-free fire extinguisher which can be used manually or as important component in an automatic fire extinguishing system to be installed in buildings especially in those tall ones.

SUMMARY OF THE INVENTION

A fire extinguisher whose pressure inside its shell is maintained constantly high all through its shelf-life comprises an ejection chamber having internal threads at its lower edge and a shell having external threads at its upper edge to mate tightly with internal threads of ejection chamber where shell contains fire extinguishing agent in an absolutely closed system in a manner that moisture and air from outside can not invade, and where there is a pressing element presses on top of upper wall of shell. Upon lifting up or destroying pressing element, pressure inside shell causes a hole being formed in the upper wall of shell allowing fire extinguishing agent to flow out to put out fire. An automatic fire extinguishing system using the invented fire extinguisher is described that fire extinguishing agent is ejected out to extinguish fire immediately when a smoke detector or a heat detector or a detector of any substances built-up during a fire is actuated to cause melting down or exploding or both of a plastic stopper cartridge at an end of a pipe to deliver fire extinguishing agent into each room in a building resulting in opening up pipe end and also resulting in a hole being formed in upper wall of shell of fire extinguisher whose pressure inside its shell is maintained constantly high all through its shelf-life to allow ejecting of fire extinguishing agent to put out fire starting in a room. A number as many as require of newly invented fire extinguisher can be connected in series with a pressure sensor installed in a pipe between each unit. Fire extinguishing agent can be ejected out from one extinguisher at a time and when fire extinghuishing agent is almost used up a pressure sensor installed in a pipe between a first and a second fire extinguisher is actuated to cause ejection of fire extinghuishing agent from second fire extinguisher, fire extinghuishing agent can be successively ejected out until fire is completely put out. Automatic fire extinguishing system is automatically turned off and next fire extinguisher in series is left unused. An automatic fire extinguishing system to be used in an oil storage tank is also described consists of two-layer tank made of fire-resistant material where fire extinguishing agent is ejected out to extinguish fire immediately when a smoke detector or a heat detector or a detector of any substances built-up during a fire is actuated to cause melting down or exploding or both of a plastic stopper cartridge at an end of a pipe to deliver fire extinguishing agent into space between the two layers of tank and space above oil level stored in inner unit of tank resulting in opening up of pipe end and also resulting in a hole being formed in upper wall of shell of fire extinguishers whose pressure inside its shell is maintained constantly high all through its shelf-life to allow ejecting of fire extinguishing agent into space between outer and inner layers of tank and space above oil level stored in inner tank to put out fire. A leakage detecting system to detect leaking of fire extinguishing agent from a fire extinguisher is described consists of a shell to cover over areas to detect leakage of a fire extinguisher mounting to fire extinguisher by fillet welding wherein a pressure sensor is actuated when pressure inside shell increases to a predetermined level to give out warning signal either audibly or visibly or both.

BRIEF DESCRIPTION OF THE DRAWINGS

FIG. 61 is a sectional view along line 18—18 of FIG. 56 of a hybrid semicircular horse-shoe shape cartridge;

DETAILED DESCRIPTION OF PREFERRED EMBODIMENTS

A fire extinguisher and automatic fire extinguishing system are described to have main features as follow:

1. Shell or cylinder of a fire extinguisher is welded to be leak-proof such that there can not be leakage of extinguishing agent or propellant from the shell. This makes the present fire extinguisher maintenance-free with no need for refilling, may be over ten years before it expires which takes quite a long time compared to those prior arts.

2. Automatic fire extinguishing system to be described uses fire extinguisher in 1. and therefore will also last for a very long time with no need for routine maintenance. With this leak-proof feature, actuation for ejection of extinguishing agent can be made automatic to instantly put out fire.

Manual Fire Extinguisher

Figure 1:
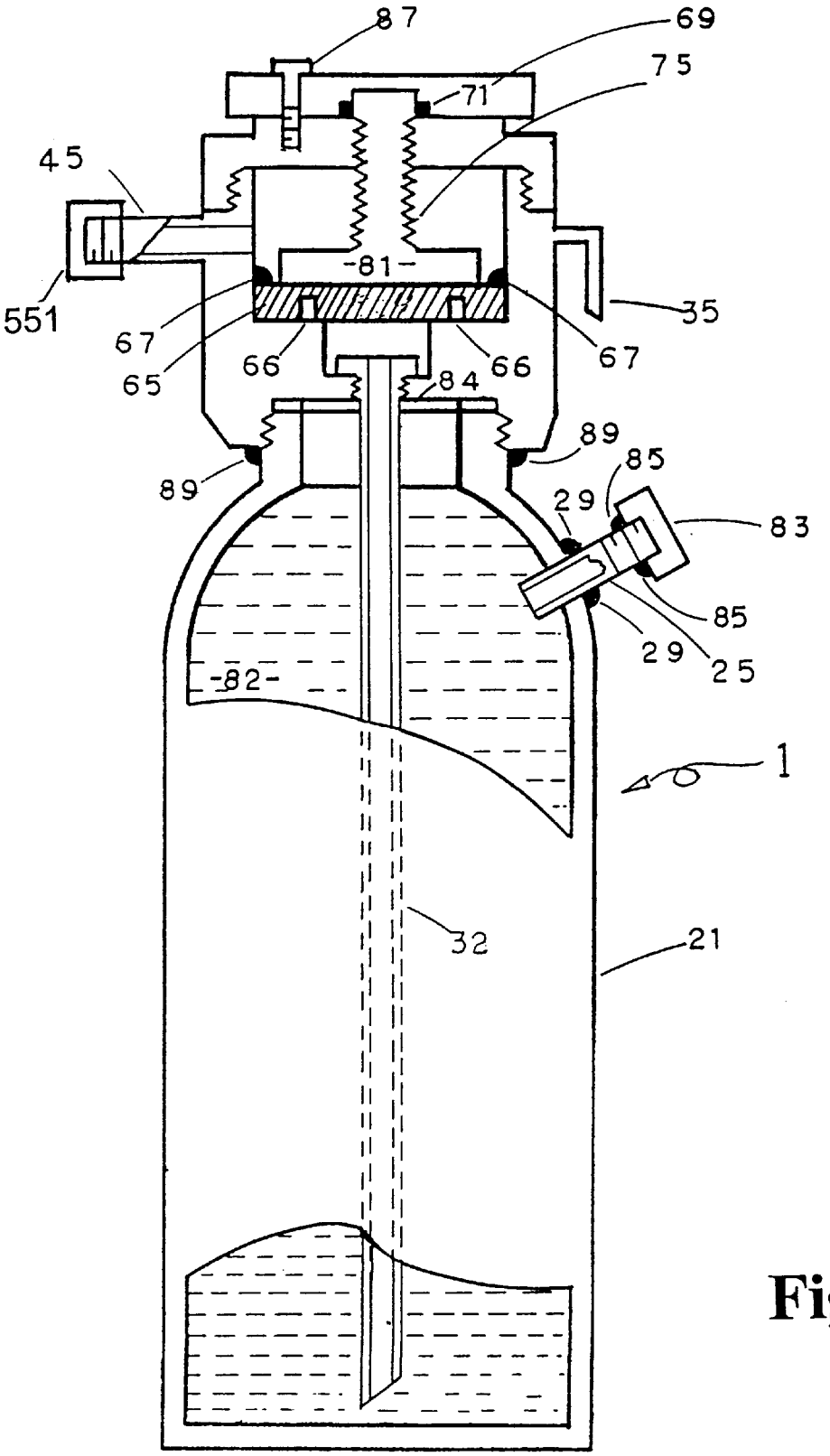
FIG. 1 shows a fire extinguisher of the present invention.
Figure 2:
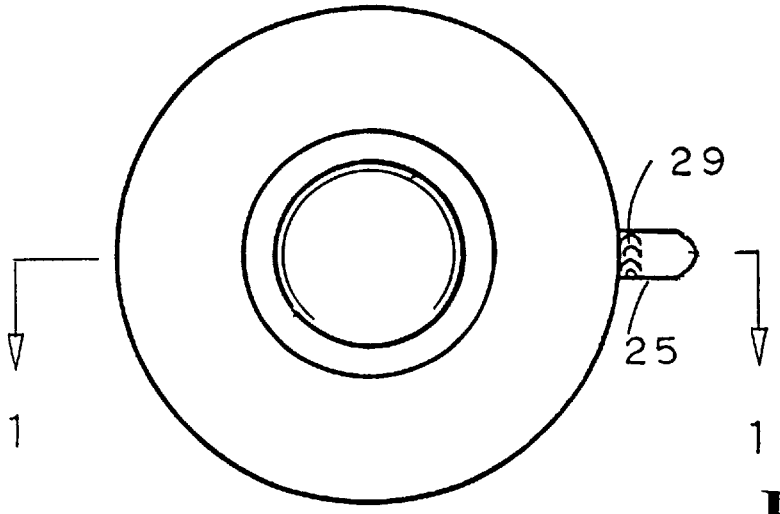
FIG. 2 is a top view of a shell of the present fire extinguisher.
Figure 3:
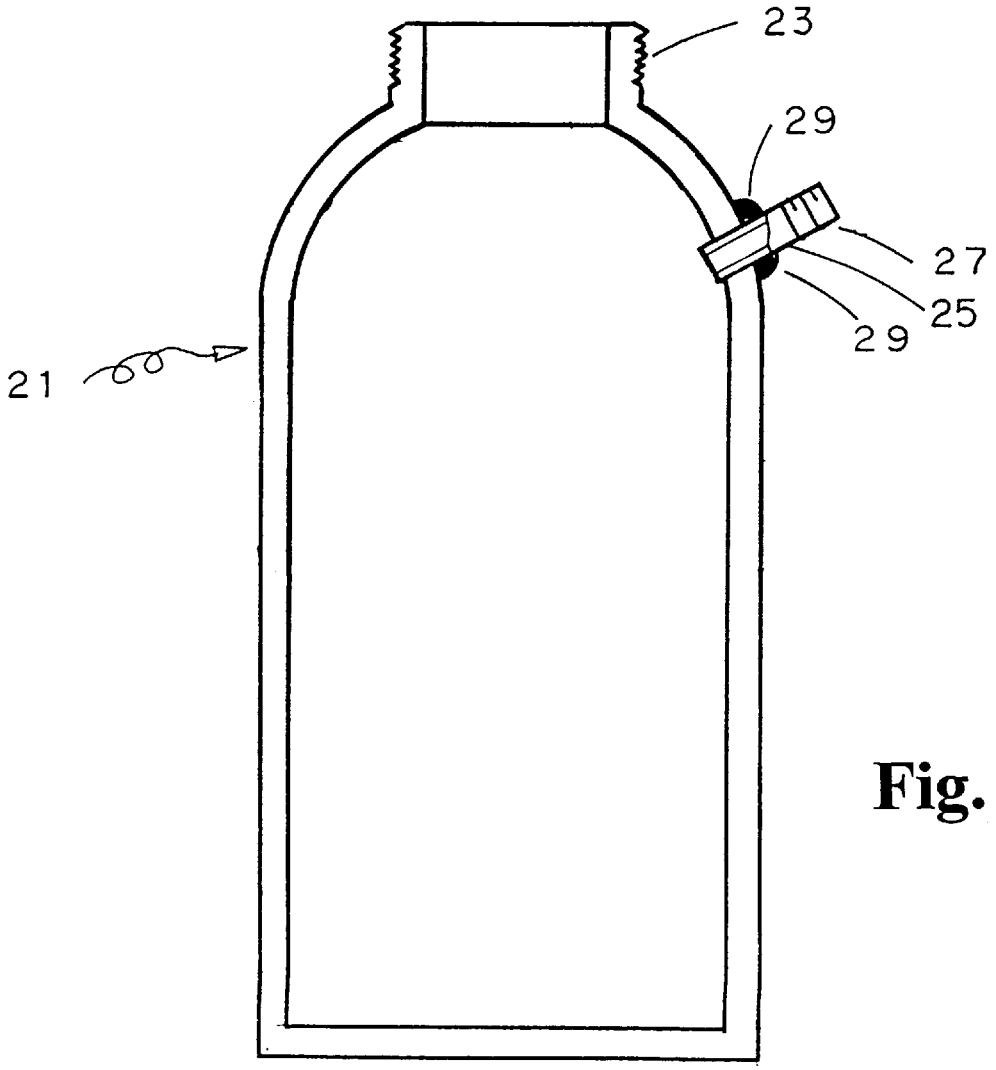
FIG. 3 is a longitudinal section along line 1—1 of FIG. 2.

FIG. 1 shows a fire extinguisher 1 having components as follow:

1. Shell 21 where, FIG. 2 is a top view and FIG. 3 is a sectional-view along line 1—1 of FIG. 2 of shell 21.

Shell 21 is an iron cylinder having an external threaded top edge 23 and a laterally protruding tube 25 extending out from shell 21 through weld 29 where at the end of tube 25 are external threads 27. A cap 83 has its internal threads which can mate tightly with external threads 27.

Tube 25 has general features similar to that of conventional automobile tire inflation tube.

2. Ejection chamber 30

Figure 4:
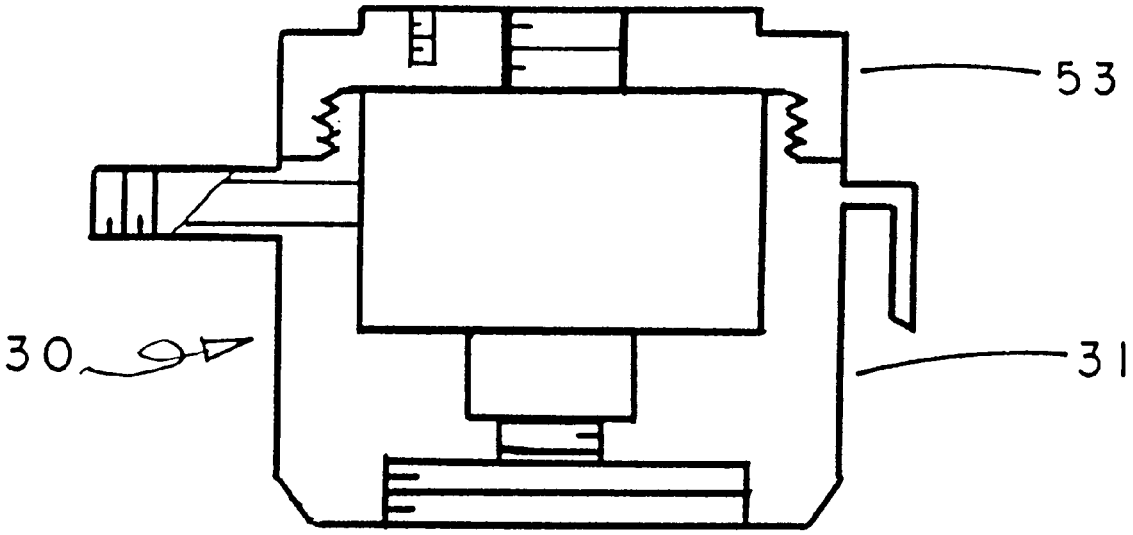
FIG. 4 shows sectional view of an ejection chamber with its lower member and cap.

FIG. 4 shows an ejection chamber 30 having a lower member 31 and a cap 53.

Figure 5:
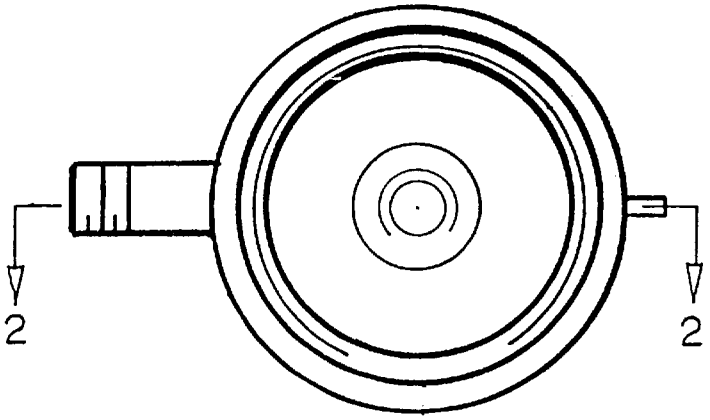
FIG. 5 is a top view of a lower member.
Figure 6:
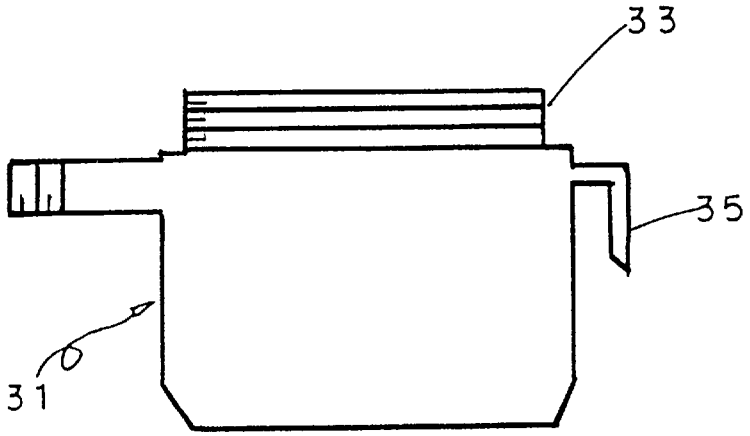
FIG. 6 is a side view of a lower member.
Figure 7:
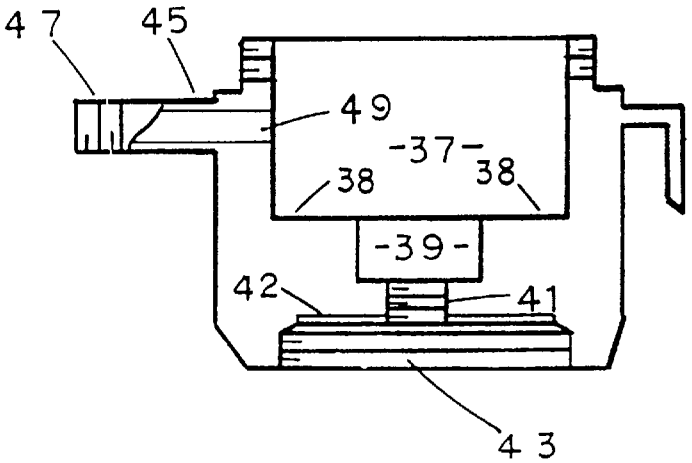
FIG. 7 is a sectional view of a lower member along line 2—2 of FIG. 5.

2.1 Lower Member 31, where, FIG. 5 is a top view,

FIG. 6 is a side view, and FIG. 7 is a sectional-view along line 2—2 of FIG. 5;

as shown in FIGS. 5, 6 and 7, upper edge of this lower member 31 are external threads 33, where at a lower level there are a carrying handle 35 and a discharge tube 45 which extends oppositely to carrying handle 35. The end of discharge tube 45 is external threads 47. The hollow cylindrical space 49 of discharge tube 45 is for conveying fire extinguishing agents from space 39 and space 37 out to the exterior. Space 37 has a diameter greater than space 39 to create abutment 38. Next lower to space 39 are internal threads 41 having diameter shorter than that of space 39. Space 42 is next downwards to internal threads 41 to be fitted with O-ring 84 where downwardly are larger internal threads 43 which can mate tightly to external threads 23 of shell 21.

Figure 8:
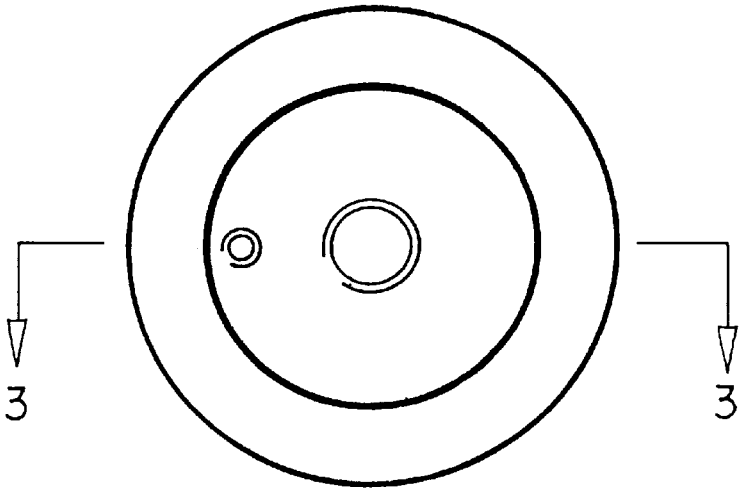
FIG. 8 is a top view of a cap.
Figure 9:
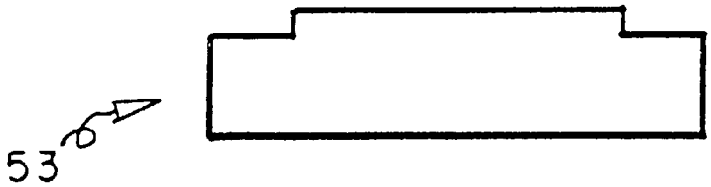
FIG. 9 is a side view of a cap.
Figure 10:
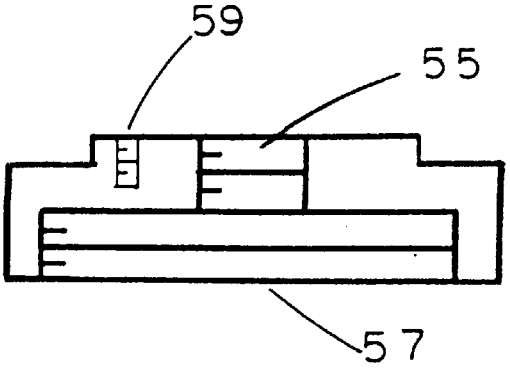
FIG. 10 is a sectional view of a cap along line 3—3 of FIG. 8.

2.2 Cap 53, where, FIG. 8 is a top view,

FIG. 9 is a side view, and FIG. 10 is a sectional-view along line 3—3 of FIG. 8;

as shown in FIGS. 8, 9 and 10, upper part of this cap 53 has internal threads 55 and next are internal threads 57 which have greater diameter than that of internal threads 55. Internal threads 57 can mate tightly with external threads 33 of lower member 31. There is yet another hole with internal threads 59 in the upper part of cap 53.

Figure 11:
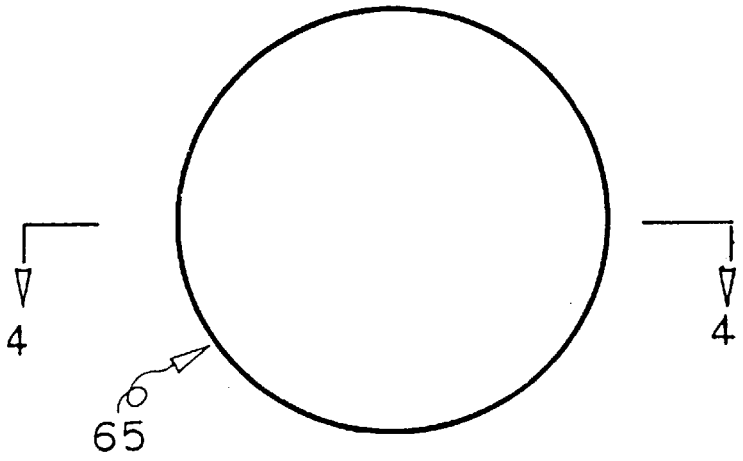
FIG. 11 is a top view of a grooved circular steel plate.
Figure 12:
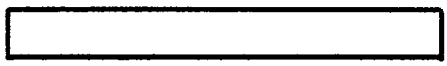
FIG. 12 is a side view of a grooved circular steel plate.
Figure 13:
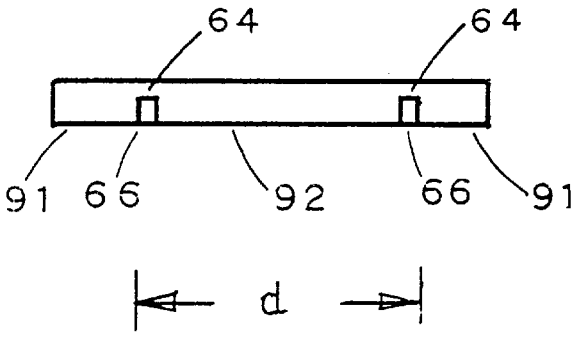
FIG. 13 is a sectional view along line 4—4 of FIG. 11.
Figure 14:
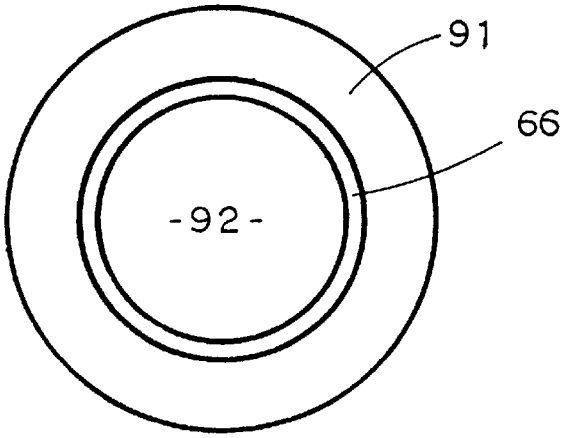
FIG. 14 is a bottom view of a grooved circular steel plate.

3. Grooved Circular Steel Plate 65, where, FIG. 11 is a top view,

FIG. 12 is a side view,

FIG. 13 is a sectional-view along line 4—4 of FIG. 11, and FIG. 14 is a bottom view;

as shown in FIGS. 11, 12, 13 and 14, grooved circular steel plate 65 is a circular steel plate having a diameter just slightly shorter than that of space 37. There is a groove 66 underneath steel plate 65 which divides the steel plate 65 into 2 parts, i.e. part 91 and part 92 as shown in FIG. 14.

This grooved circular steel plate 65 can be made of either stainless steel or brass or any kind of metal that is rust-proof yet can be welded to stainless steel.

The part of metal 64 left over groove 66, by itself can not withstand the pressure or the force within the fire extinguisher.

Figure 16:
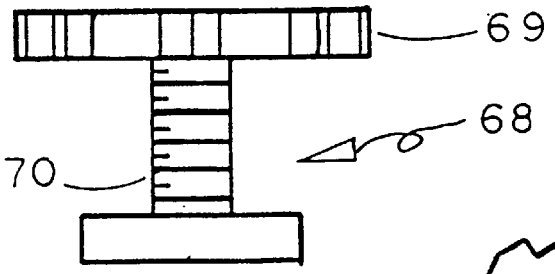
FIG. 16 is a side view of a pressing set.
Figure 15:
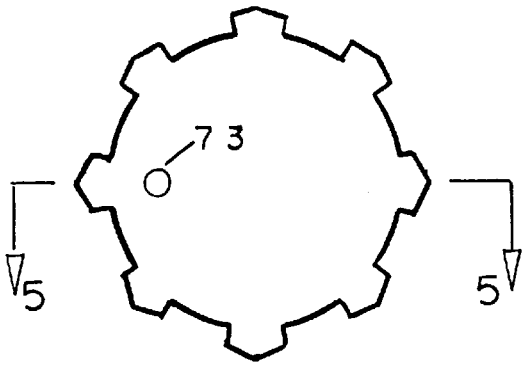
FIG. 15 is a top view of a pressing set.
Figure 17:
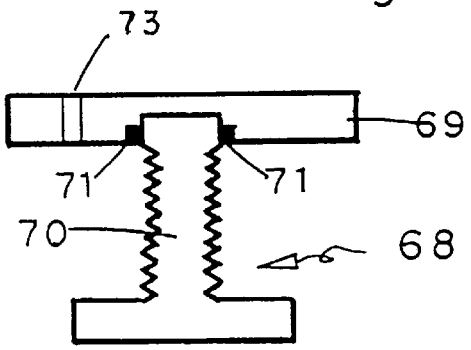
FIG. 17 is a sectional view along line 5—5 of FIG. 15.
Figure 18:
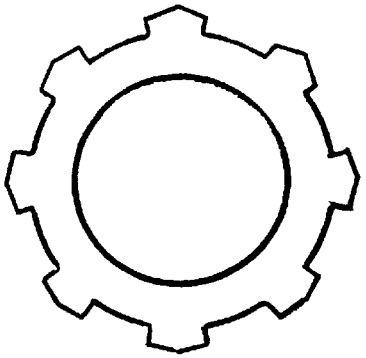
FIG. 18 is a bottom view of a pressing set.

4. Pressing Set 68, where, FIG. 15 is a top view,

FIG. 16 is a side view,

FIG. 17 is a sectional-view along line 5—5 of FIG. 15, and FIG. 18 is a bottom view;

as shown in FIGS. 15, 16, 17 and 18, Pressing set 68 consists of 2 parts, i.e.

Figure 20:
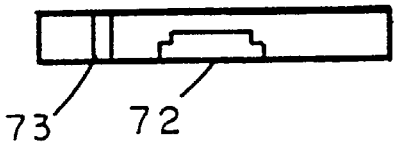
FIG. 20 is a sectional view along line 6—6 of FIG. 19.
Figure 19:
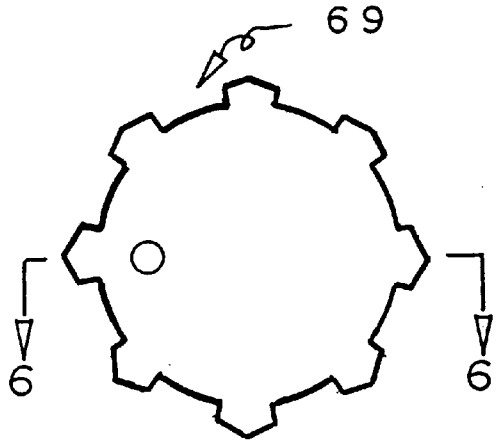
FIG. 19 is a top view of a releasing knob.

4.1 Releasing Knob 69, where, FIG. 19 is a top view,

FIG. 20 is a sectional-view along line 6—6 of FIG. 19, is a knob having a circular space 72 underneath and a hole 73 which is lightly greater than the internal threads 59.

Figure 21:
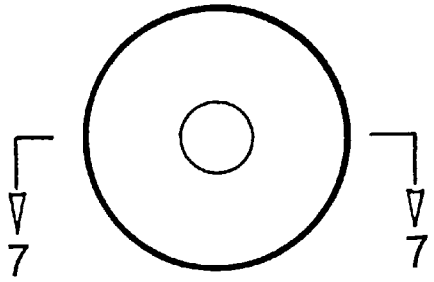
FIG. 21 is a top view of a pressing member.
Figure 22:
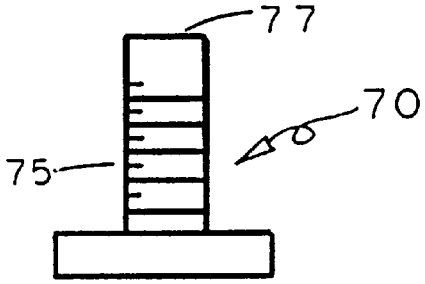
FIG. 22 is a side view of a pressing member.
Figure 23:
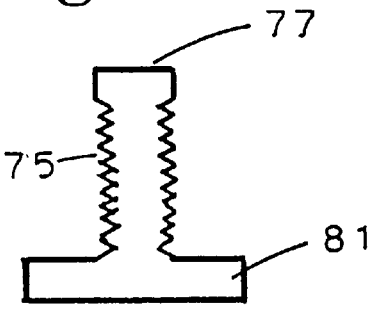
FIG. 23 is a sectional view along line 7—7 of FIG. 21.

4.2 Pressing Member 70, where, FIG. 21 is a top view,

FIG. 22 is a side view,

FIG. 23 is a sectional-view along line 7—7 of FIG. 21;

is a round stem with external threads 75 having its lower end as circular steel plate 81 of 1 cm. thickness where its cut upper end 77 has a diameter slightly smaller than that of circular space 72.

Assembly of a Manual Fire Extinguisher:

1. Mate external threads of a conventional siphon tube 32 with internal threads 41 of lower member 31,
2. place grooved circular steel plate 65 onto abutment 38 to have groove 66 facing downwardly,
3. weld grooved circular steel plate 65 to the inner wall of lower member 31 of ejection chamber 30 with fillet weld 67,
4. mate external threads 75 through internal threads 55 to have cut end 77 sticking over cap 53 with circular steel plate 81 hanging down,
5. fit circular space 72 onto cut end 77 and weld them together with fillet weld 71,
6. as from 4.–5., cap 53 is assembled to pressing set 68,
7. mate internal threads 57 of assembled cap 53 to external threads 33 of lower member 31 of ejection chamber 30 (assembled in 1.–3.);
8. turning releasing knob 69 downwards until circular steel plate 81 presses tightly onto grooved circular steel plate 65 where in this manner groove 66 is pressed in between circular steel plate 81 and abutment 38 and thus can withstand the pressure inside shell 21 no matter how great the pressure is, as long as groove 66 is sandwiched between circular steel plate 81 and abutment 38. Circular steel plate 81 pressing in this manner can withstand pressure inside shell 21. Hole 73 is aligned with internal threads 59. A hexagonal head bolt 87 is inserted through hole 73 and screwed by hand to fit tightly to internal threads 59 to fix circular steel plate 81 tightly to grooved circular steel plate 65;

Any other means that can fix circular steel plate 81 tightly to grooved circular steel plate 65 can also be used providing it can be taken off easily and rapidly in urgency;

9. fill fire extinguishing agent 82 (can be either as chemical powder or liquefied gas) into shell 21 and place O-ring 84 on upper edge of shell 21;
10. mate internal threads 43 tightly to external threads 23 to fit the assembled parts from 1.–8. to shell 21 filled with fire extinguishing agent 82.

In this manner the slant tip of siphon tube 32 will be very close to the bottom of shell 21;

11. weld the two parts, ejection chamber and shell, together by fillet weld 89;
12. fill propellant (here, uses $N_2$)through tube 25 to give a desirable pressure inside shell 21, assumingly 10 bar (1 bar=14.75 psi, =1 atmosphere);
13. close cap 83 tightly to external threads 27 at the end of tube 25;
14. weld cap 83 to the end of tube 25 by fillet weld 85;
15. turn a plastic cap 551 to mate its internal threads with the external threads at the end of discharge tube 45. In case this plastic cap 551 is broken, there indicates that this fire extinguisher has been used since the pressurized fire extinguishing agent when discharged is predetermined to be capable of breaking the plastic cap 551.

Figure 24:
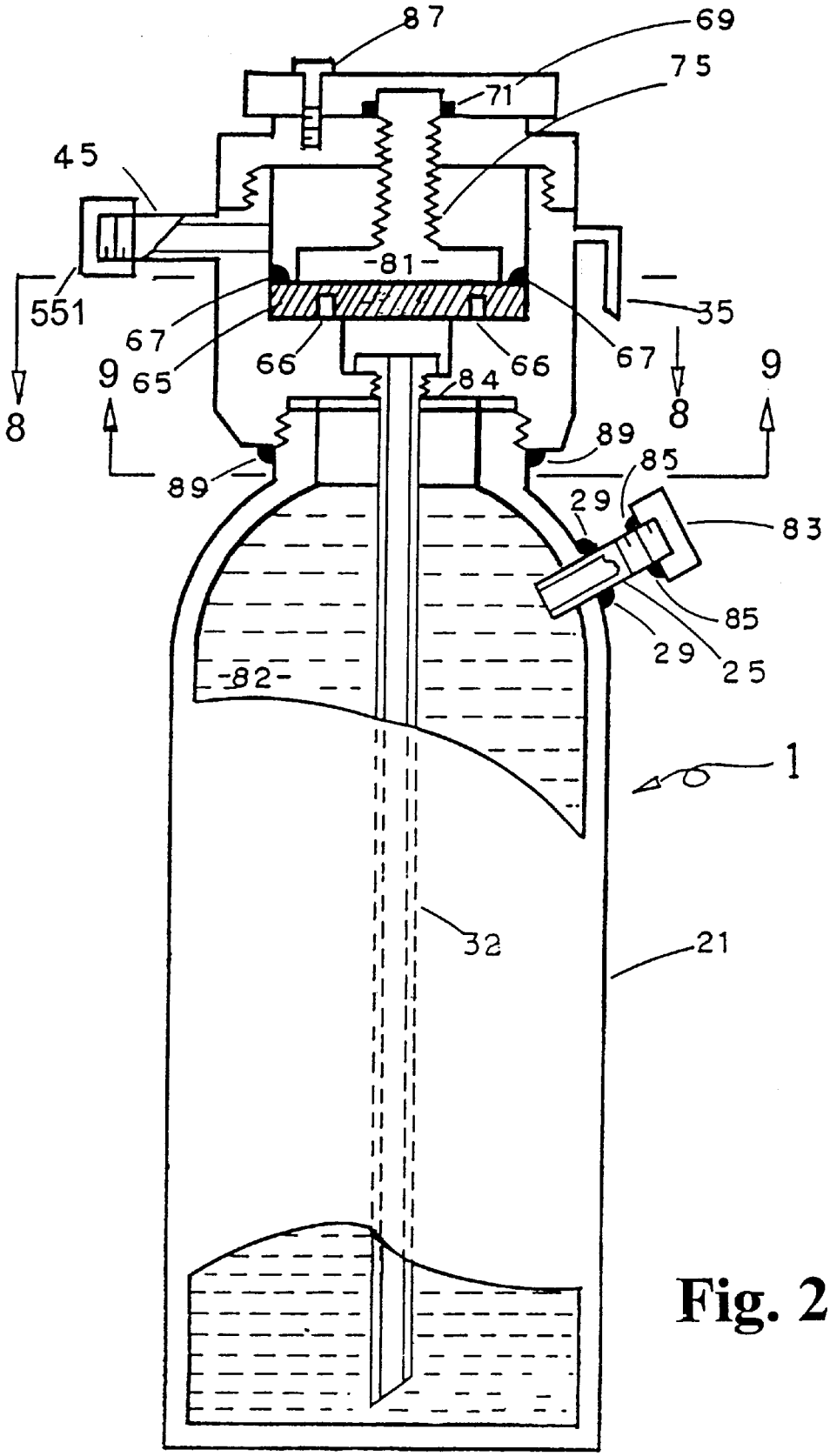
FIG. 24 is a sectional view of an assembled fire extinguisher of the present invention.

After putting together all the components as in 1. through 15., a presently invented fire extinguisher is assembled as shown in FIG. 24.

In case both fire extinguishing agent and propellant are in liquefied form, they can be directly filled into shell 21 where siphon tube 32 together with tube 25 are then unnecessary.

Figure 25:
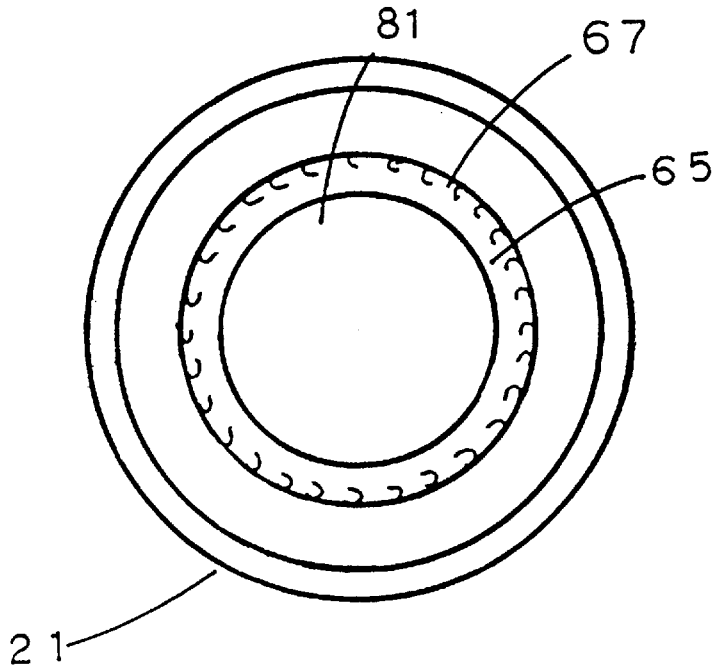
FIG. 25 is a sectional view along line 8—8 of FIG. 24.
Figure 26:
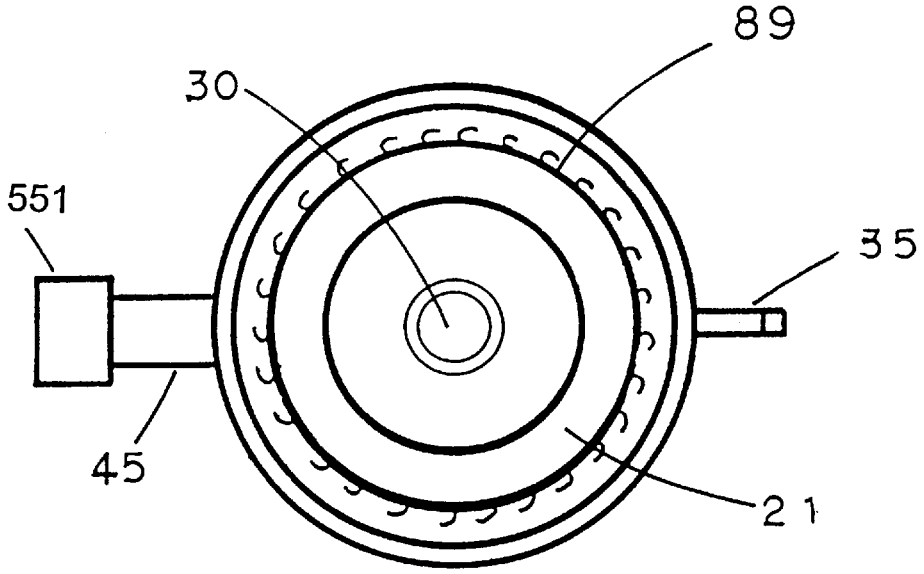
FIG. 26 is a sectional view along line 9—9 of FIG. 24.

As in FIGS. 25 and 26, fillet welds 67 and 89 are seen upon sectioning along lines 8—8 and 9—9 of FIG. 24, respectively.

Fillet welds 29, 85, 89 and 67 all are made to be strong enough to withstand the pressurized force within the fire extinguisher throughout the operation.

Figure 27:
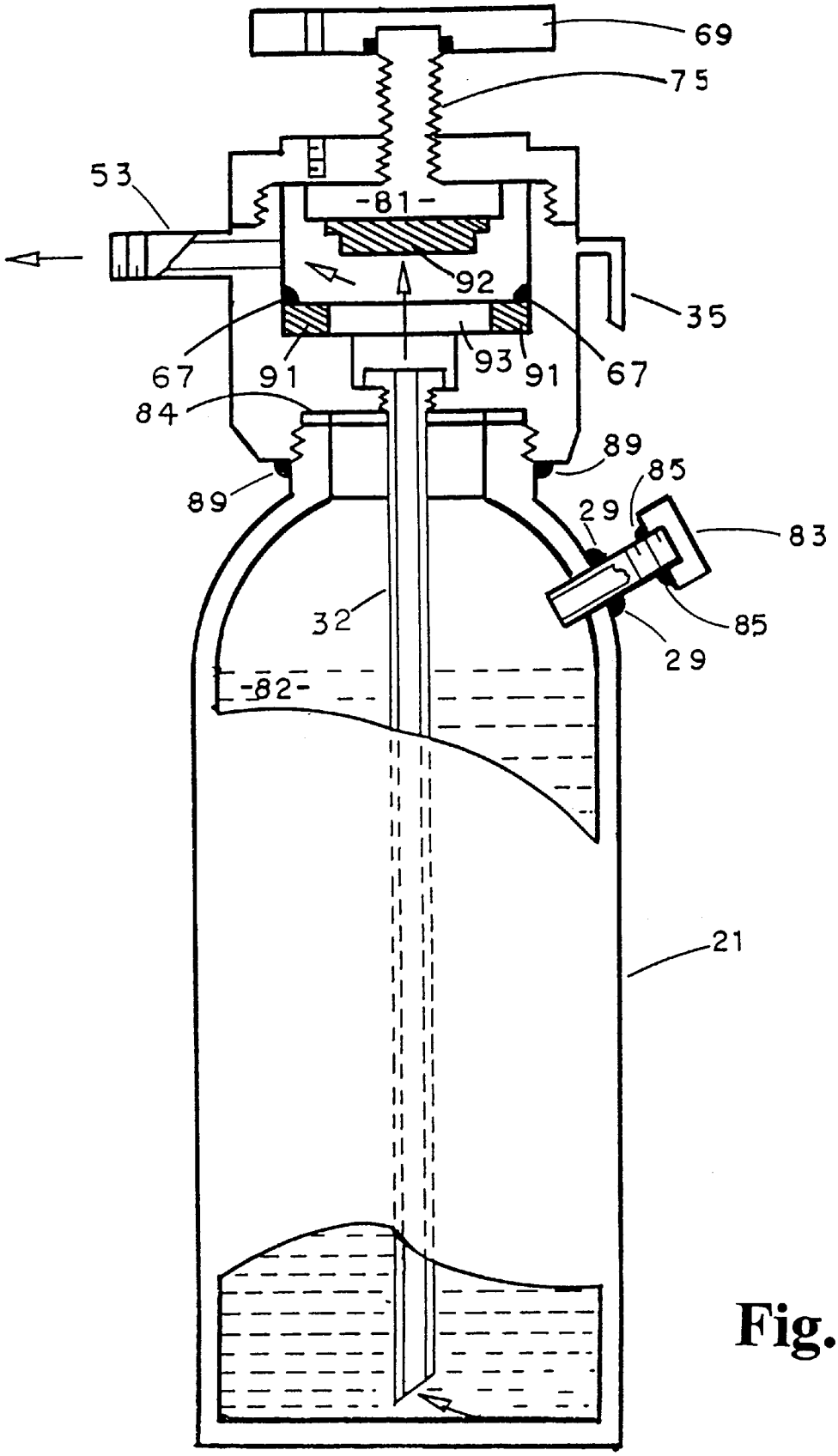
FIG. 27 is a partially sectional view of the present fire extinguisher showing arrows indicating ejection of fire extinguishing agent upon removal of pressing set.

Upon breaking out of fire, an operator turns hexagonal head bolt 87 and releases it from hole 73 while turning knob 69 up to lift circular steel plate 81 from pressing on grooved circular steel plate 65. The pressure within shell 21 thereby tears and pushes part 92 away from part 91 of grooved circular steel plate 65 along groove 66 to form a hole 93 while part 91 remains welded to ejection chamber 30 through fillet weld 67. The fire extinguishing agent is thus ejected through this hole 93 in the arrow direction as shown in FIG. 27.

Figure 28:
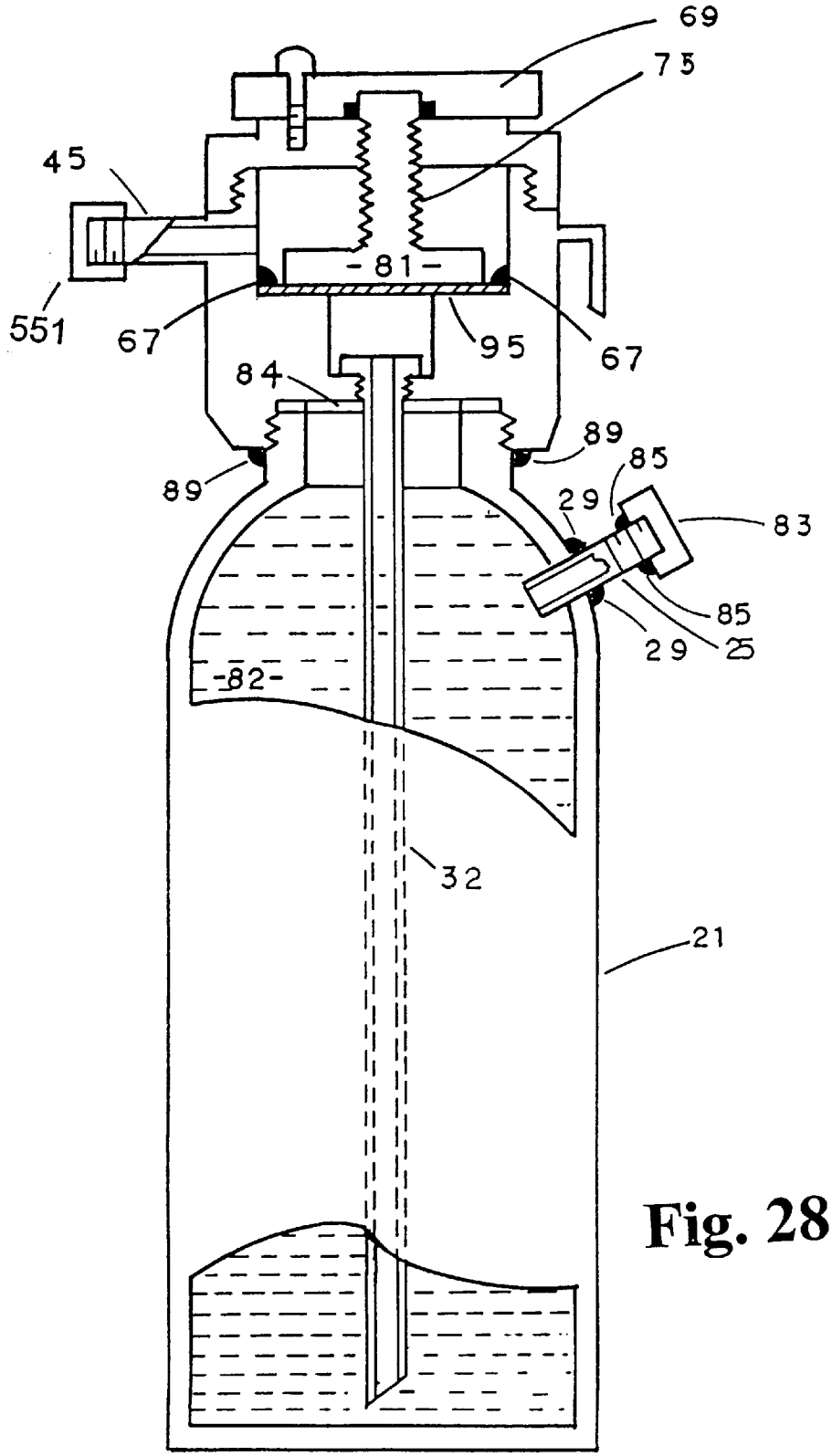
FIG. 28 is a partially sectional view of the present fire extinguisher showing a different embodiment using a circular steel plate with thinner central space welded to ejection chamber.
Figure 29:
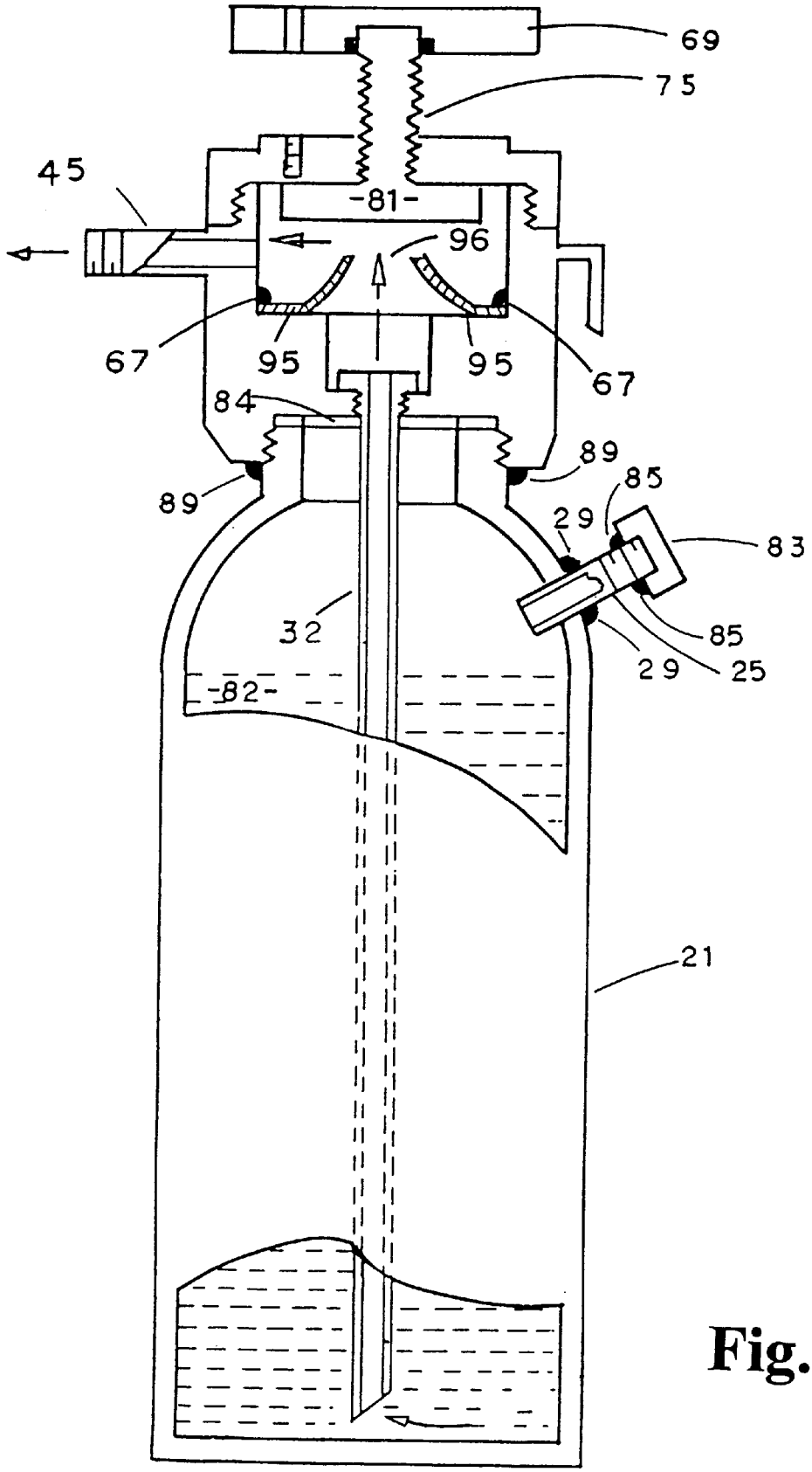
FIG. 29 is a partially sectional view of the present fire extinguisher showing ejection of fire extinguishing agent through a hole formed in the center of a circular steel plate with thinner central space upon removal of pressing set.

In another embodiment, as shown in FIG. 28, instead of using grooved circular steel plate 65, a circular steel plate 1651 can also be used, assigning that a circular space at its center is much thinner than at its periphery. Circular steel plate 1651 rests upside down on shoulder 112 where it is welded by fillet weld 67 to ejection chamber 30 with circular steel plate 81 pressing on top. Thus, when circular steel plate 81 is lifted up, thin metal part at the center of circular steel plate 1651 is then torn away to form hole 931 and fire extinguishing agent is ejected out through hole 931 as in FIG. 29.

Figure 29A:
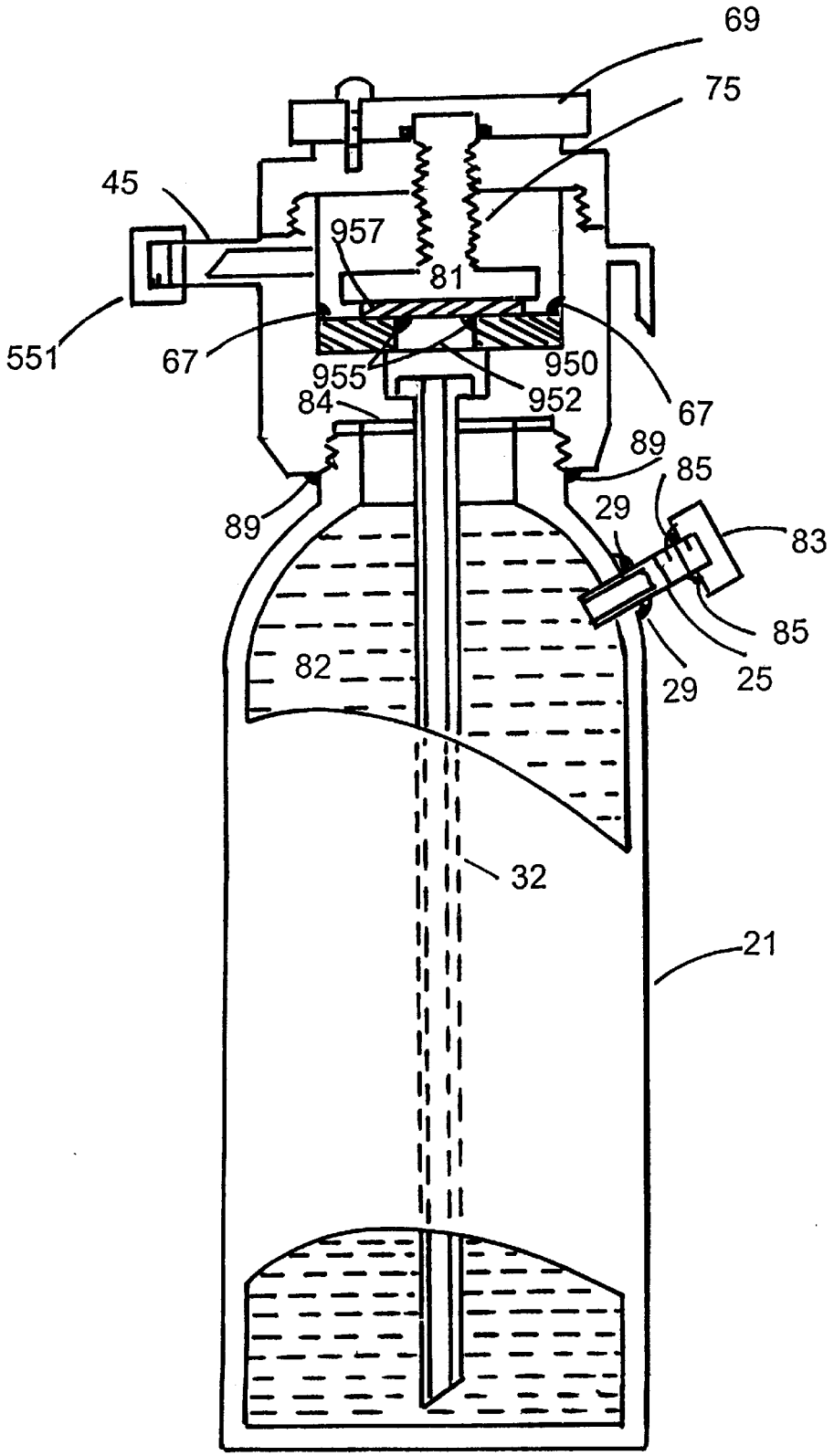
FIG. 29A is a partially sectional view of the present fire extinguisher showing a different embodiment using a thin circular steel plate welded to cover cavity in a circular steel plate mounted to ejection chamber through fillet weld.

Yet, FIG. 29A is another embodiment where a circular steel plate 950 is mounted to ejection chamber 30 through fillet weld 67. There is a circular cavity 952 at the center of circular steel plate 950. A thin circular steel plate 957 is placed on and welded to circular steel plate 950 to cover cavity 952 through fillet weld 955. In standby situation, there is a pressor circular steel plate 81 is pressed on top of thin circular steel plate 957.

Figure 29B:
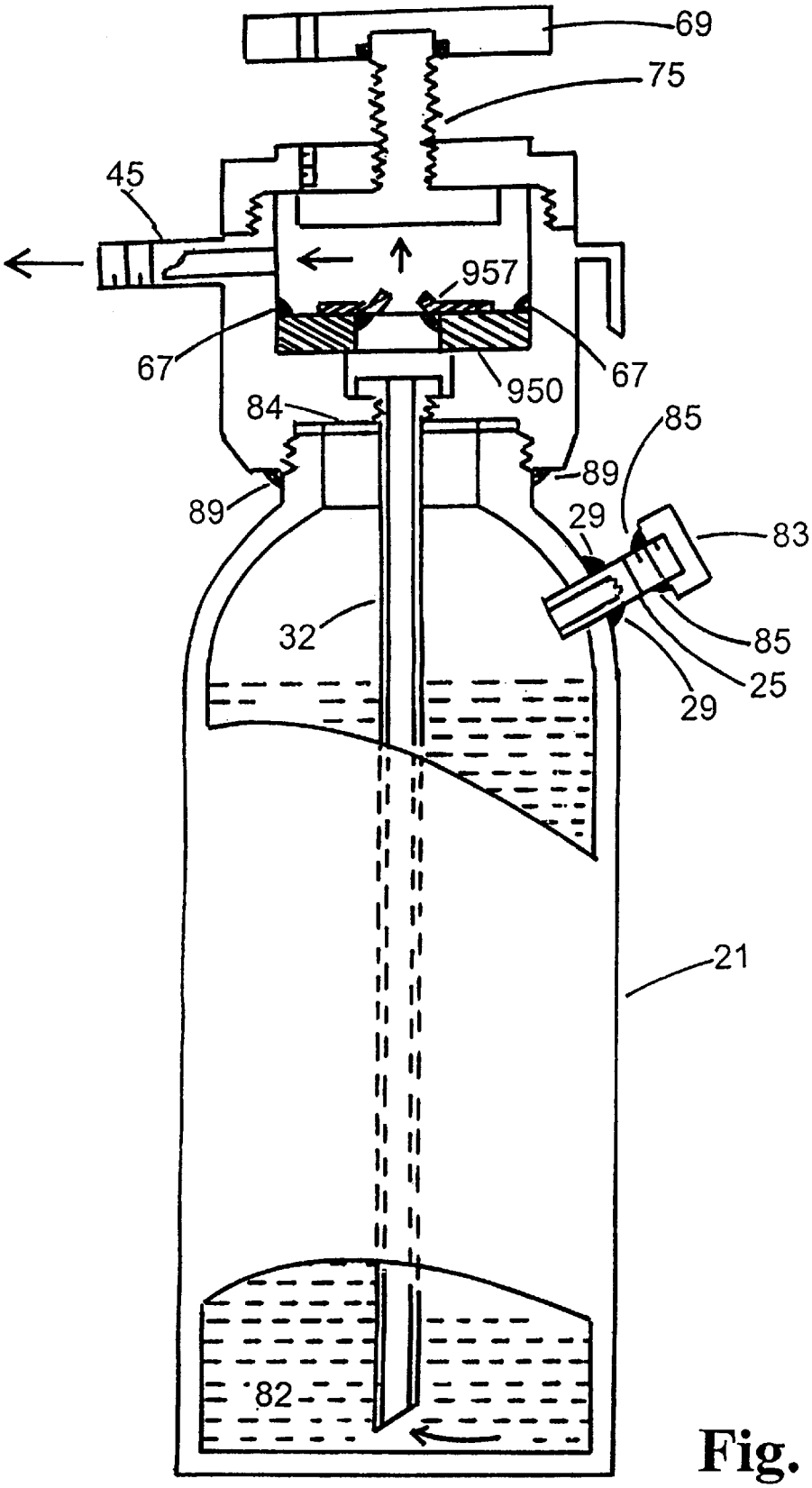
FIG. 29B is a partially sectional view of the present fire extinguisher showing ejection of fire extinguishing agent through a hole formed in thin circular steel plate of FIG. 29A.

Thin circular steel plate 957 by itself can not withstand the pressure within fire extinguisher 98. Thus, when a fire breaks out and pressor steel plate 81 is lifted up, pressure inside shell 21 forces resulting in a hole being formed in the circular steel plate 957. Extinguishing agent 162 is then ejected to put out fire as shown in FIG. 29B.

Figure 30:
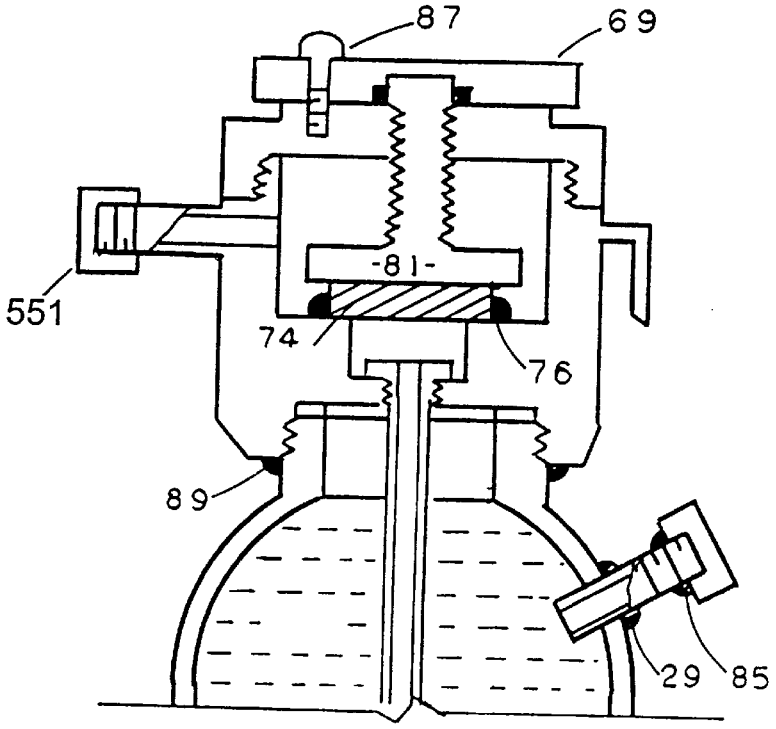
FIG. 30 is a sectional view showing a different embodiment of the present fire extinguisher using plain thick steel plate mounted to abutment of ejection chamber through fillet weld.
Figure 31:
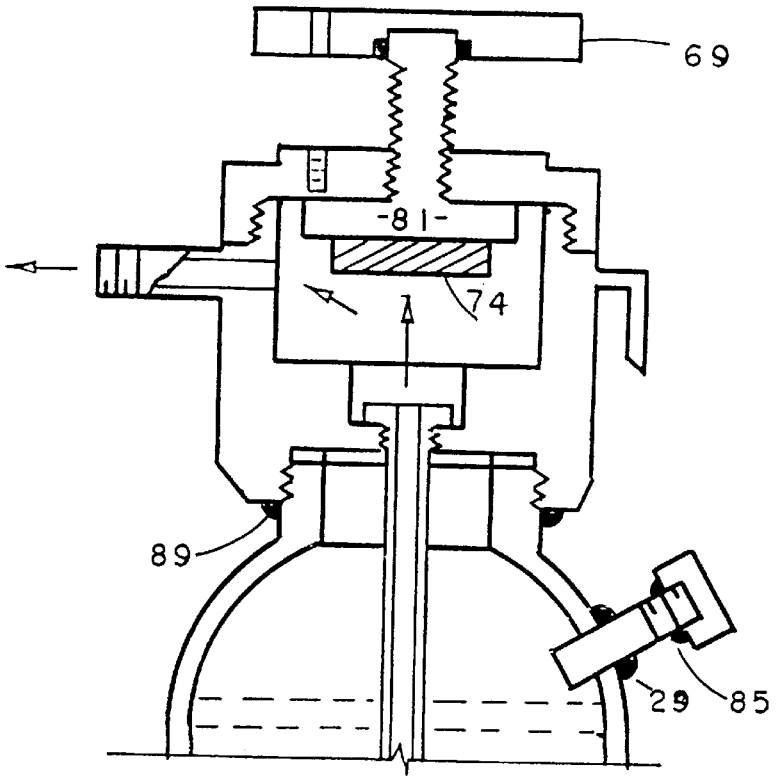
FIG. 31 is a sectional view showing ejection of fire extinguishing agent upon lifting of pressing set to cause detachment of plain thick steel plate mounted to abutment of ejection chamber through fillet weld.

Yet another embodiment can be used according FIG. 30, where a plain thick steel plate 74 without a groove is welded to abutment 38 of ejection chamber 30 through fillet weld 76 and is pressed tightly on top by circular steel plate 81. Plain thick steel plate by itself can withstand the pressure inside shell 21. However, fillet weld 76 is predetermined not to be strong enough that it can not withstand the pressure inside shell 21. When circular steel plate 81 is lifted up, fillet weld 76 is then broken up and plain thick steel plate 74 is pushed away. Fire extinguishing agent is then ejected out.

Figure 32:
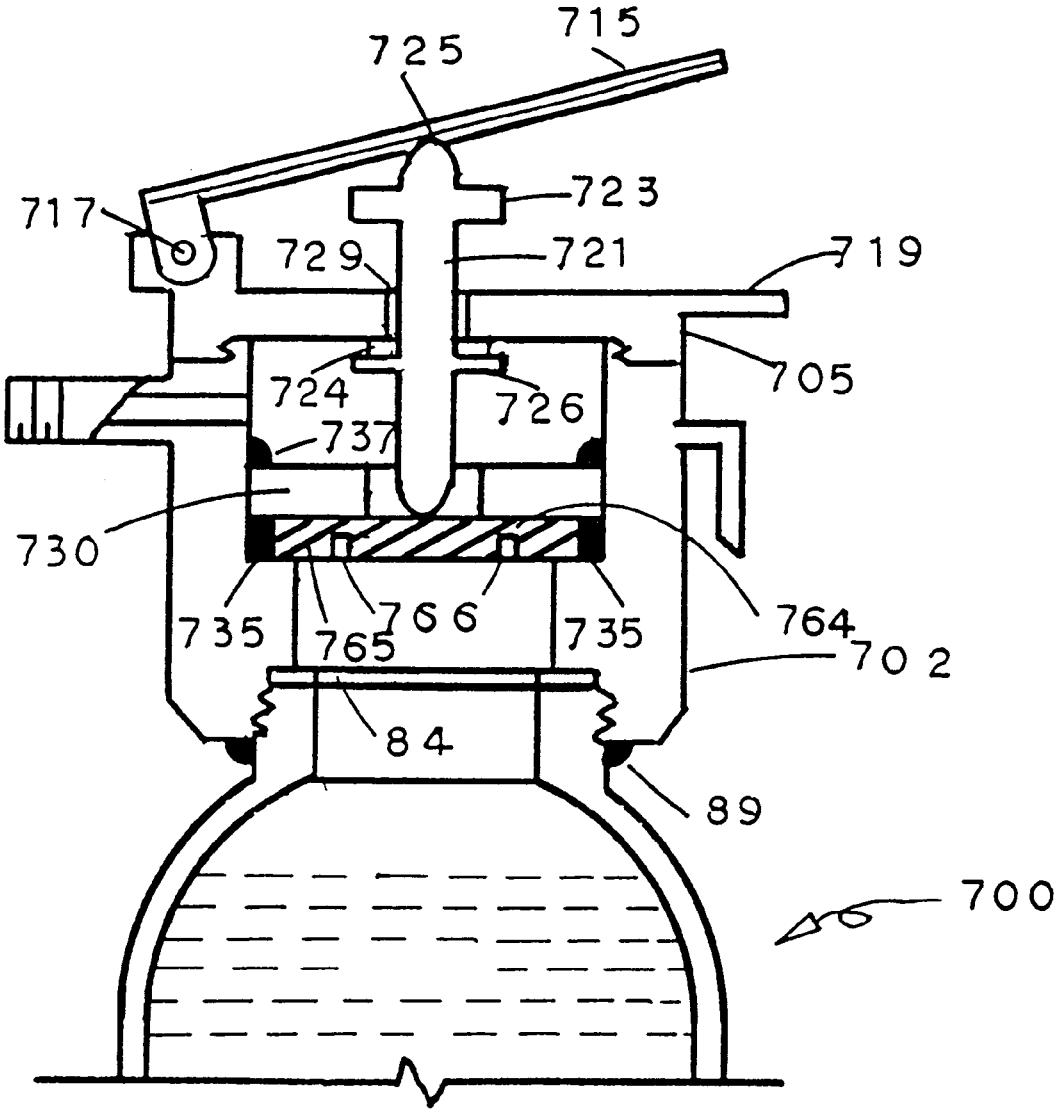
FIG. 32 is a sectional view showing a different embodiment of the present fire extinguisher using a pressing stick to cause a hole for ejection of fire extinguishing agent.

In the fourth embodiment, as shown in FIG. 32, a fire extinguisher 700 consists of an ejection chamber 702 having a lower member 703 identical to lower member 31 of ejection chamber 30. The difference is cap 705 which consists of an operating lever 715 having a fulcrum 717. Operating lever 715 rests on an upper end 725 of a pressing stick 721. Down next from upper end 725 is a circular wing 723. About the middle of pressing stick 721 is another circular wing 726 which locates underneath cap 705 having a rubber O-ring 724 underneath cap 705 but above wing 726. Both wings 723 and 726 have diameters greater than that of hole 729 in the center of cap 705 and help preventing pressing stick 721 from slipping off from cap 705. Upon pressing stick 715 by operating lever 715, stick 715 moves vertically through hole 729, where hole 729 can help holding stick 715 in an upright position at all time.

Grip 719 extends out from cap 705 in the same direction as operating lever 715.

Figure 33:
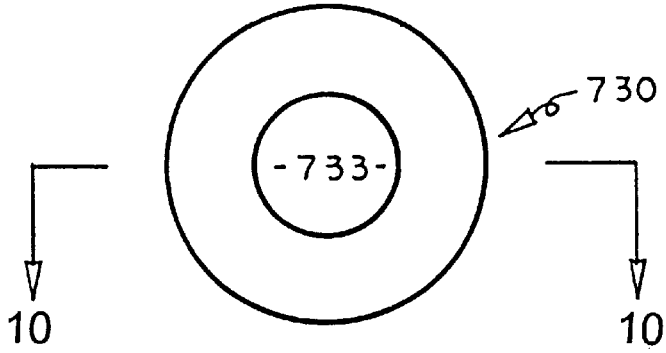
FIG. 33 is a top view of a pressing steel plate of an embodiment of the present fire extinguisher using a pressing stick to cause a hole for ejection of fire extinguishing agent.
Figure 34:
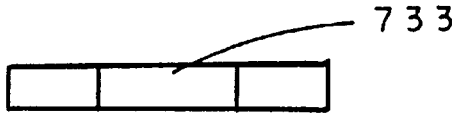
FIG. 34 is a sectional view along line 10—10 of FIG. 33.

From FIG. 33 which is a top view and FIG. 34 which is a sectional view along line 10—10 of FIG. 33, pressing steel plate 730 is a circular steel plate having a hole 733 in the center where diameter of hole 733 is about twice the diameter of pressing stick 721.

A grooved circular steel plate 765 rests on abutment 38 where groove 766 faces downwards and is not on abutment 38. Fillet weld 735 welds at the edge of grooved circular steel plate 765 to fix it tightly to ejection chamber 702.

Pressing steel plate 730 is placed on to grooved circular steel plate 765 and welded to ejection chamber 702 by fillet weld 737.

Cap 705 is tightly fitted to lower member 703 to make the lowest end of pressing stick 721 rests on the center of grooved circular steel plate 765 while operating lever 715 rests on the upper end 725 of a pressing stick 721.

Figure 35:
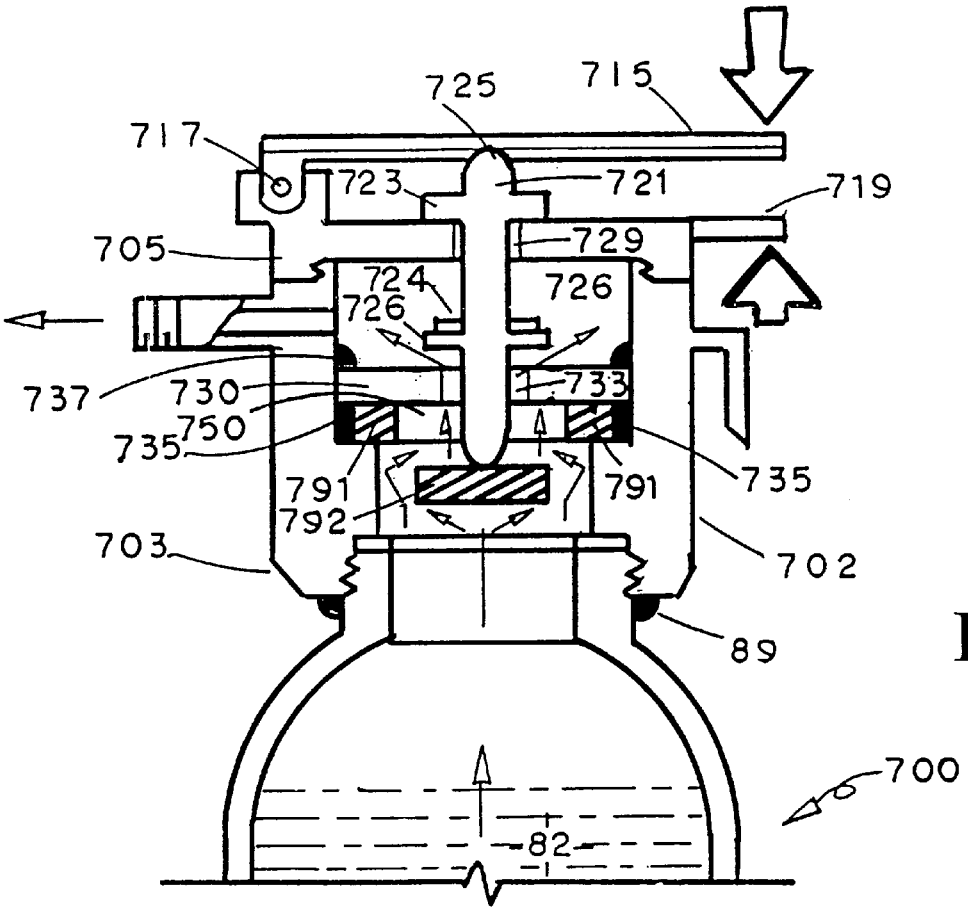
FIG. 35 is a sectional view showing how fire extinguishing agent is ejected from the present fire extinguisher using a pressing stick to cause a hole in the upper wall of shell.

Upon an outburst of fire, as shown in FIG. 35 operating lever 715 and grip 719 are squeezed together until pressing stick 721 pushes down onto grooved circular steel plate 765 to tear apart remnant metal 764 above groove 766 to form a hole in the center. Remnant metal 764 above groove 766 is designed not to withstand the pressing force of pressing stick 721. Grooved circular steel plate 765 is then torn into two parts, part 792 and part 791 where the latter one still remained connected to ejection chamber 30 through fillet weld 735. Hole 750 is formed in the center of steel plate 765 and allows extinguishing agent to be ejected out through hole 733 and discharge tube 45 to the fire.

Simultaneously, wing 723 presses onto cap 705 that it seals hole 729 and allows no leakage of extinguishing agent.

Figure 36:
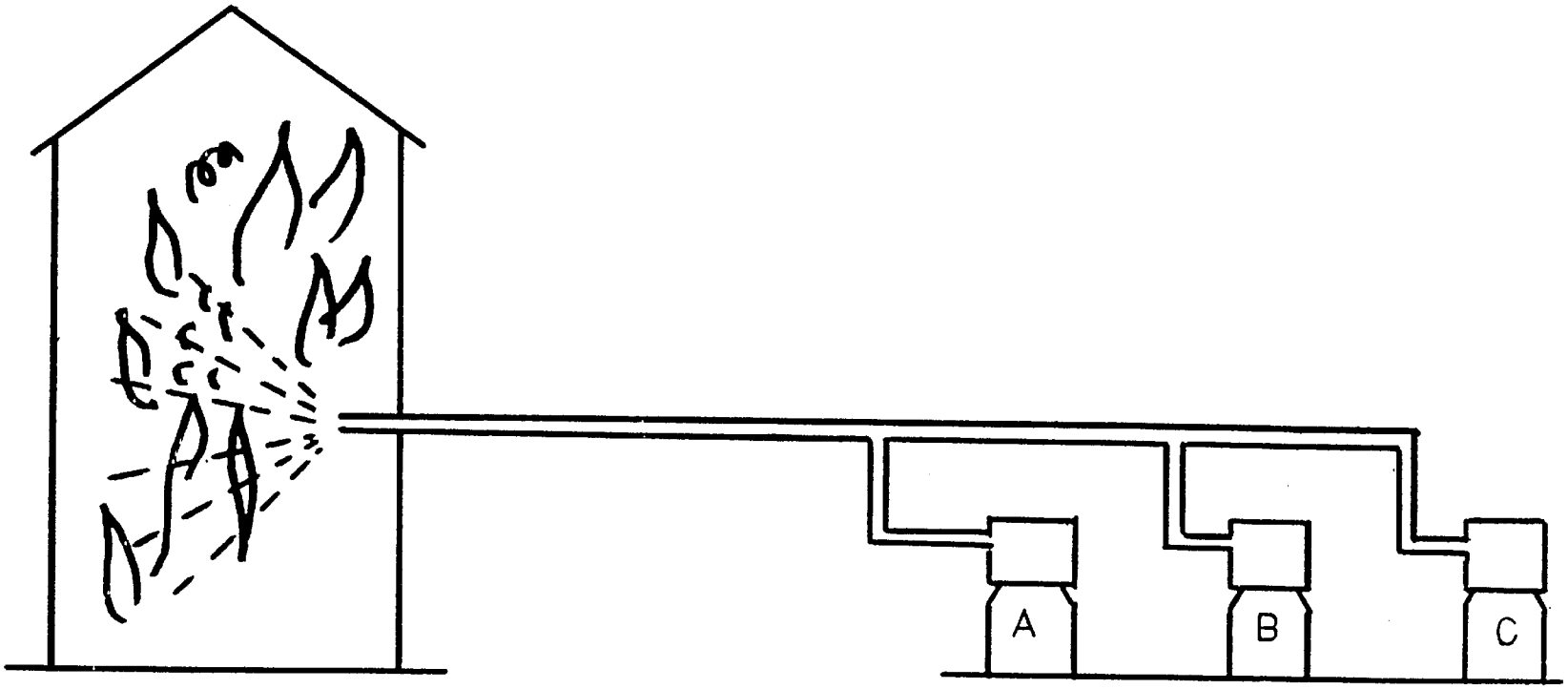
FIG. 36 shows how a number of fire extinguishers of the present invention are connected in series for manual operation.

When using several of the fire extinguishers described above connected in series as shown in FIG. 36, the set of these fire extinguishers can be manually operated to put out those fire outbursts in chemical or poisonous material storehouse where an operator can not enter the area. He can then operate at a distance where the fire extinguishers are located at somewhere far away from storehouse, eg. 200 meters or more, connecting through piping into storehouse to eject extinguishing agent out from several points in storehouse.

Assuming extinguishing agent in each fire extinguisher can be exhausted in 60 seconds, thus at a fire outburst an operator will start operating the first fire extinguisher A as described above. If fire is put out within 60 seconds, there will be no need to operate a next one. However, the next fire extinguisher B and C can be used in series until fire is put out.

Figure 37:
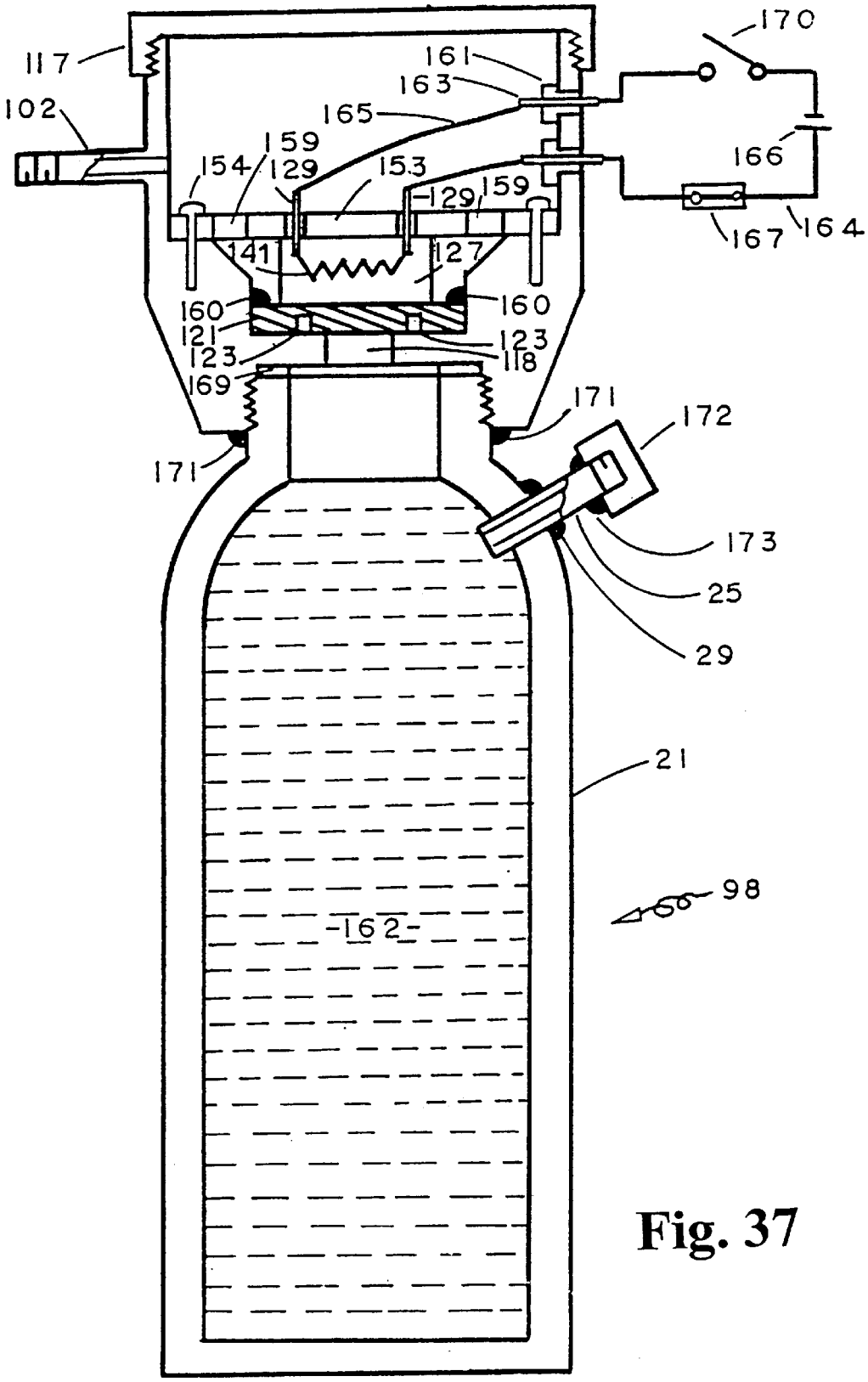
FIG. 37 shows sectional view of fire extinguisher to be used in automatic fire extinguishing system.
Figure 38:
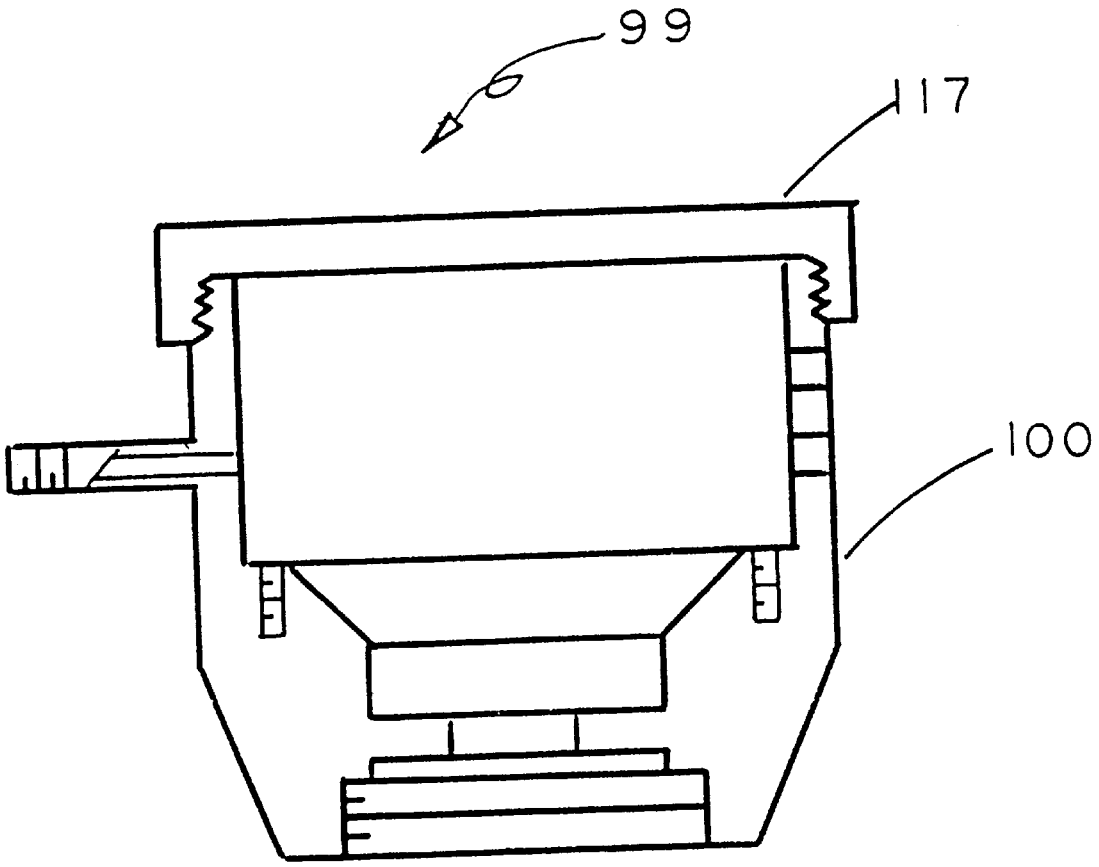
FIG. 38 is a sectional view of an ejection chamber of fire extinguisher to be used in automatic fire extinguishing system.
Figure 39:
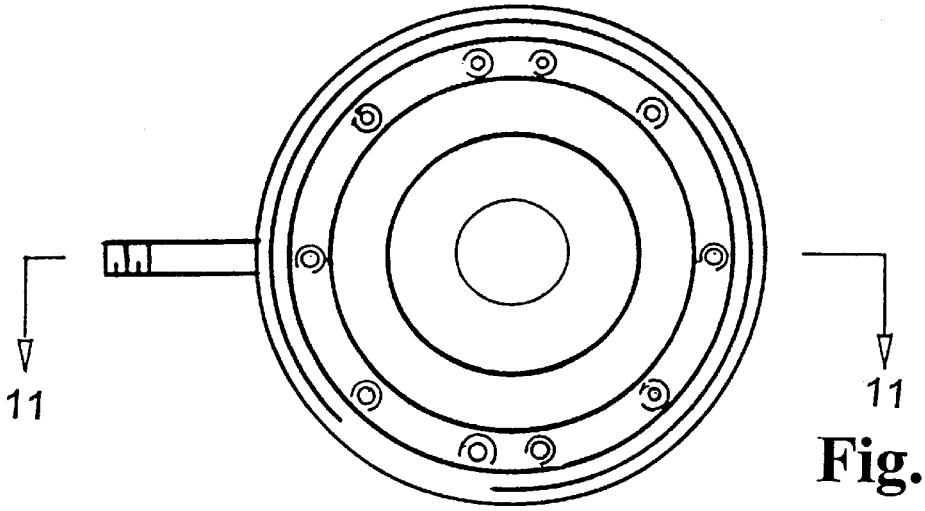
FIG. 39 is a top view of a lower member of an ejection chamber of fire extinguisher to be used in automatic fire extinguishing system.
Figure 40:
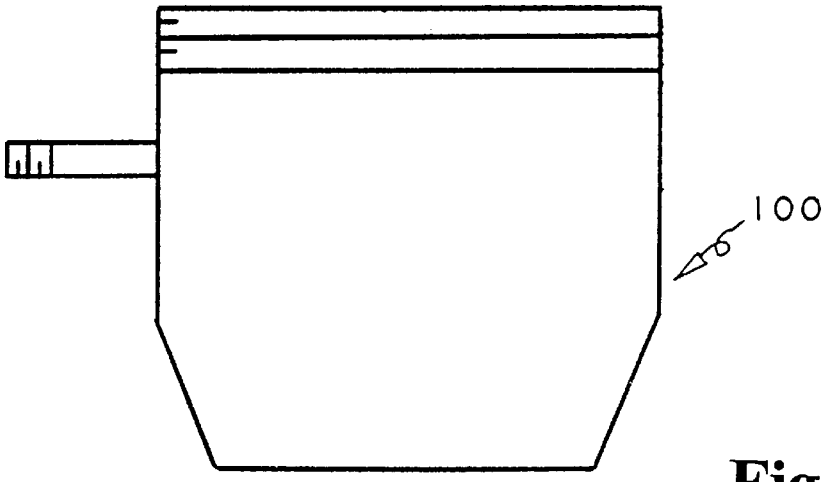
FIG. 40 is a side view of a lower member of an ejection chamber of fire extinguisher to be used in automatic fire extinguishing system.
Figure 41:
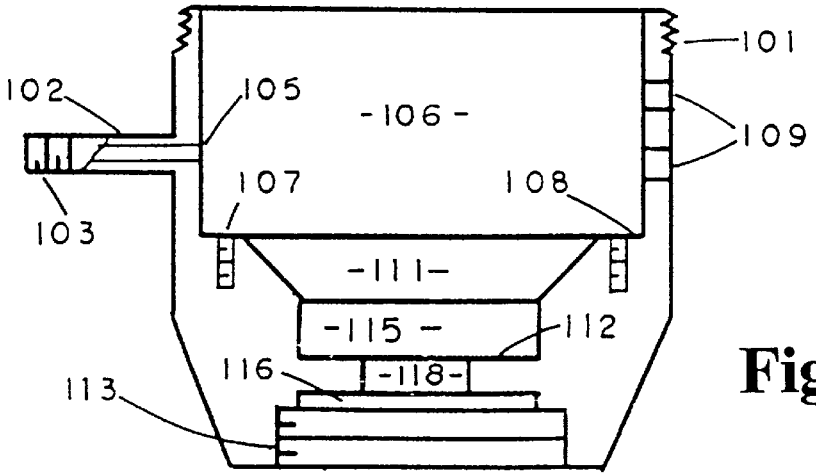
FIG. 41 is a sectional view along line 11—11 of FIG. 39.

Fire Extinguisher to be used in Automatic Fire Extinguishing System:

Similary yet with slight modifications, as shown in FIG. 37, a fire extinguisher 98 presently invented to be used in an automatic fire extinguishing system is composed of:

1. Shell 21 to contain fire extinguishing agent and propellant;

2. Ejection chamber 99 of fire extinguisher 98 consists of a lower member 100 and a cap 117 as shown in FIG. 38, 2.1 lower member 100, where FIG. 39 is a top view, FIG. 40 is a side view, FIG. 41 is a sectional-view along line 11—11 of FIG. 39, has external threads 101 at its upper edge, next lower is a discharge tube 102 with its outer end as external threads 103 and its hollow space 105 for conveying extinguishing agent out from cavity 106. Opposite to discharge tube 102, there are 2 holes 109 through the wall of lower member 100. Next lower to cavity 106 is another cut cone-shape cavity 111 to create an abutment 108 where there are 4 internal threads 107 in abutment 108.

Next lower to cavity 111 is a cylindrical cavity 115 having an abutment 112. Cavity 115 enlarges to be a circular space 118 and next lower is another larger circular space 116 than space 118 to be filled with rubber O-ring 169 where next lower to cavity 116 are internal threads 113.

Figure 42:
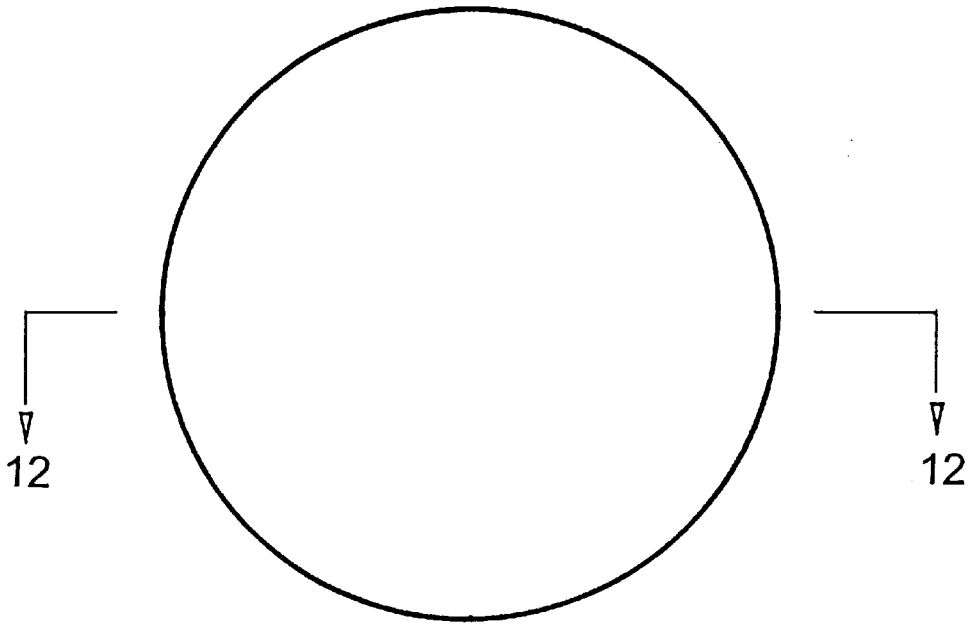
FIG. 42 is a top view of a cap of an ejection chamber of fire extinguisher to be used in automatic fire extinguishing system.
Figure 43:
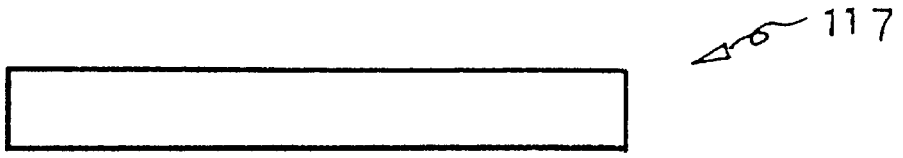
FIG. 43 is a side view of a cap of an ejection chamber of fire extinguisher to be used in automatic fire extinguishing system.
Figure 44:
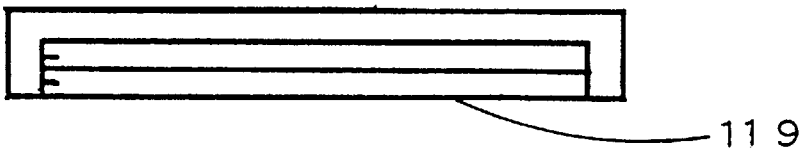
FIG. 44 is a sectional view along line 12—12 of FIG. 42.

2.2 Cap 117, where FIG. 42 is a top view,

FIG. 43 is a side view,

FIG. 44 is a sectional-view along line 12—12 of FIG. 42, has internal threads 119 inside which can mate tightly with external threads 101.

Figure 45:
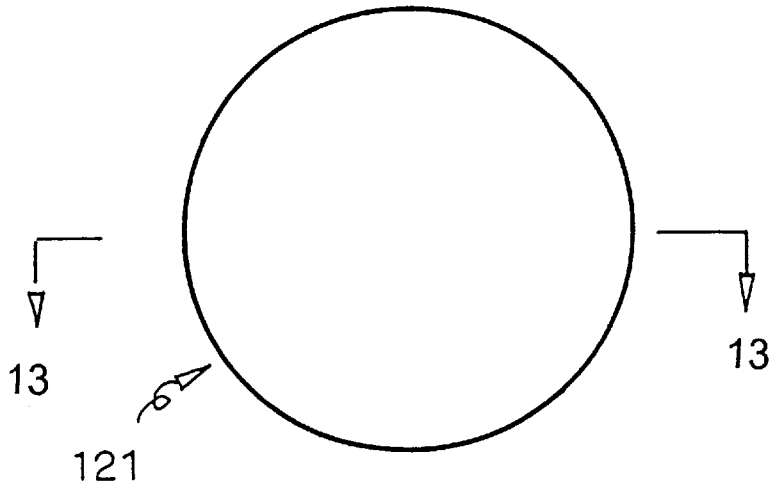
FIG. 45 is a top view of a grooved circular steel plate to be used in automatic fire extinguishing system.
Figure 46:
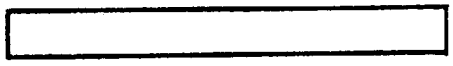
FIG. 46 is a side view of a grooved circular steel plate to be used in automatic fire extinguishing system.
Figure 47:
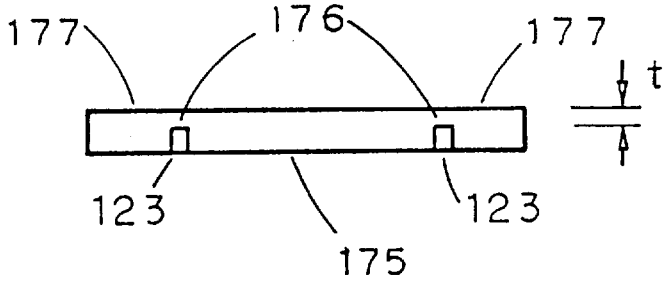
FIG. 47 is a sectional view along line 13—13 of FIG. 45.
Figure 48:
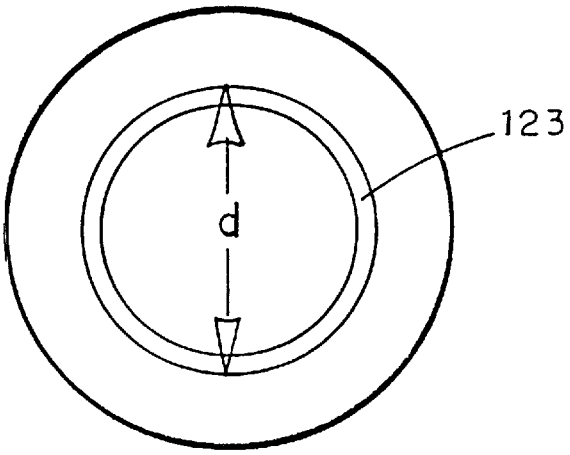
FIG. 48 is a bottom view of a grooved circular steel plate to be used in automatic fire extinguishing system.

3. Grooved circular steel plate 121, where, FIG. 45 is a top view,

FIG. 46 is a side view,

FIG. 47 is a sectional-view along line 13—13 of FIG. 45, and FIG. 48 is a bottom view;

has a diameter slightly shorter than that of circular space 106. Underneath circular steel plate 121 is a groove 123 to divide circular steel plate 121 into 2 parts, part 175 and part 177 as shown in FIG. 48.

Grooved circular steel plate 121 can be made of stainless steel or brass or any metals that will not become rusted and can be readily welded with stainless steel.

The part of metal 176 which is just above groove 123 by itself can not withstand force exerted by pressure inside the shell.

A distance 'd' is a diameter of outer edge of groove 123 as shown in FIG. 48.

4. Pressing Set

Figure 49:
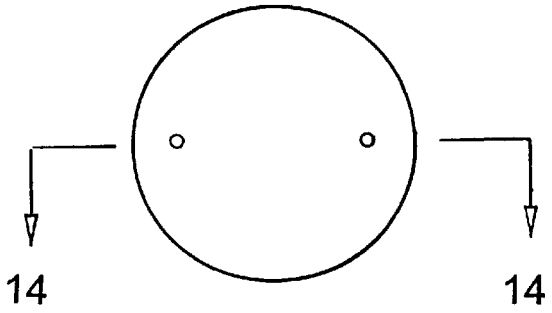
FIG. 49 is a top view of a cartridge.
Figure 50:
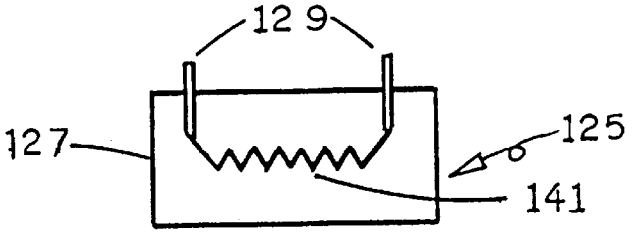
FIG. 50 is a sectional view along line 14—14 of FIG. 49 of a melting cartridge.
Figure 51:
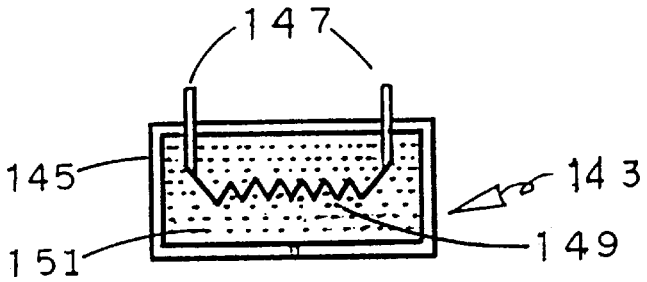
FIG. 51 is a sectional view along line 14—14 of FIG. 49 of an explosive cartridge.

In the present invention, one of the most important components is a pressing set to press on grooved circular steel plate 121. There can be 3 different types of pressing set as follow, i.e., 4.1 Melting cartridge 125, where, FIG. 49 is a top view, FIG. 50 is a sectional-view along line 11—11 of FIG. 49, has a plastic plate 127 of cylindrical shape with a heating coil 141 buried inside plate 127. Both ends of heating coil 141 are connected to 2 electrodes 129 to provide electric current from outside; or 4.2 Explosive cartridge 143, where, FIG. 49 is a top view, FIG. 51 is a sectional-view along line 11—11 of FIG. 49, has a hollow cylindrical plastic box 145 filled with explosive powder 151 with a heating coil 149 buried inside. Both ends of heating coil 149 are connected to 2 electrodes 147 to provide electric current from outside. The distance between the two electrodes 147 is equal to the distance between the two electrodes 129.

Diameter of plastic plate 127 is equal to diameter of plastic box 145, assumingly is 'C' cm. in length which is greater that 'd' cm. which is diameter of outer edge of groove 123 of grooved circular steel plate 121.

Thickness of melting cartridge 125 is equal to thickness of explosive cartridge 143.

Figure 52:
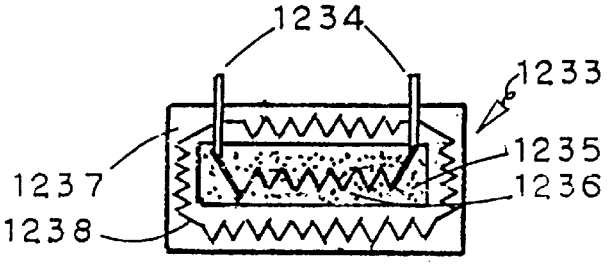
FIG. 52 is a sectional view along line 14—14 of FIG. 49 of a hybrid cartridge.

4.3 Hybrid cartridge 1233 where, FIG. 49 is a top view,

FIG. 52 is a sectional-view along line 11—11 of FIG. 49, is a cylindrical plastic box containing explosive powder 1235 inside. Upon explosion, this amount of explosive powder will damage only the cartridge but not any other parts of this automatic fire extinguishing system. There is a resisting coil 1236 buried within the explosive powder where each of its ends are connected to each of 2 electrodes 1234.

Inside the plastic wall 1237 of the cylindrical plastic box, there is a heating coil 1238 buried within and also each of its ends connected to each of 2 electrodes 1234.

Any of these 3 types of cartridges of pressing set can be used. However, the advantage of this type of hybrid cartridge 1233 over the other is that it guarantees that the system is to function without failure. In case, there is some problem with one type, the other can then readily function equally well to allow operation of automatic fire extinguishing action.

Figure 53:
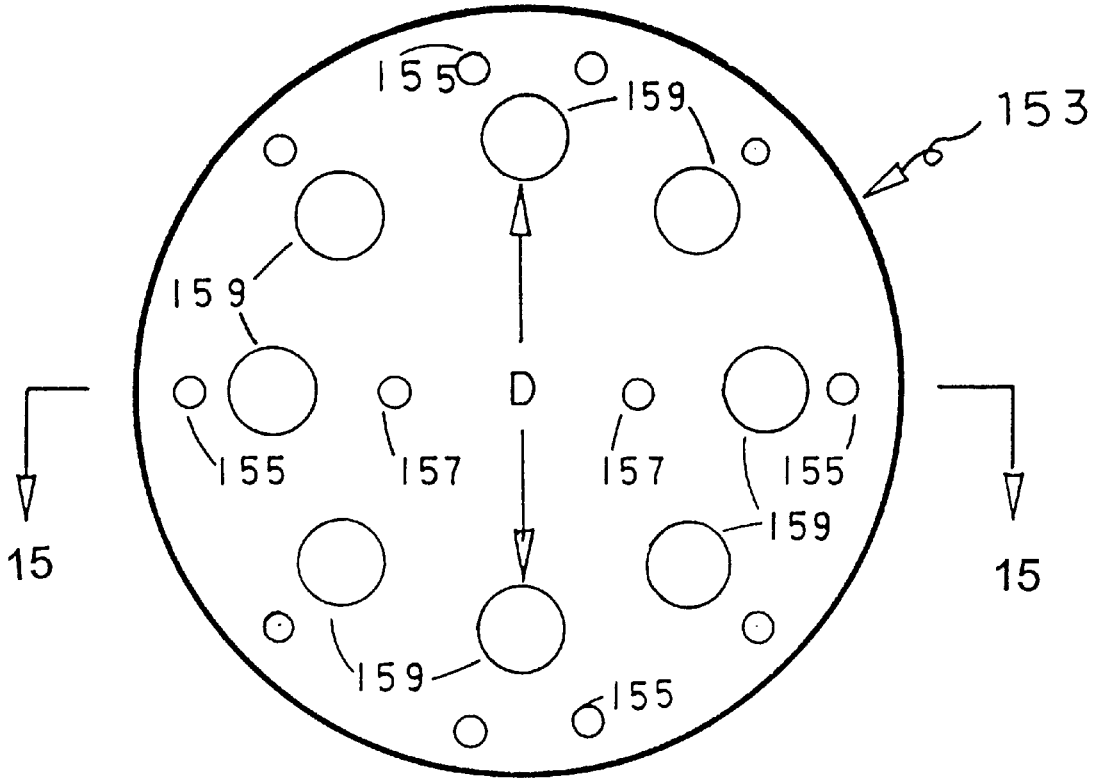
FIG. 53 is a top view of a pressing steel plate.
Figure 54:
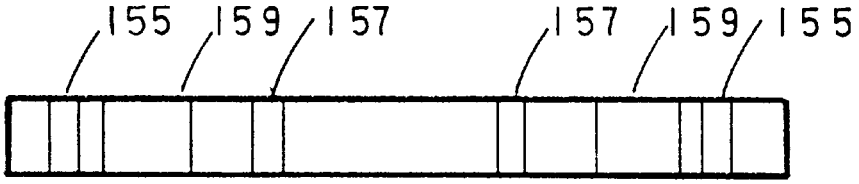
FIG. 54 is a sectional view along line 15—15 of FIG. 53.

5. Pressing steel plate 153, where, FIG. 53 is a top view,

FIG. 54 is a sectional-view along line 12—12 of FIG. 53, is a circular steel plate thick enough to withstand the pressure inside shell 21 of fire extinguisher 98. Next to its edge there are 4 holes, slightly bigger than internal threads 107 at abutment 108, radially arranged. Next inside are several holes 159 also radially arranged. Next inside to holes 159 are 2 holes 157, where distance between these 2 holes is equal to distance between the two electrodes 129 or 147. Hole 157 has diameter slightly greater than that of electrodes 129 or 147 that when electrodes 129 or 147 are inserted through the 2 holes 157 there will never be contact between the electrodes and edges of the holes 157.

Distance 'D' is a distance between inner edge of a hole 159 to inner edge of another hole 159 on the opposite side must be equal or greater that 'd' which is diameter of outer edge of groove 123. Thus, when part 175 is detached from grooved circular steel plate 121, it can not close all the holes 159. The fire extinguishing agent can then in all cases be ejected out through the remaining holes 159 to put out fire.

Figure 55:
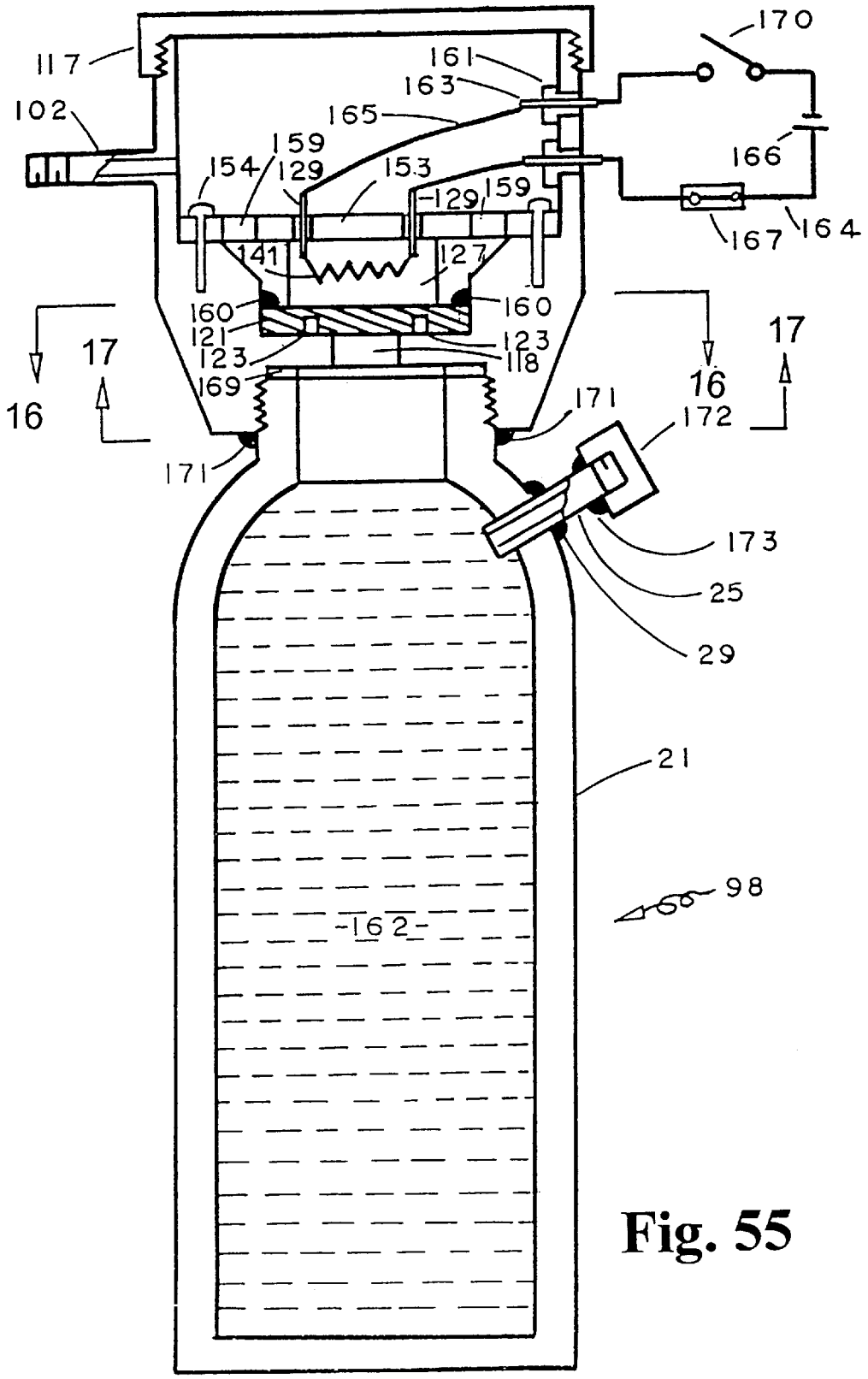
FIG. 55 shows a completely assembled fire extinguisher to be used in the present automatic fire extinguishing system.

Assembling of Fire Extinguisher to be Used in Automatic Fire Extinguishing System In the present invention, fire extinguishing agent to be used may be of any kind that will not cause damage to electrical appliances and electronic apparatus. These can be carbon dioxide, halon or FM 200 (heptafluropropane) when used in a form of liquefied gas, there will be no need for siphon tube 32 to convey fire extinguishing agent out from shell 21 since these gases can expel right out to put out fire. After the assembling, a fire extinguisher to be used in automatic fire extinguishing system will have features as shown in FIG. 55.

Assembling steps are:

1. place grooved circular steel plate 121 on abutment 112 with groove 123 facing downwards;
2. weld the edge of grooved circular steel plate 121 to wall of cavity 115 of lower member 100 of ejection chamber 99 by fillet weld 160;
3. place melting cartridge 125 on grooved circular steel plate 121;
4. place pressing steel plate 153 over plastic plate 127 of melting cartridge 125 to have each of the electrodes 129 inserts through each hole 157 without touching edge of hole 157, where top of melting cartridge 125 just slightly levels above abutment 108. Each of four hexagonal head bolts 154 is inserted through each hole 155 of pressing steel plate 153. Mate external threads of each bolt 154 tightly with internal threads 107 in abutment 108. This mounts plastic plate 127 of melting cartridge 125 very tightly to grooved circular steel plate 121 where groove 123 is sandwiched between abutment 112 and melting cartridge 125;

place rubber O-ring 169 in circular space 116;

5. insert plastic plug 161 tightly through holes 109 in the wall of lower member 160 with copper electrodes 163 of plug 161 extruding on each side, both inside and outside wall of lower member 100;
6. connect each of electrodes 129 to each of copper electrode 163 by wire 165;
7. mate internal threads 119 of cap 117 tightly to external threads 101 of lower member 100;
8. fill extinguishing agent 162 as liquefied gas in to shell 21;
9. mate internal threads 113 of lower member 100 which has been already assembled to other components through steps 1.–8. tightly to external threads 23 of shell 21 that upper edge of shell 21 presses tightly to rubber O-ring 169 and weld ejection chamber 99 to shell 21 by fillet weld 171 such that it is air-tight inside shell 21;
10. fill $N_2$ as propellant into shell 21 through tube 25.
11. put cap 172 on to have its internal threads mate tightly with external threads 27 at the end of tube 25, then weld cap 172 to tube 25 by fillet weld 173; and
12. connect electrodes 163 to battery 166 through wire 164, fuse 167 and switch 170.

Fire extinguisher 98 as shown in FIG. 55 to be used in automatic fire extinguishing system is thus completely assembled from the above described step 1. through 12.

Figures 56, 57, 58, 59, 60:
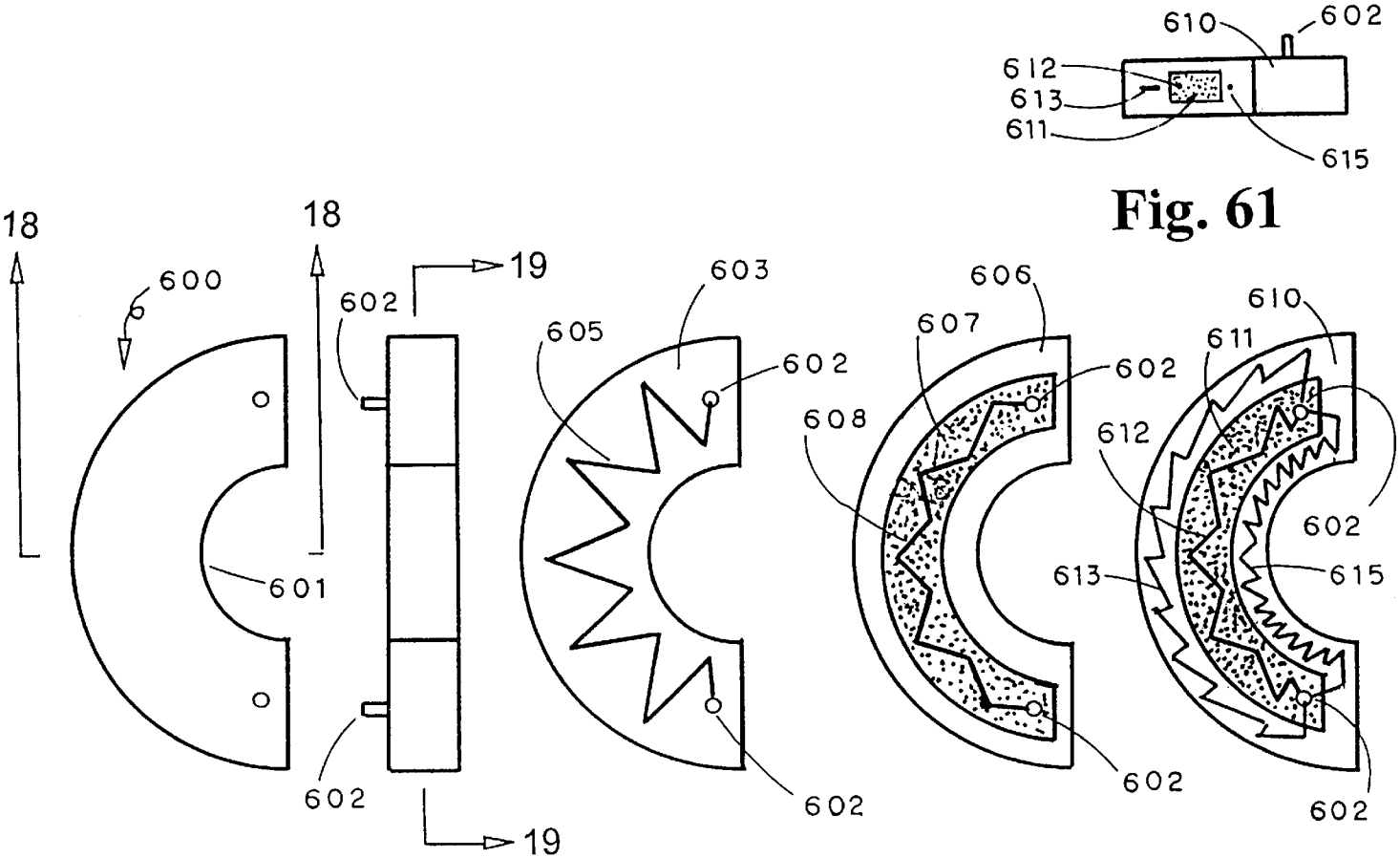
FIG. 56 is a top view of a semicircular horse-shoe shape cartridge.
FIG. 57 is a front view of a semicircular horse-shoe shape cartridge.
FIG. 58 is a sectional view along line 19—19 of FIG. 57 of a semicircular horse-shoe shape melting cartridge.
FIG. 59 is a sectional view along line 19—19 of FIG. 57 of a semicircular horse-shoe shape explosive cartridge.
FIG. 60 is a sectional view along line 19—19 of FIG. 57 of a hybrid semicircular horse-shoe shape cartridge.

In different embodiments, pressing set or cartridge can be designed to have semicircular horse-shoe shape. Likewise, there can also be 3 different types of the semicircular horse-shoe shape cartridge as follow:

1. Semicircular horse-shoe shape melting cartridge 600, where, FIG. 56 is a top view, FIG. 57 is a front view, and FIG. 58 is a sectional-view along line 19—19 of FIG. 57, consists of a thick semicircular horse-shoe shape plastic plate 603 having a heating coil 605 with each of its 2 ends connected to each of the 2 electrodes 602 supplying electric current. The diameter of inner semicircle 601 is shorter that the inner diameter of groove 123 of grooved circular steel plate 121.

2. Semicircular horse-shoe shape explosive cartridge 650, where, FIG. 56 is a top view, FIG. 57 is a front view, and FIG. 59 is a sectional-view along line 19—19 of FIG. 57, consists of a semicircular horse-shoe shape plastic box 606 containing explosive powder 607 inside. There is a resisting coil 608 buried within the explosive powder with each of its 2 ends connected to each of 2 electrodes 602 supplying electric current.

3. Hybrid semicircular horse-shoe shape cartridge 652, where, FIG. 56 is a top view, FIG. 57 is a front view, FIG. 60 is a sectional-view along line 19—19 of FIG. 57, and, FIG. 61 is a sectional-view along line 18—18 of FIG. 56, consists of a semicircular horse-shoe shape plastic box 610 containing explosive powder 611 inside. There is a resisting coil 612 buried within the explosive powder with each of its 2 ends connected to each of the 2 electrodes 602 supplying electric current.

Inside wall of plastic box 610, there are heating coils 613 and 615 buried within and each of their ends connected to each of electrodes 602.

Figure 64:
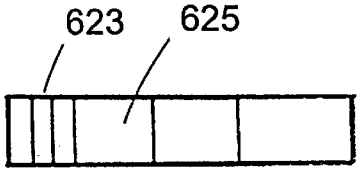
FIG. 64 is a sectional view along line 20—20 of FIG. 62 of a semicircular horse-shoe shape pressing steel plate.
Figure 63:
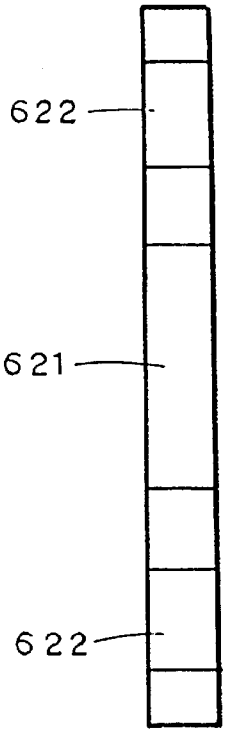
FIG. 63 is a front view of a semicircular horse-shoe shape pressing steel plate.
Figure 62:
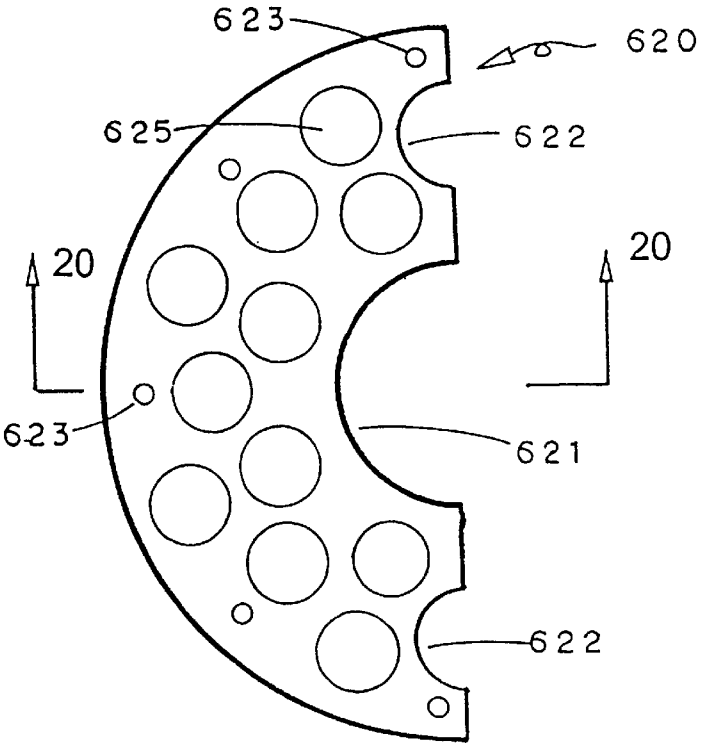
FIG. 62 is a top view of a semicircular horse-shoe shape pressing steel plate.

All these three types of semicircular horse-shoe shape cartridges are to be assembled to semicircular horse-shoe shape pressing steel plate 620, where, FIG. 62 is a top view, FIG. 63 is a front view, and FIG. 64 is a sectional-view along line 20—20 of FIG. 62, which is a semicircular horse-shoe shape steel plate, the thickness of which can withstand pressure inside fire extinguisher 98. Its outer diameter is slightly shorter than the diameter of cavity 106 (as in FIG. 41). Within this steel plate there are several holes 625 and close to outer edge of the semicircular plate there are 2 holes 623 each coinciding with and having its diameter slightly greater than the diameter of internal threads 107 of abutment 108.

Inner diameter of the semicircular horse-shoe shape pressing steel plate 620 is shorter than diameter of inner semicircle 601 of plastic plate 603 shown in FIG. 56.

Both ends of the horse-shoe shape steel plate 620 are cut into semicircles 622 as shown in FIG. 62.

Figure 65:
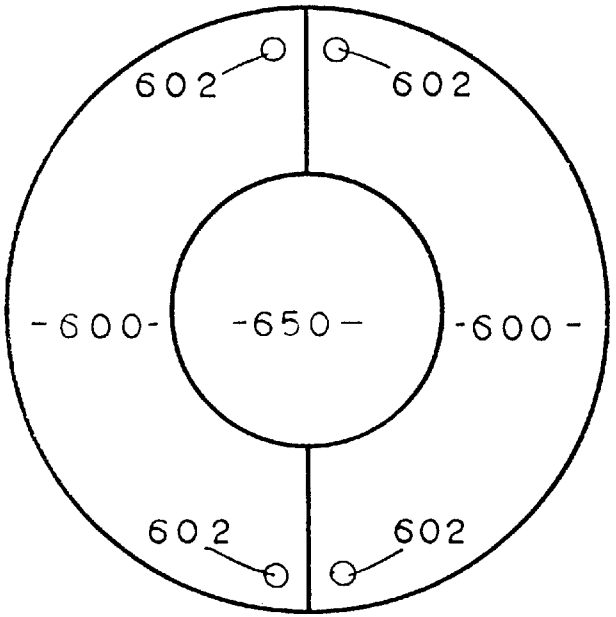
FIG. 65 is a top view of a pair of semicircular horse-shoe shape melting cartridges forming a donut shape component.

When 2 sets of semicircular horse-shoe shape melting cartridge 600 are assembled together, they form a complete donut-shape component as shown in FIG. 65 and a pair of semicircles 601 become a circular cavity 650.

Figure 66:
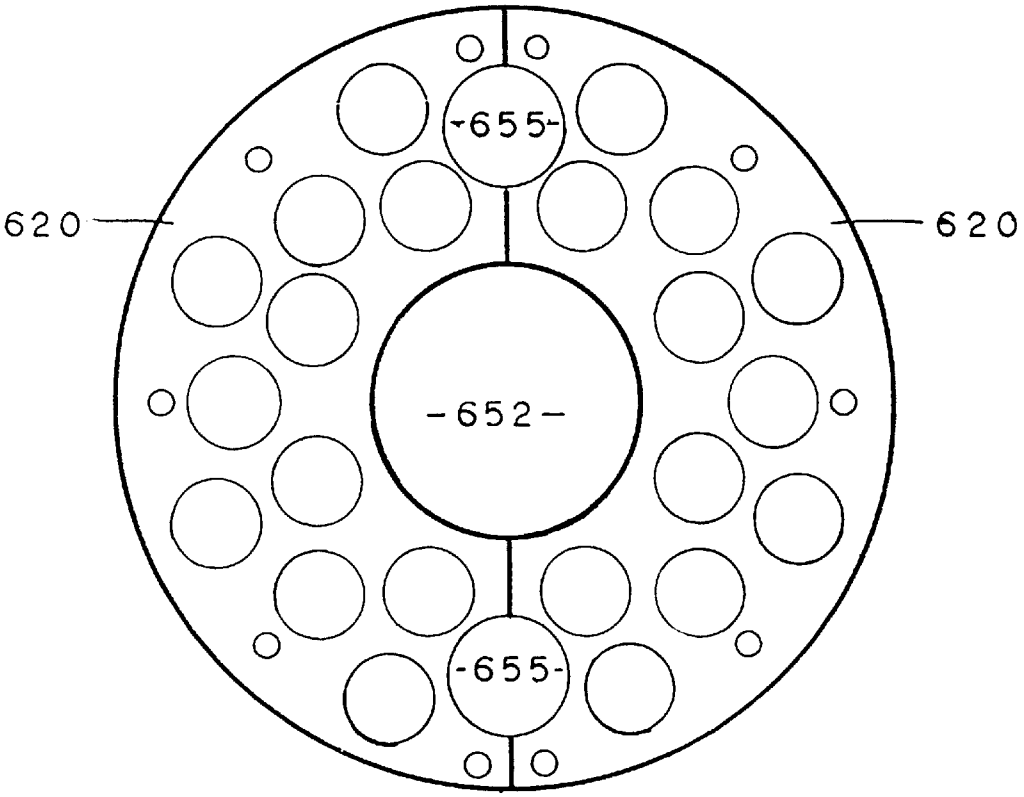
FIG. 66 is a top view of a pair of semicircular horse-shoe shape pressing steel plates forming a donut shape component.

When 2 sets of semicircular horse-shoe shape pressing steel plate 620 are assembled together, they also form a complete donut-shape component as shown in FIG. 66 and a pair of semicircles 621 become a circular cavity 652 where two of semicircles 622 become each circular cavity 655.

Figures 67, 68, 69:
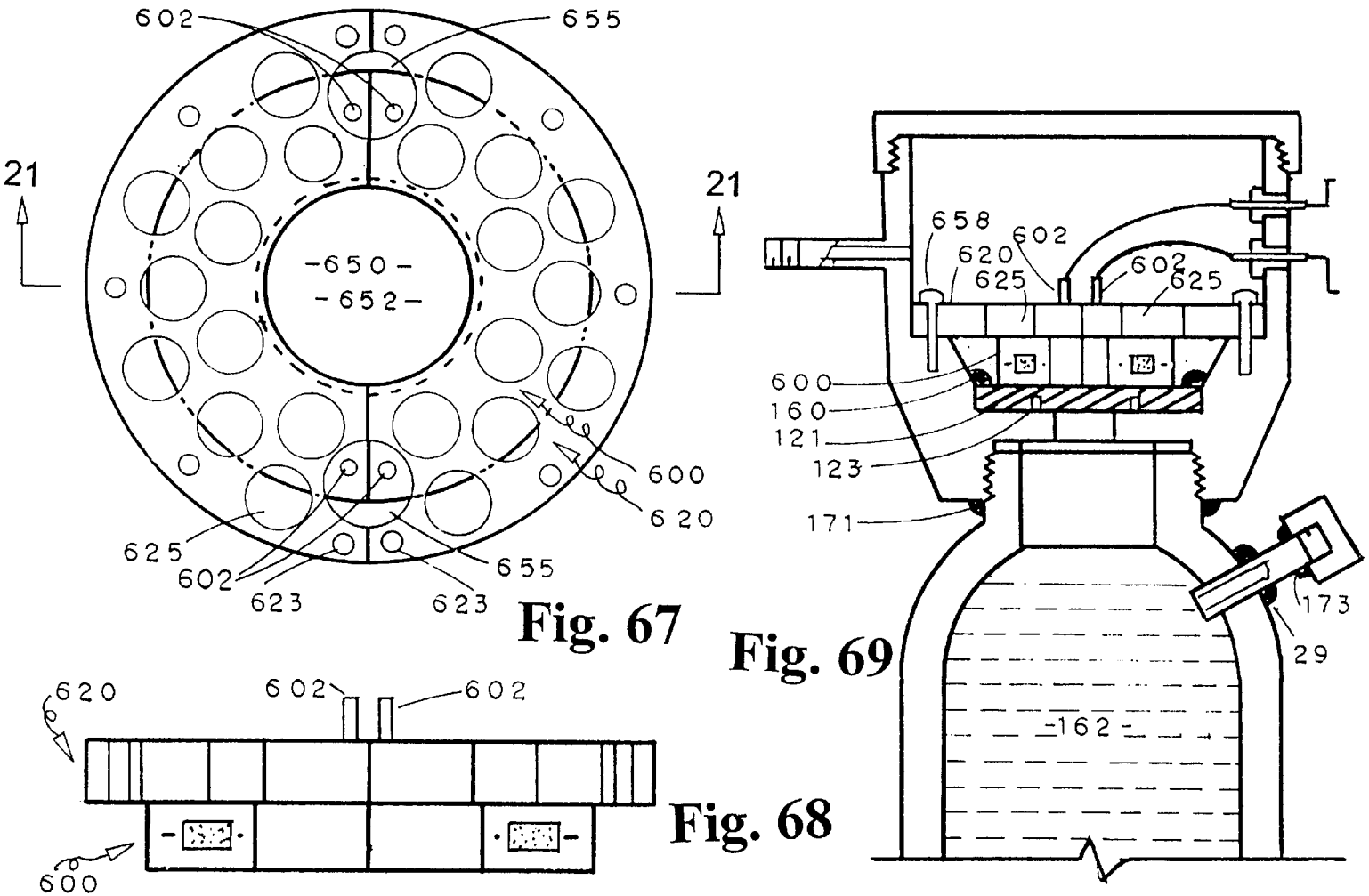
FIG. 67 is a top view shows how a pair of semicircular horse-shoe shape pressing steel plates is placed on top of a pair of semicircular horse-shoe shape melting cartridges.
FIG. 68 is a sectional view along line 21—21 of FIG. 67.
FIG. 69 is a sectional view shows how a pressing set is assembled to a fire extinguisher to be used in automatic fire extinguishing system.

When a pair of semicircular horse-shoe shape pressing steel plate 620 as in FIG. 66 are placed on top of a pair of semicircular horse-shoe shape melting cartridge 600 as in FIG. 65, they form a pressing set as shown in FIG. 67 which is a top view and in FIG. 68 which is a sectional-view along line F—F of FIG. 67. Each pair of electrodes 602 is inserted through each circular cavity 655 where circular cavity 652 is slightly smaller than circular cavity 650.

As shown in FIG. 69, when a pressing set as shown in FIG. 67 is assembled to ejection chamber 99 of fire extinguisher 98 (shown in FIG. 41) by mounting grooved circular steel plate 121 onto abutment 112 of cylindrical cavity 115 by fillet weld 160 and placing pressing set as shown in FIG. 67 on top of steel plate 121 to have each hole 623 aligned with each internal threads 107. Four bolts 658 are used to fasten both pressing steel plates 620 to grooved circular steel plate 121 through internal threads 107. In this manner, circular cavity 650 is small enough that both semicircular horseshoe shape melting cartridge 600 cover and press on top all along groove 123 of circular steel plate 121.

This whole set of ejection chamber described above is assembled to shell 21 fully filled with fire extinguishing agent 162 and welded with fillet weld 171.

All these semicircular horse-shoe shape cartridge described in FIGS. 58–60 can be replaced with a new one by taking away one cartridge at a time and fastened a new one with bolts 658 to abutment 112 while there is no need to replace any other components of the system. This can be done for system maintenance after having been installed the system for a long time just to keep the system ready for operation at all time.

Figure 70:
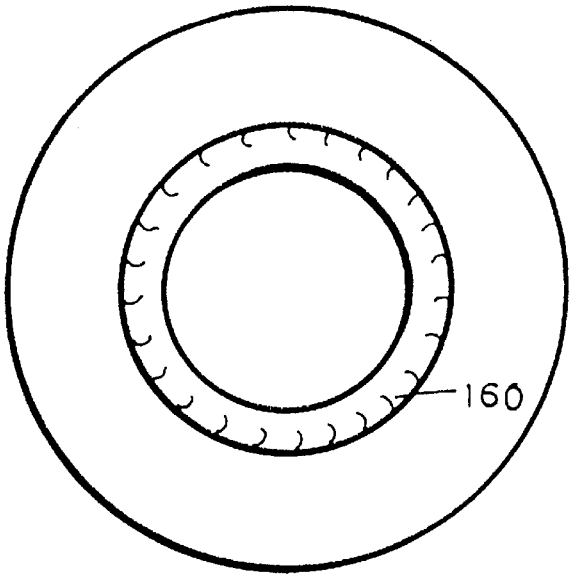
FIG. 70 is a sectional view along line 16—16 of FIG. 55 showing fillet weld 160.
Figure 71:
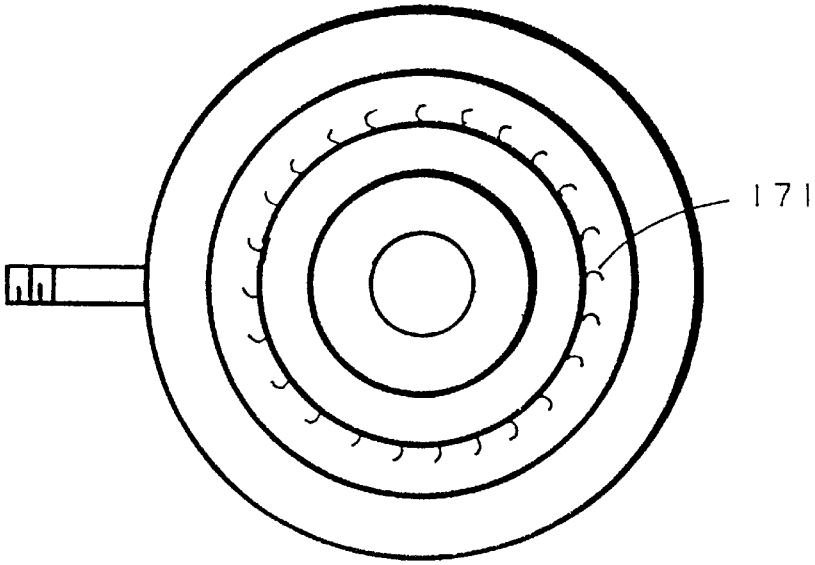
FIG. 71 is a sectional view along line 17—17 of FIG. 55 showing fillet weld 171.

FIGS. 70 and 71 show fillet welds 160 and 171 along the sectional lines U—U and V—V of FIG. 55, respectively.

Fillet welds 29, 173, 171 and 160 all can withstand the force caused by pressure inside shell 21 throughout operating the automatic fire extinguishing system.

The fire extinguishers both manually-operated or an automatic one to be used in the present automatic fire extinguishing system need no gauge for measuring pressure inside its shell 21, since by fillet welding there will never be any leakage therefore pressure inside shell 21 remains constant throughout its shelf-life. This is a major difference and a break-through improvement of present invention over those conventional fire extinguishing systems.

This fire extinguisher used in the present automatic fire extinguishing system, when in a normal 'not in use' situation, its switch 170 will be in an 'OFF' position. Upon 'In use' situation, switch 170 will be in an 'ON' position thus allows electric current to flow through heating coil 141 of melting cartridge 125 results in heating and then melting down of plastic plate 127. Fuse 167 then melts after plastic plate 127 melted down. This will cut electric current not to flow into the circuit and thus prevents a short circuit.

Figure 72:
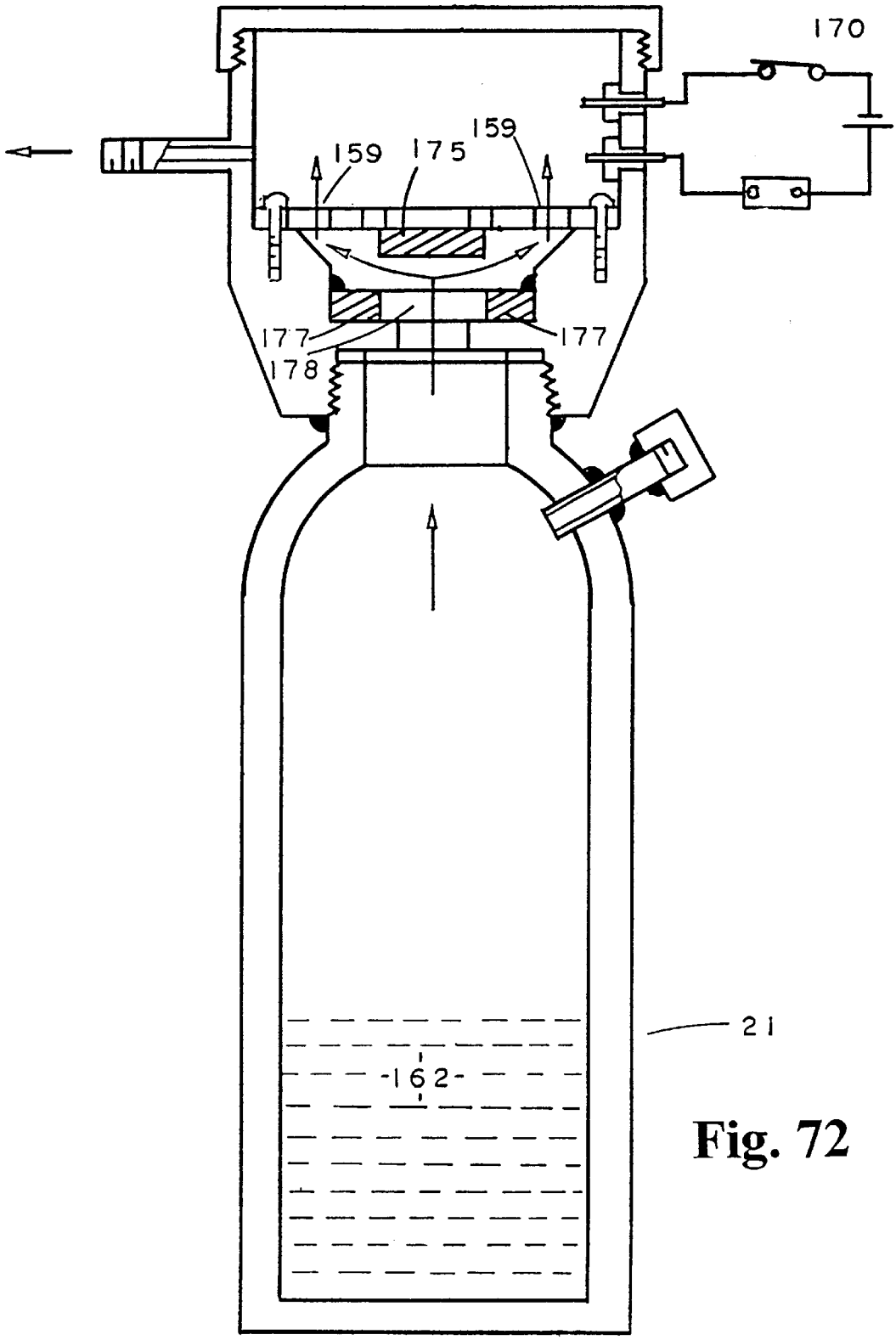
FIG. 72 shows ejection of fire extinguishing agent when plastic plate of melting cartridge melts down and pressure inside shell detaches central part along groove of grooved circular steel plate.

As shown in FIG. 72, when plastic plate 127 melts down, pressure in shell 21 forces part 175 of grooved circular steel plate 121 to be torn away from part 177 along groove 123 while part 177 of steel plate 121 remains welded tightly to wall of cavity 115 of lower member 100 by fillet weld 160. Extinguishing agent in shell 21 is thereby ejected out through holes 159 of pressing steel plate 153 to put out fire.

Figure 73:
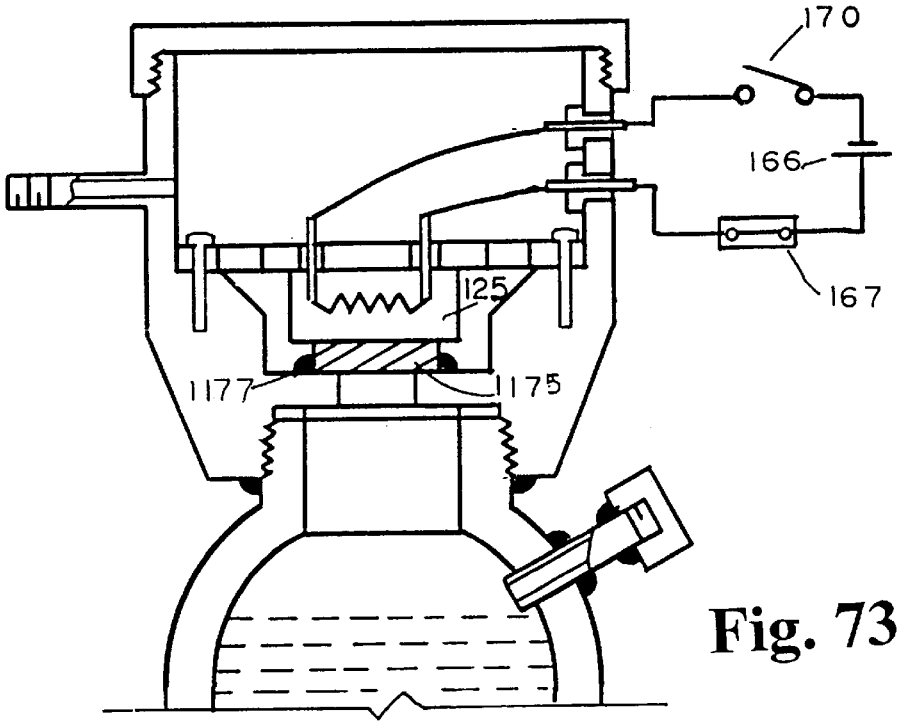
FIG. 73 shows a plain circular steel plate without groove mounted to abutment of ejection chamber through a fillet weld which can not withstand force exerted from the pressure inside shell of fire extinguisher.
Figure 74:
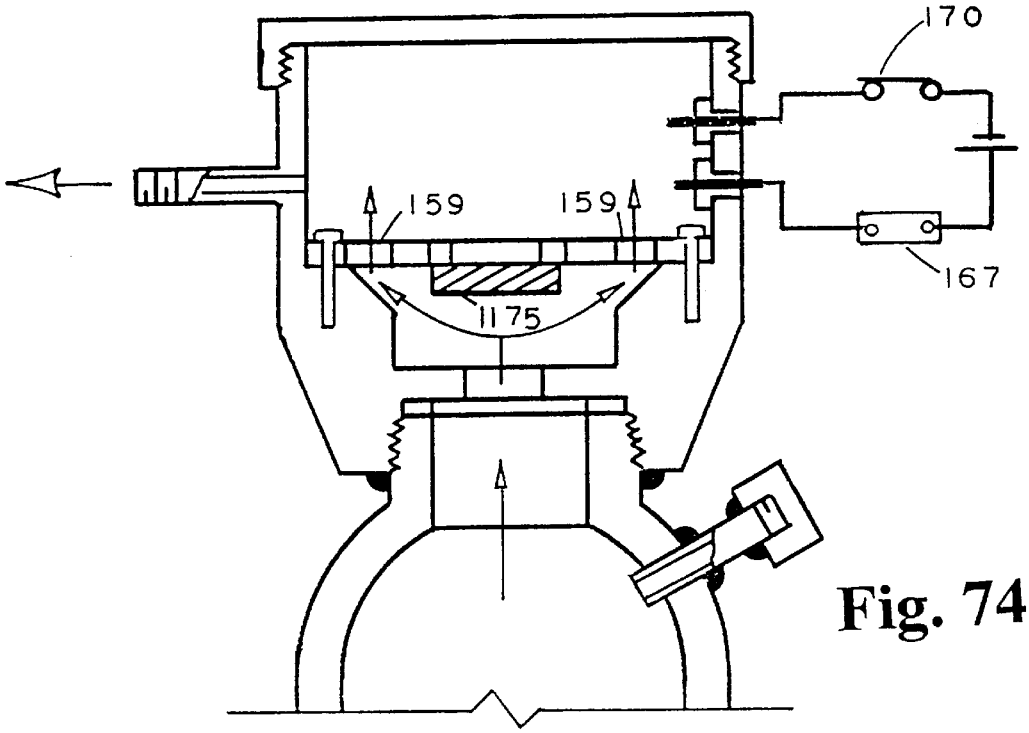
FIG. 74 shows how a plain circular steel plate without groove detaches from abutment of ejection chamber when fillet weld is destroyed by pressure inside shell of fire extinguisher after melting cartridge melted down.

In another embodiment, as shown in FIG. 73, instead of grooved circular steel plate 121 a plain circular steel plate 1175 without groove can be used. By itself, circular steel plate 1175 can withstand the pressure inside shell 21. Steel plate 1175 is placed on abutment 112 and welded to wall of lower member 100 by fillet weld 1177. Melting cartridge 125 is placed on steel plate 1175 with pressing steel plate 153 on top in a similar manner. Fillet weld 1177 is, however, assigned not to withstand the pressure inside shell 21. Thus, when plastic plate 127 melts, plain circular steel plate 1175 is then forced and detached from fillet weld 1177. Extinguishing agent 162 is ejected to put out fire as shown in FIG. 74.

Figure 75:
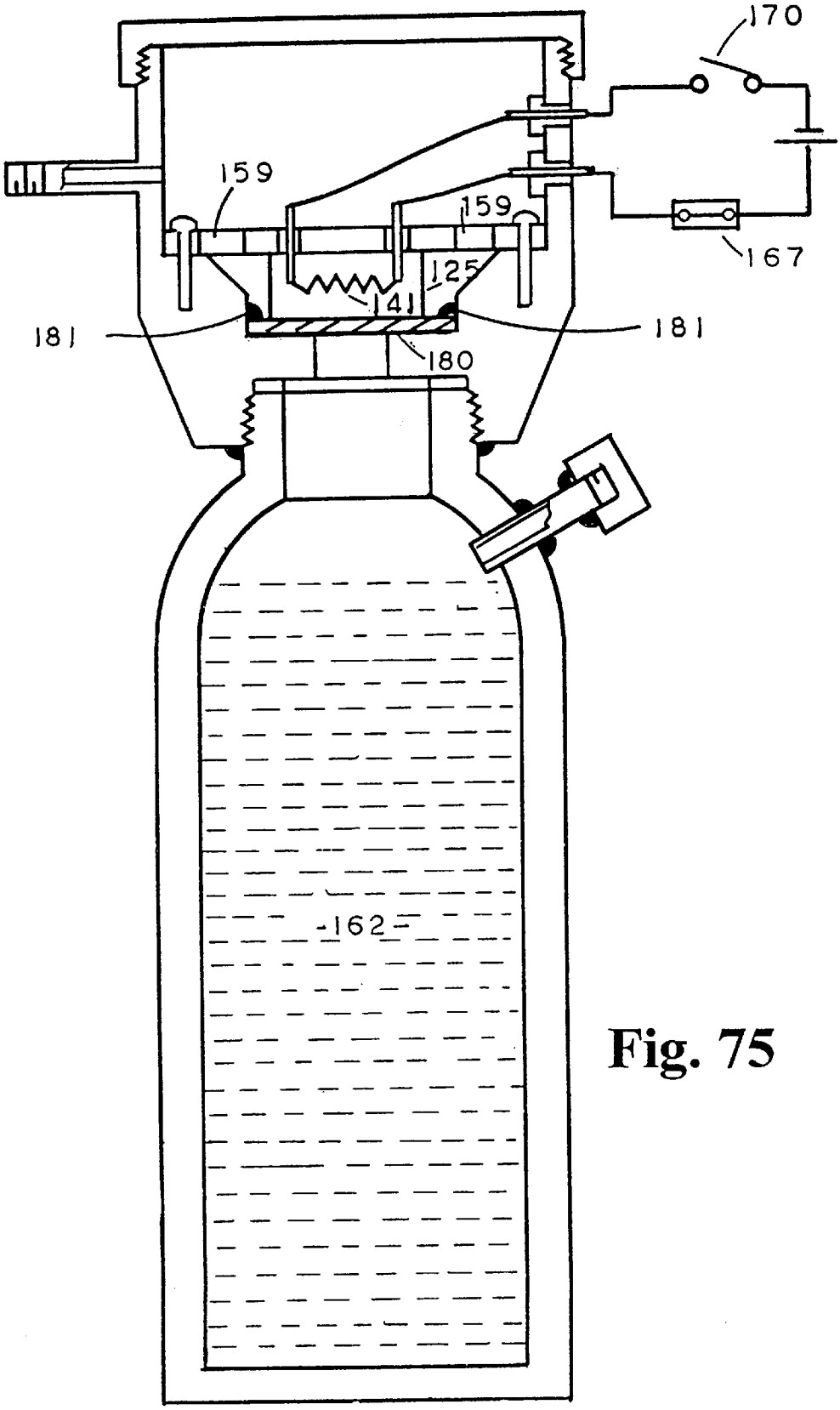
FIG. 75 shows a circular steel plate with thinner central space mounted to ejection chamber through a fillet weld.
Figure 76:
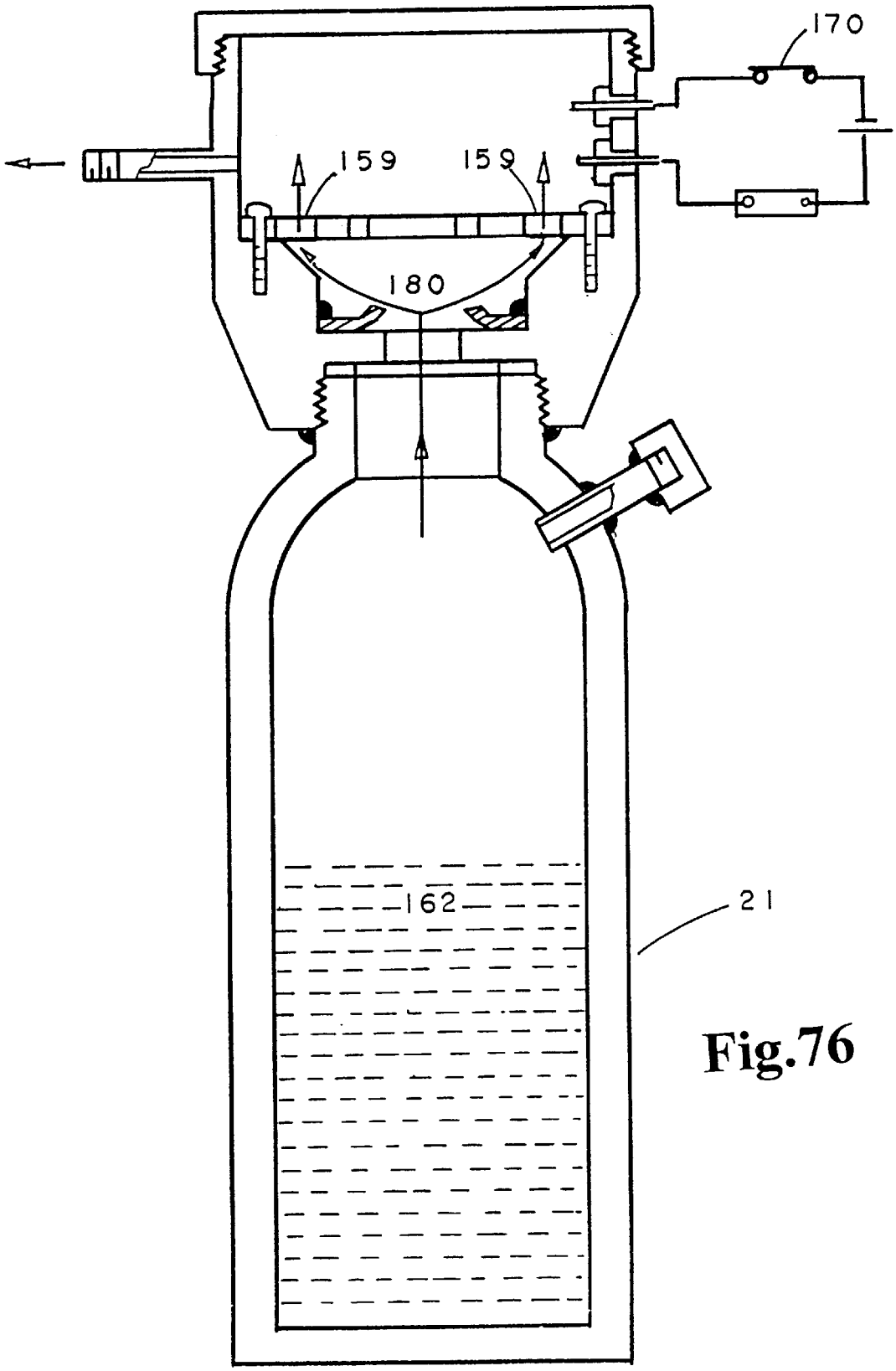
FIG. 76 shows ejection of fire extinguishing agent when a circular steel plate is broken at it thinner central space by pressure inside shell after a melting cartridge melted down.

Yet in a third different embodiment, as shown in FIG. 75, instead of grooved circular steel plate 121, a circular steel plate 180 can also be used, assigning that a circular space at its center is much thinner than at its periphery. Circular steel plate 180 rests upside down on shoulder 112 where it is welded by fillet weld 181 to ejection chamber 99 with plastic plate 127 pressing on top. Thus, when plastic plate 127 melts, pressure inside shell 21 forces resulting in a hole formed in the circular steel plate 180. Extinguishing agent 162 is then ejected to put out fire as shown in FIG. 76.

Figure 76A:
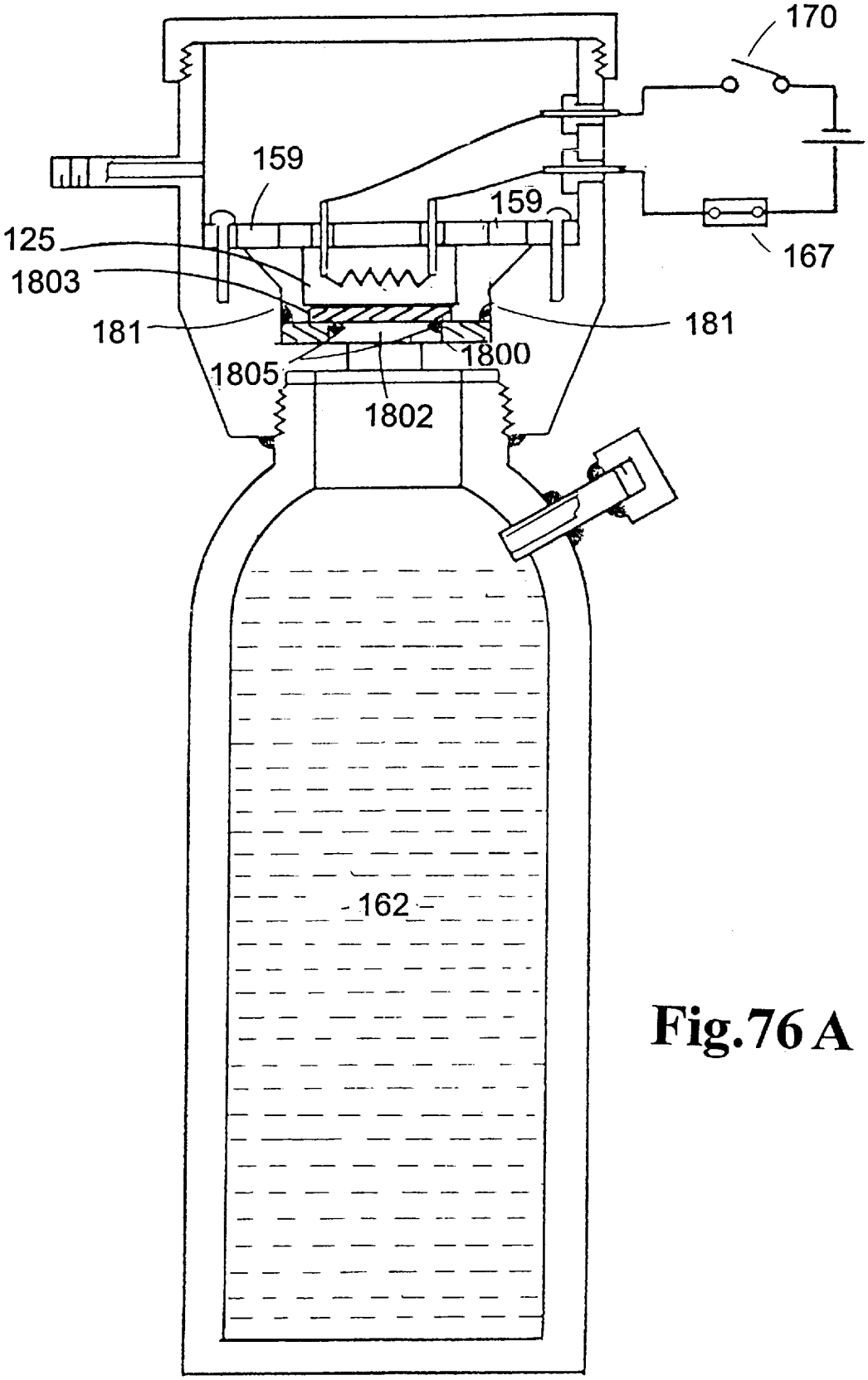
FIG. 76A shows a thin circular steel plate sealed a central cavity of a circular steel plate mounted to ejection chamber through a fillet weld.

Yet, FIG. 76A is another embodiment where a circular steel plate 1800 is mounted to ejection chamber 99 through fillet weld 181. There is a circular cavity 1802 at the center of circular steel plate 1800. A thin circular steel plate 1803 is placed on and welded to circular steel plate, 1800 to close cavity 1802 through fillet weld 1805. In standby situation, there is a melting cartridge 125 pressed on thin circular steel plate 1803.

Figure 76B:
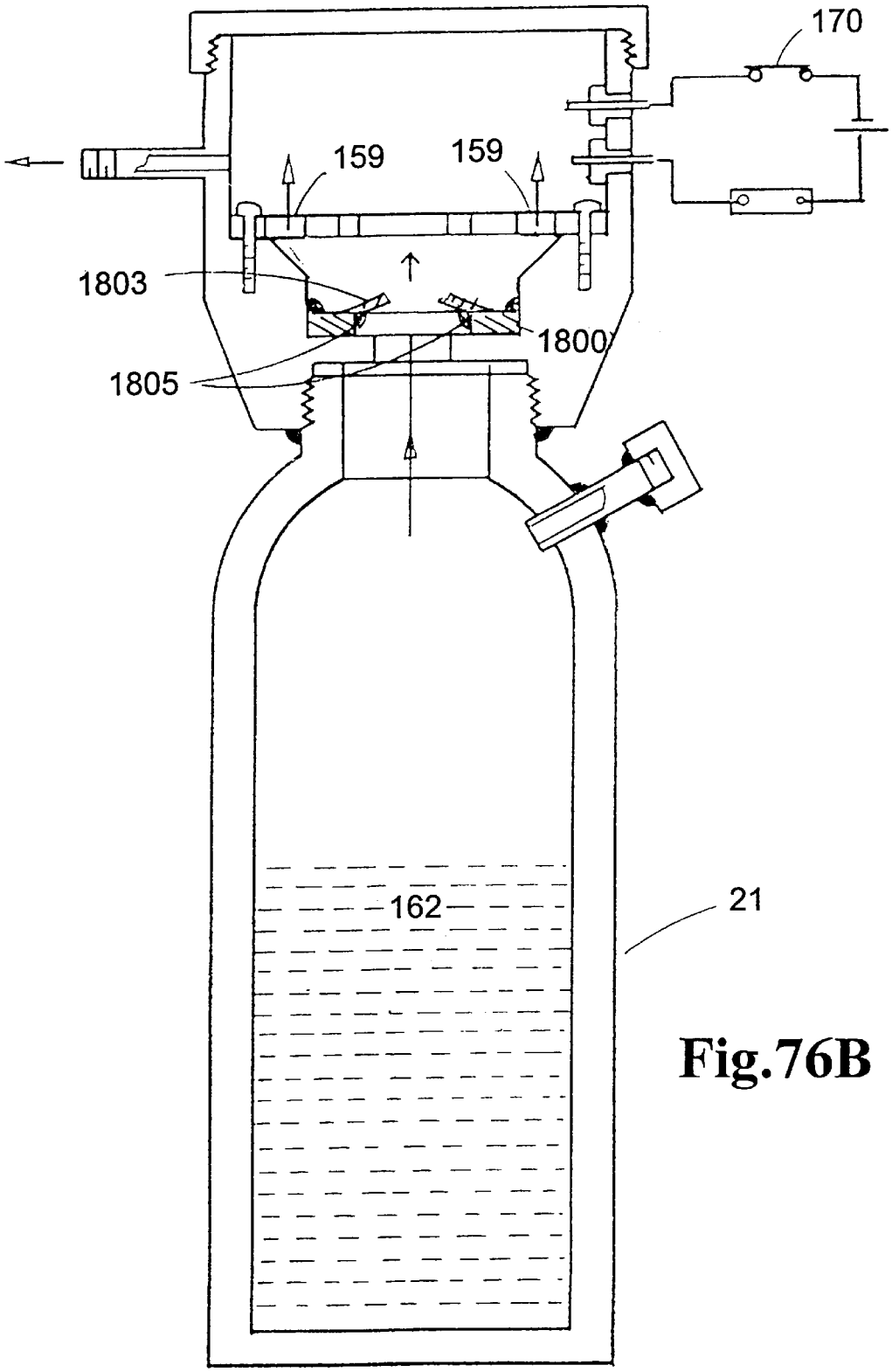
FIG. 76B shows ejection of fire extinguishing agent when a thin circular steel plate shown in FIG. 76A broken by pressure in shell after melting cartridge melted down.

Thin circular steel plate 1803 by itself can not withstand pressure within fire extinguisher 98. Thus, when a fire breaks out and cartridge 125 melts down, pressure inside shell 21 forces resulting in a hole being formed in the circular steel plate 1803. Extinguishing agent 162 is then ejected to put out fire as shown in FIG. 76B.

For all these different embodiments described, instead of using a melting cartridge 125, an explosive cartridge 143 as shown in FIG. 51 can be used. Using an explosive cartridge 143, when there is electric current in heating coil 149, explosive powder explodes. Explosive cartridge 143 is destroyed where it is designed to cause only self-damage and can not damage any other parts of fire extinguisher 98. Explosion leads to same result as when a melting cartridge 125 is used, i.e., pressure inside shell forces to cause a cavity to allow ejecting out of extinguishing agent to put out fire. Yet using explosive cartridge 143, a fuse 167 is not necessary since upon explosion electric current is readily disconnected.

When liquid nitrogen is used as propellant, it can be filled directly and simultaneously with liquefied extinguishing agent 162 into shell 21 to give desirable pressure inside shell 21. Tube 25 is thus not necessary.

Figure 77:
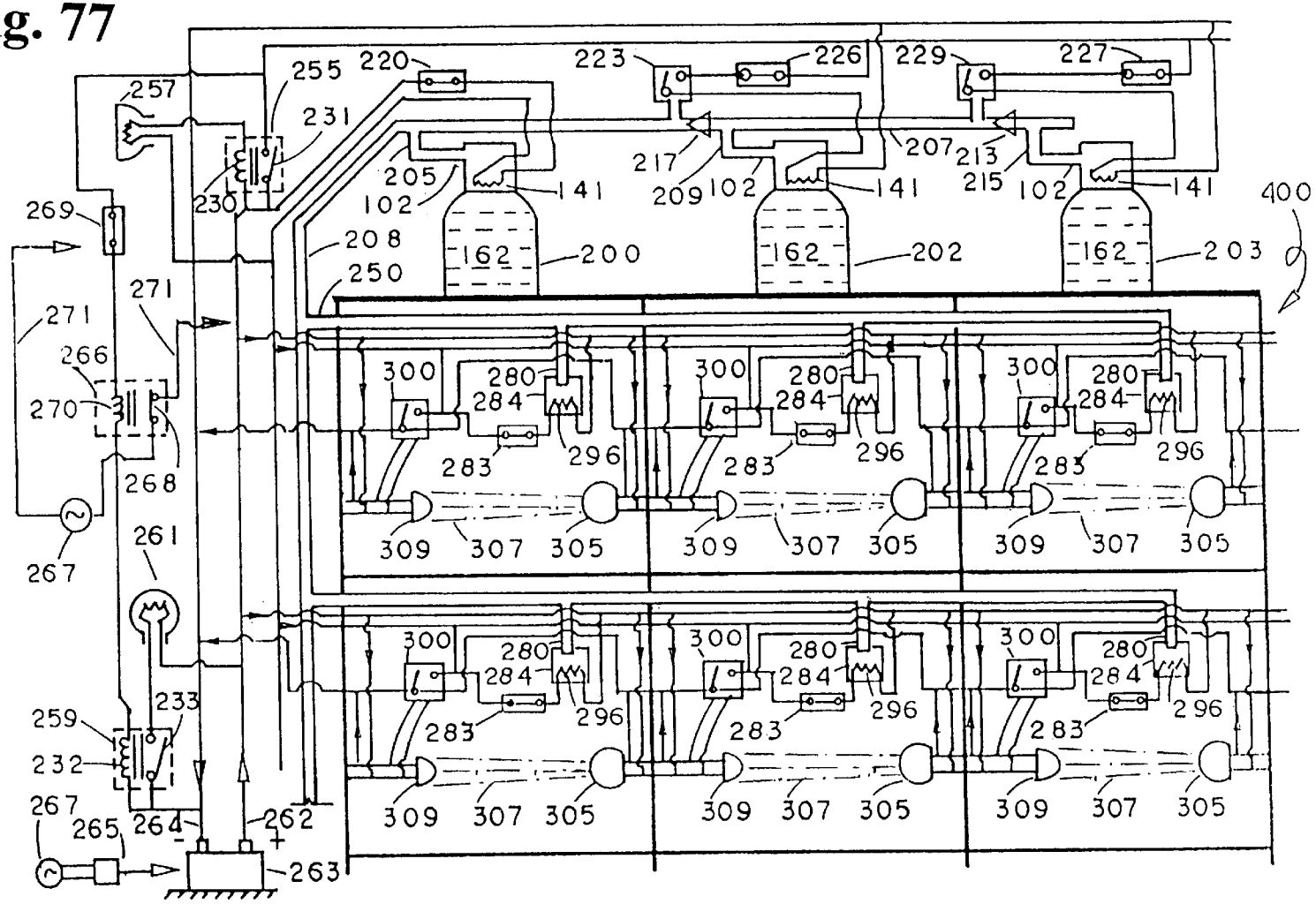
FIG. 77 shows how all components of automatic fire extinguishing system are arranged.

Automatic Extinguishing System:

An automatic extinguishing system is shown in FIG. 77, consists of 2 main components as follow:

1. piping loop, and
2. wiring loop.

These two loops are installed in all rooms in tall or huge buildings and will be described.

1. Piping loop is composed of fire extinguishers 98 containing extinguishing agent 162 amounts at least 400 lbs. with pressure at least 500 psi. Fire extinguisher 98 may be installed at any part of the building but the most appropriate would be the highest floor in the building since the gravity may somehow help accelerate the flow of extinguishing agent downwards.

Many of fire extinguishers 98 can be connected in series, here assumingly there are 3 fire extinguishers, giving numbers 200, 202 and 203. All are installed in the top floor of building 400, assumably a 60-storey building where there can be any number of rooms in each floor. A set of automatic extinguishing component is installed in each room where in every room it features similarly. In the following description, steps of fire extinguishing will be described only in one room referred as reference room, where if fire bursts out any of other rooms, steps of fire extinguishing occurs then similarly.

In the present invention, extinguishing agent will be ejected only into a room in which fire breaks out. If fire breaks out in many rooms at the same time, extinguishing agent can also be ejected into those rooms in similar manner and at the same time to put out fire.

As shown in FIG. 77 three fire extinguishers given numbers—200, 202, and 203 are connected in series through main pipe 207 installed horizontally.

A main pipe 208 runs vertically and connects to main pipe 207.

Branch pipes 250 each runs through rooms in each floor of building 400 and connects to main pipe 208.

From each branch pipe 250, there are short pipes or nipples 280 each runs into each room.

At the end of each nipple 280 in each room there are external threads which can mate tightly to internal threads 289 of a room ejection set 284.

From fire extinguisher 200, its discharge tube 102 is connected to brance pipe 205 from main pipe 207, where on main pipe 207 between fire extinguishers 200 and 202 there is a pressure switch 223.

In main pipe 207, there is a check valve 217 installed between pressure switch 223 and a brance pipe 209 which connects between main pipe 207 and discharge tube 102 of fire extinguisher 202.

A pressure switch 229 is installed on main pipe 207 somewhere between fire extinguishers 202 and 203.

Next in main pipe 207, there is a check valve 213 installed between pressure switch 229 and a branch pipe 215 which connects between main pipe 207 and discharge tube 102 of fire extinguisher 203.

A check valve is a valve allowing flow of fluid only in one direction and never in reverse direction, where as shown in FIGS. 89–95 and 102–107, extinguishing agent can flow only in direction as shown by arrow head of check valves 213 and 217.

2. Wiring loop from fire extinguisher 200, heating coil 141 is connected through fuse 220 to external electrical unit installed outside building 400;

from fire extinguisher 202, heating, coil 141 is connected through pressure switch 223 and fuse 226 to external electrical unit installed outside building 400;

from fire extinguisher 203, heating coil 141 is connected through pressure switch 229 and fuse 227 to external electrical unit installed outside building 400.

Pressure switches 223 and 229 used in the present invention are of one-way differential pressure switch type (conventional) where no matter how high pressure inside the switch changes from zero to higher, it remains in 'OFF' (normally 'OFF') position. The switch will be actuated only when pressure inside it falls from higher to a preset value that pressure switch will then be turned on. Electric current can thus flow through pressure switch. In the present invention, pressure switch is preset to turn on when pressure decreases from higher to 30 psi and not vice versa, i.e. only one way.

Electrical Appliances Installed Outside Building:

These are

Figure 78:
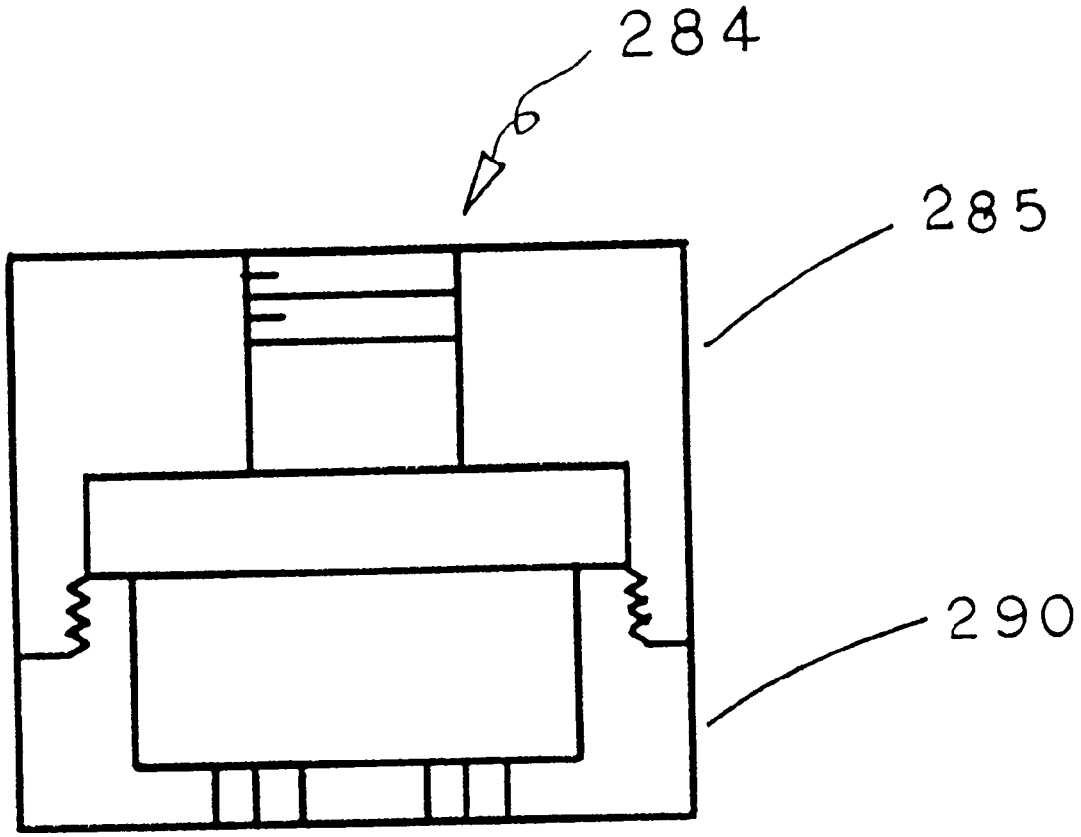
FIG. 78 shows a sectional view of a room ejection set to be used in automatic fire extinguishing system.
Figure 79:
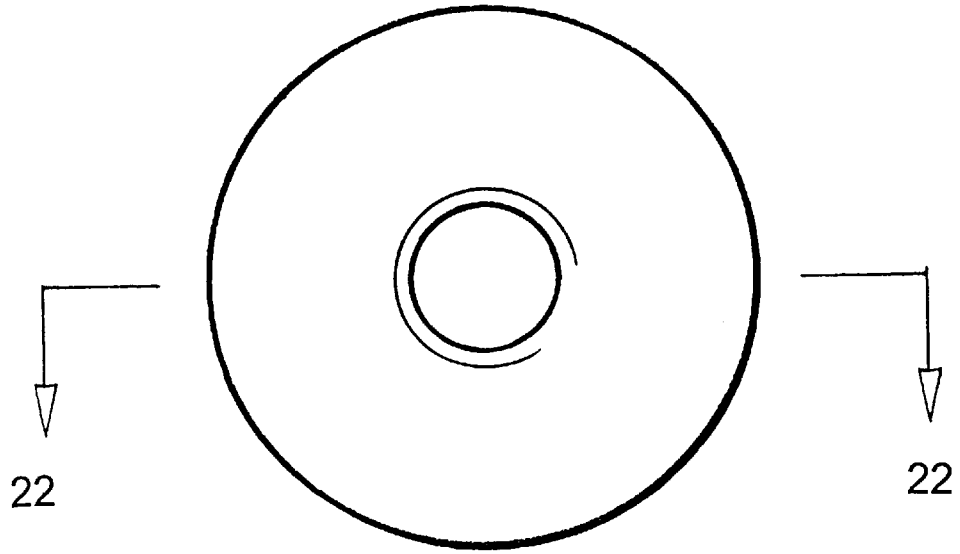
FIG. 79 is a top view of upper portion of a room ejection set.
Figure 80:
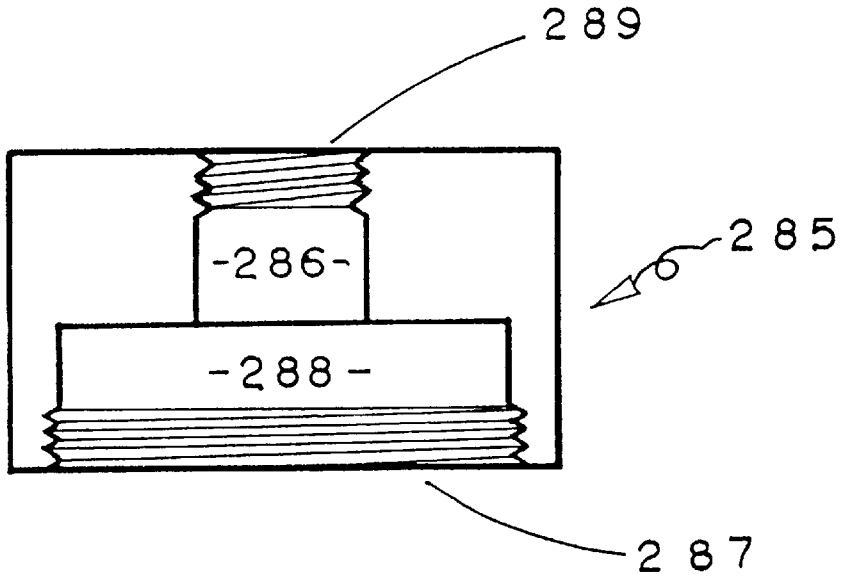
FIG. 80 is a a sectional view along line 22—22 of FIG. 79.
Figure 81:
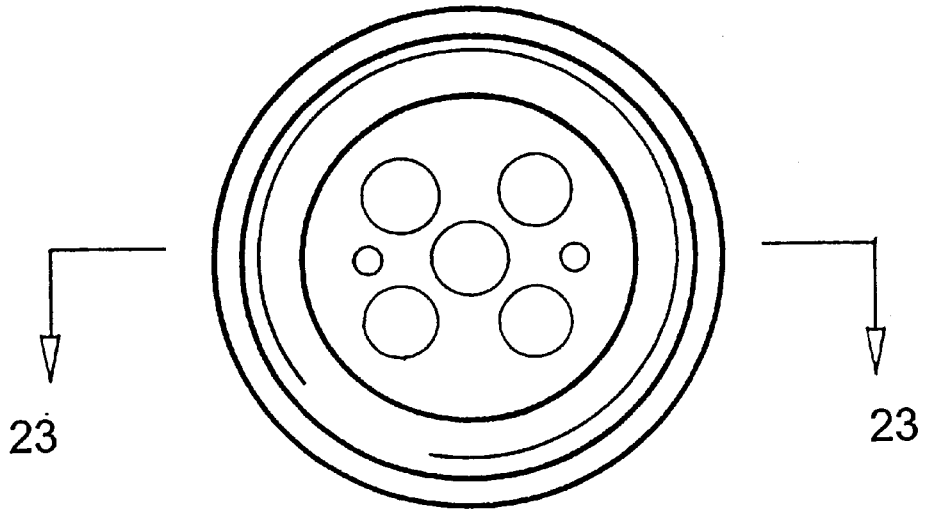
FIG. 81 is a top view of lower portion of a room ejection set.
Figure 82:
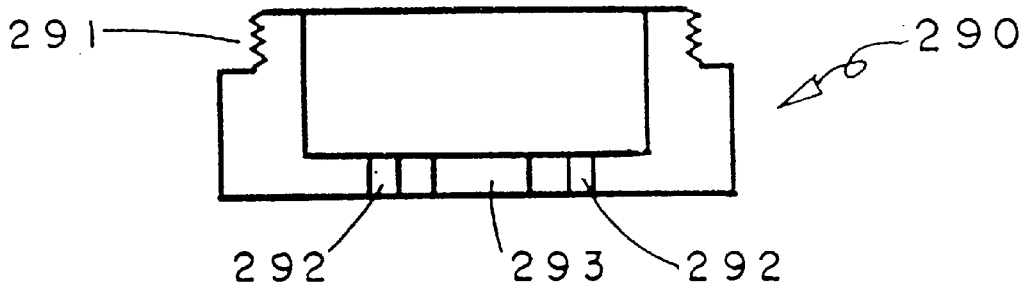
FIG. 82 is a a sectional view along line 23—23 of FIG. 81.
Figure 83:
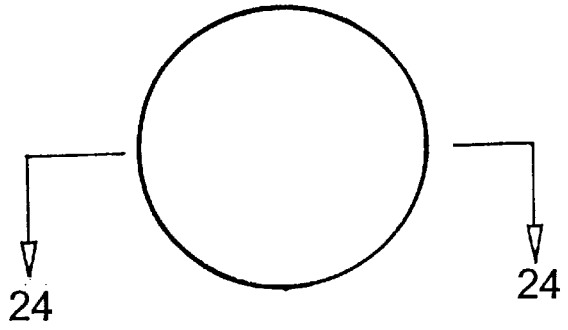
FIG. 83 is a top view of a cartridge to be used in a room ejection set.
Figure 84:
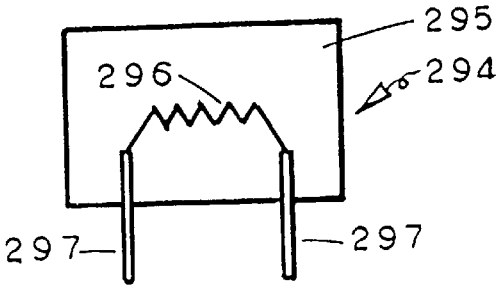
FIG. 84 is a sectional view along line 24—24 of FIG. 83 of a melting cartridge to be used in a room ejection set.
Figure 85:
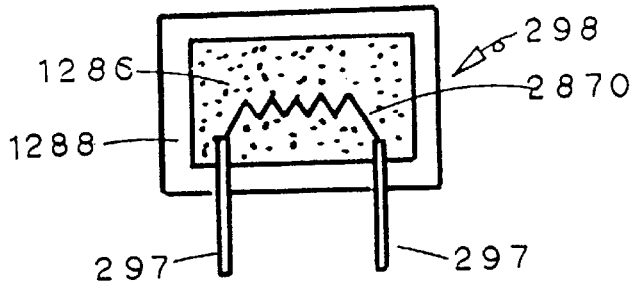
FIG. 85 is a sectional view along line line 24—24 of FIG. 83 of an explosive cartridge to be used in a room ejection set.

1. Battery 263 to provide DC for whole automatic fire extinguishing system;
2. Control relay 255 which is composed of an inducting coil 230 and a switch 231;
3. Siren 257 which is actuated to make a long loud sound as a warning when fire breaks out. Siren 257 is connected in series to inducting coil 230;
4. Fuse 269 connected in series to switch '231';
5. Main electric line 271 which provides AC from an alternating current-main line 267 into all the rooms in the building, is connect in series to a switch 268 of control relay 266. In normal situation where there is no fire, electricity is provided into all the rooms in the building through this switch 268.
6. Control relay 266 which is composed of an inducting coil 270 and a switch 268, where in a normal situation when fire has not yet broken out, switch 268 will be in 'ON' (normally 'ON') position. Yet, when fire breaks out switch 268 is induced to 'OFF' position and remains as such,
   inducting coil 270 is connected in series to fuse 269 and inducting coil 232,
   control relay 266 functions only when fire breaks out to turn off electricity in the whole building. In case electricity is to be off in each room at a time, a control relay of the same type should be installed separately for each room;
7. Control relay 259 which is composed of an inducting coil 232 and a switch 233, where in a normal situation when fire has not yet broken out, switch 233 will always be in 'OFF' (normally 'OFF') position. Yet, when fire breaks out, switch 233 is induced by inducting coil 232 to 'ON' position and remains as such;
8. Blinking lamp 261 connected in series to switch '233';
9. Alternating current-main line 267 which is connected to a battery charger 265 to charge battery 263 at all time;

Electrical Appliances Installed in Each Room Inside Building:

These are 1. room ejection set 284 made of durable material preferably also heat-resistant, from which extinguishing agent is ejected out when fire breaks out, as shown in FIG. 78, is composed of several components as follow:

1.1 upper portion 285 is a cylindrical lid,
where, FIG. 79 is a top view,
FIG. 80 is a sectional-view along line 13—13 of FIG. 79,
with a circular cavity 286 in its center where there are internal threads 289 in the upper end of cavity 286; next lower to cavity 286 is another larger circular cavity 288 with internal threads 287 at it lower end;

1.2 lower portion 290 is also of cylindrical shape,
where, FIG. 81 is a top view,
FIG. 82 is a sectional-view along line 14—14 of FIG. 81,
having external threads 291 at its outer upper edge to mate tightly to internal threads 287 where at its floor there are 2 holes 292 and several holes 293;

2. cartridge to fill space between upper and lower portion, there can be of 2 types which only either one is used;

2.1 melting cartridge 294,
where, FIG. 83 is a top view,
FIG. 84 is a sectional-view along line 15—15 of FIG. 83,
is a cylindrical plastic plate 295 having a heating coil 296 whose ends connected to electrodes 297 to provide electric current; or 2.2 explosive cartridge 298,
where, FIG. 83 is a top view,
FIG. 85 is a sectional-view along line 24—24 of FIG. 83,
is a hollow cylindrical plastic box 1288 filled with explosive powder 1286 with a heating coil 2870 buried inside. Both ends of heating coil 2870 are connected to 2 electrodes 297 to provide electric current from outside.

Explosive cartridge 298 is designed such that when it explodes it may cause only self-damage and can not damage any other components in the system.

Diameter of each electrode 297 is just slightly shorter than that of hole 292.

Diameter of melting cartridge 294 or explosive cartridge 298 is great enough to cover all the holes 293 of lower portion 290.

These two types of cartridge used in room ejection set 284 are similar to those used in fire extinguisher 98 except that electrodes are in the lower portion.

Figure 86:
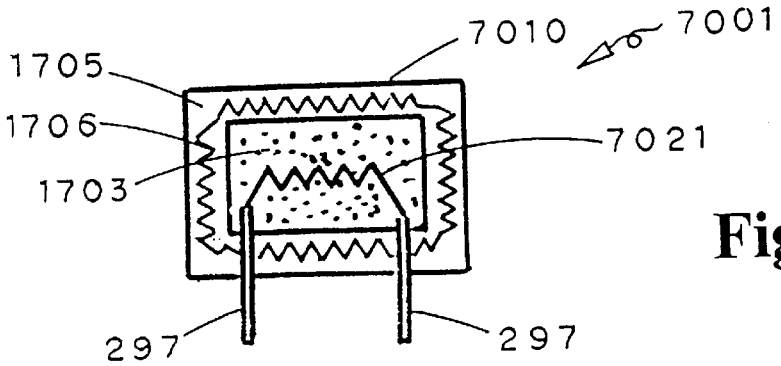
FIG. 86 is a sectional view along line line 24—24 of FIG. 83 of a hybrid cartridge to be used in a room ejection set.

2.3 Hybrid Explosive Cartridge 7001,
where, FIG. 83 is a top view,
FIG. 86 is a sectional view along line 24—24 of FIG. 83
is a cylindrical plastic box 7010 filled with explosive powder 1703. Upon explosion, this amount of explosive powder will damage only the cartridge but not any other parts of this automatic fire extinguishing system. There is a resisting coil 7021 buried within the explosive powder where each of its ends are connected to each of 2 electrodes 297.

Inside the plastic wall of the plastic box 1705, there are heating coils 1706 buried within with each of their ends connected to each of 2 electrodes 297.

This type of hybrid cartridge 7001 is the best to be used in the automatic fire extinguishing system that in case had any of the mechanisms failed to function the other mechanism can readily function.

Figure 87:
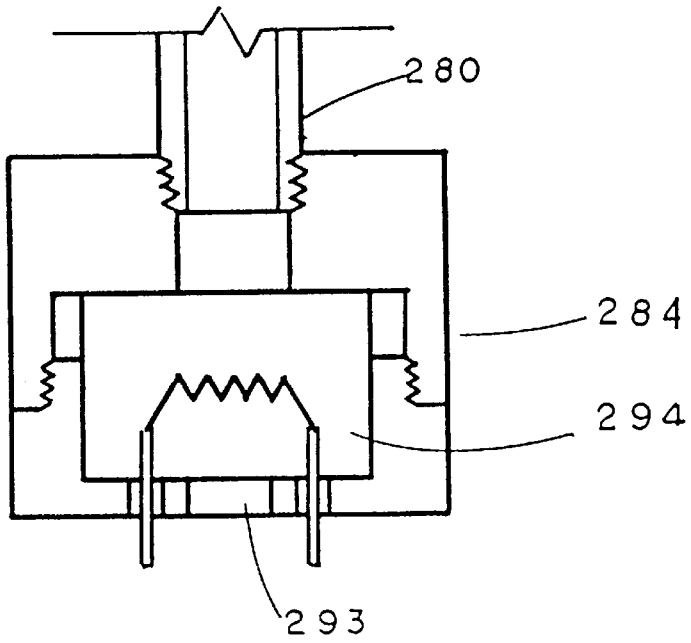
FIG. 87 shows a sectional view how a melting cartridge is assembled to a room ejection set.
Figure 88:
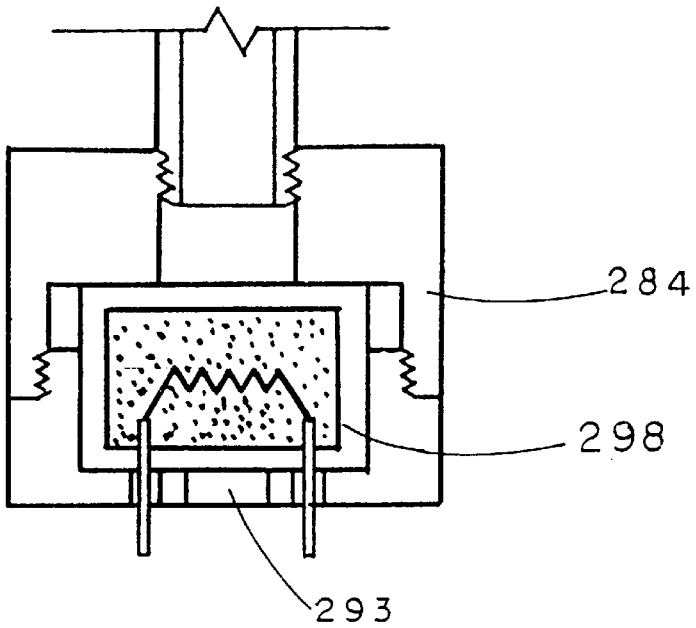
FIG. 88 shows a sectional view how an explosive cartridge is assembled to a room ejection set.

Assembly of Room Ejection Set 284 mate internal threads 289 of upper portion 285 to external threads at the end of nipple 280;

insert 2 electrodes 297 or 1297 through holes 292 of lower portion 290, thus melting cartridge 294 or explosive cartridge 298 is placed in lower portion 290;

mate external threads 291 of lower portion 290 tightly to internal threads 287 of upper portion 285 to press melting cartridge 294 or explosive cartridge 298 in between the two portions with electrodes 297 or 1297 extruding out downwards, as shown in FIGS. 87 or 88, respectively.

In a similar manner, if a hybrid cartridge 7001 is used, the same step of assembly can be applied.

In a normal situation, extinguishing agent can not leak out through this room ejection set 284 since holes 292 and 293 are all tightly closed by either melting cartridge 294 or explosive cartridge 298. Only in one case that holes 292 and 293 are opened, i.e., after plastic plate 295 melts down or plastic box 1288 is damaged by explosion which is self-limited and thereby extinguishing agent is ejected through this room ejection set 284;

3. control relay 300, where in normal situation when fire has not broken out, it is in 'OFF' position (normally off);

4. photoelectric light obscuration smoke detector is composed of:

4.1 a light source 305, and 4.2 a light-sensitive device 309, both in normal situation or during a fire, this smoke detector is provided electric current at all time to allow projecting of light beam 307 from light source 305 to light sensitive device 309. Thus, when smoke particles partially plate the light beam 307, the reduction in light reaching the light-sensitive device 309 alters its output. The change in output is sensed by the detector's circuitry, and when the threshold is crossed control relay 300 which is connected to light-sensitive device 309 is actuated to 'ON' position.

For most conventional photoelectric light obscuration smoke detector, blocking the light beam normally initiates an alarm.

Figure 89:
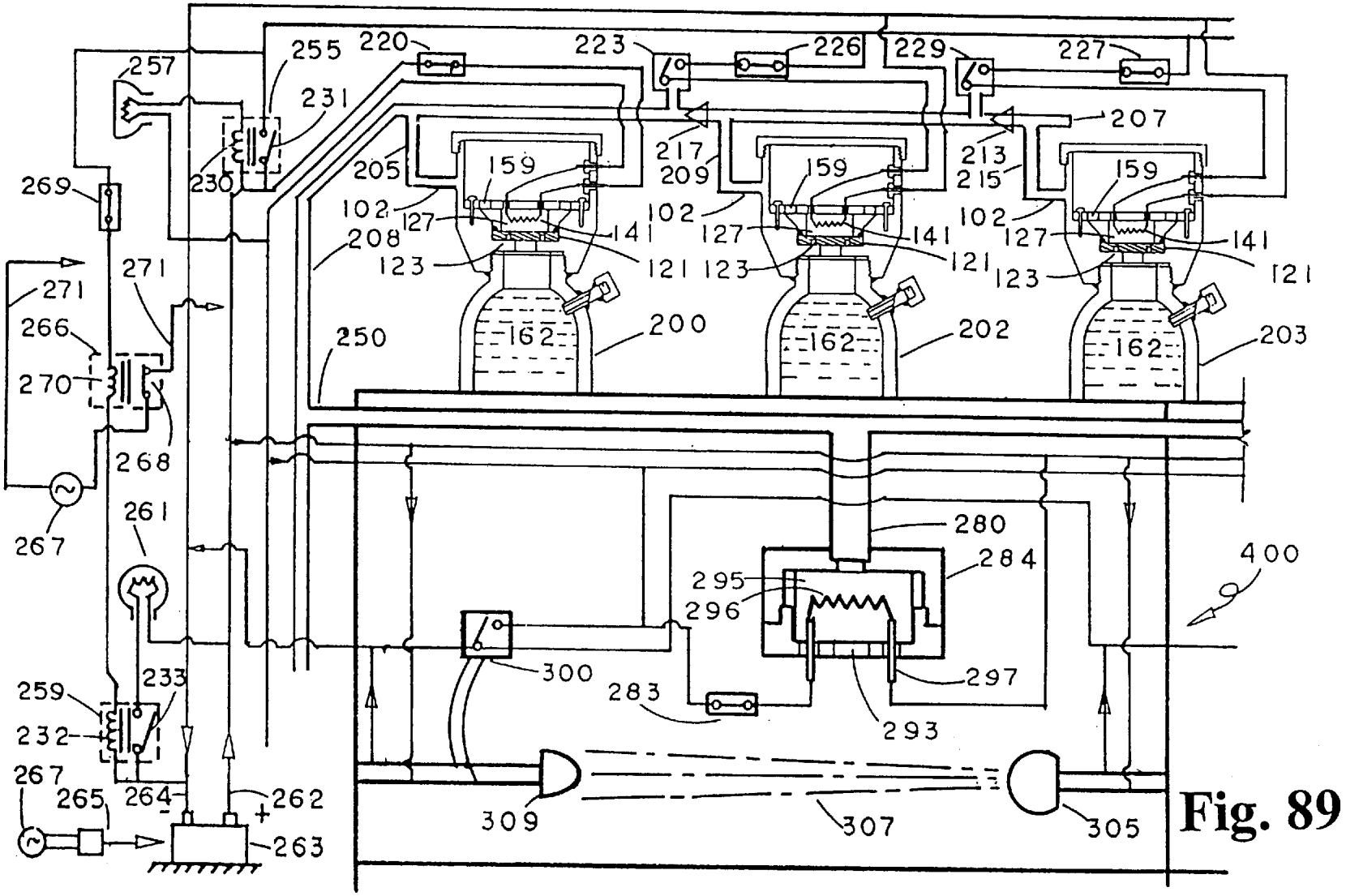
FIG. 89 is a diagram showing electric circuit in a reference room of automatic fire extinguishing system.

FIG. 89 is an enlarged diagram showing electric circuit in a reference room in building 400.

In a normal situation, fire extinguishers 200, 202 and 203 are all filled with extinguishing agent;

control relay 300 is 'OFF';

pressure switches 223 and 229 are 'OFF';

switch 231 of control relay 255 is 'OFF';

switch 268 of control relay 266 is 'ON' (normally on);

switch 233 of control relay 259 is 'OFF' (normally off);

electric current flows from anode of battery 263 through cord 262 to light source 305 and light-sensitive device 309 and back to cathode of battery 263 by cord 264.

In a normal situation, electric current flows in a direction as shown by the arrow heads in FIGS. 77 and 89.

When fire breaks out, flow of electric current in each step of automatic fire extingushing operation is shown in FIGS. 90–93.

Figure 90:
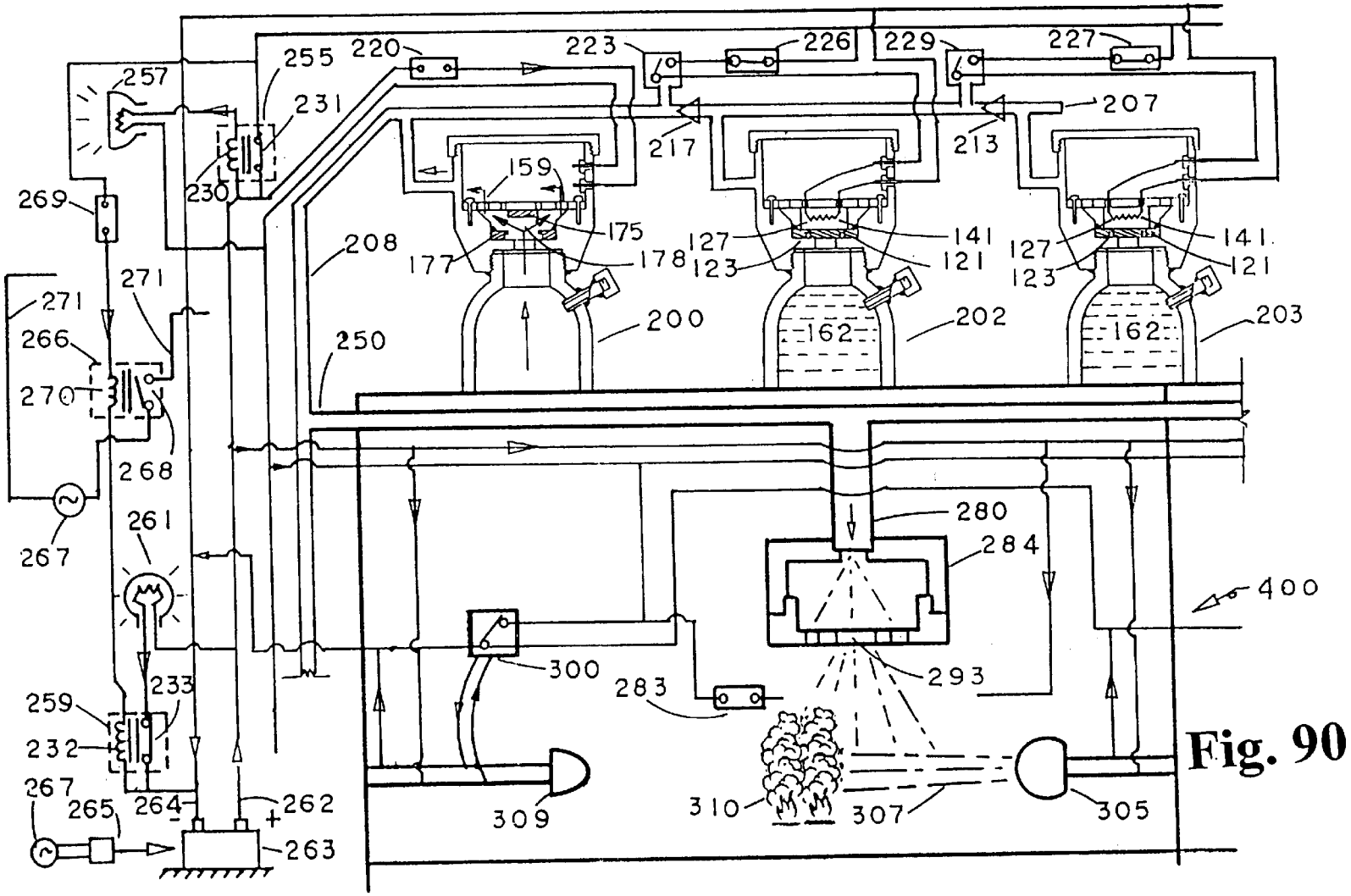
FIG. 90 shows arrow heads indicating flow of electric current when a fire starts in a reference room.

As shown in FIG. 90, 1. smoke formed obscures light beam 307, reduction of light received by light sensitive device 309 alters its output. When the threshold is crossed, control relay 300 is actuated to 'ON' position. Thereby, 2. in the room where fire breaks out, electric current flows in heating coil 296 of melting cartridge 294 in room ejection set 284. The whole plastic plate 295 melts down and a cavity is formed within room ejection set 284 to open holes 293.

When plastic plate 295 melts down, fuse 283 also melts thus disconnect electric current to heating coil 296 and prevent short circuit;

3. Just very short moment after opening of holes 293, at fire extinguisher 200, electric current flows through heating coil 141 and plastic plate 127 melts down to form a cavity between grooved circular steel plate 121 and pressing steel plate 153 (in the present invention, it is designed that plastic plate 127 must melt slightly slower than plastic plate 295 such that extinguishing agent will be ejected out from fire extinguisher only after holes 293 of room ejection set 284 are opened by melting of plastic plate 295 in the burning room). Pressure in fire extinguisher 200 thus breaks part 175 apart from part 177 of grooved circular steel plate 121 and forming a hole 179. Extinguishing agent is then ejected out through this hole 179.

After plastic plate 127 all melts down, fuse 220 will then melt to prevent short circuit.

In the mean time, fire extinguishers 202 and 203 do not yet operate since pressure switches 223 and 229 are still 'OFF'. There is not yet electric current flowing through heating coil 141 of both fire extinguishers;

4. the ejected extinguishing agent flows through hole 179 then into main pipe 207 and branch pipe 250 and out through holes 293 of room ejection set 284 to put out fire burning in the room;

5. after control relay 300 is 'ON' as described in 1., sequence of events happen to electrical appliances installed outside building 400 is:

6. electric current flows through inducting coil 230 of control relay 255 into siren 257. Siren 257 then makes very loud warning sound to notify that there is fire breaking out where this sound continues at all time during a fire and stops only after fire has been put out;

7. flowing of electric current through inducting coil 230 also induces switch 231 of control relay 255 to 'ON' position, thus allowing electric current to flow through fuse 269 into inducting coil 270 of control relay 266 and inducting coil 232 of control relay 259;

8. flowing of electric current through inducting coil 270 induces switch 268 of control relay 266 to 'OFF' position and remains as such for the rest of the time. Turning of switch 268 to 'OFF' position disconnects electric current flowing through main line 271 into all the rooms in building 400 and thus prevent short circuit in all rooms of the building;

9. flowing of electric current through inducting coil 232 induces switch 233 of control relay 259 to 'ON' position and remains as such for the rest of the time. This actuates blinking lamp 261 to start blinking and remains blinking for the rest of the time even control relay may have turned back to 'OFF' position and even fire has already been put out by the present system.

This is to notify that there has been a fire broken out in the building.

Since this automatic fire extinguishing system is a perfect one, sometime a fire may break out and has been put out while there is nobody inside the building. The blinking of lamp 261 is thus continuous to notify an attendant of the building that a fire has broken out and having also been put out.

Figure 91:
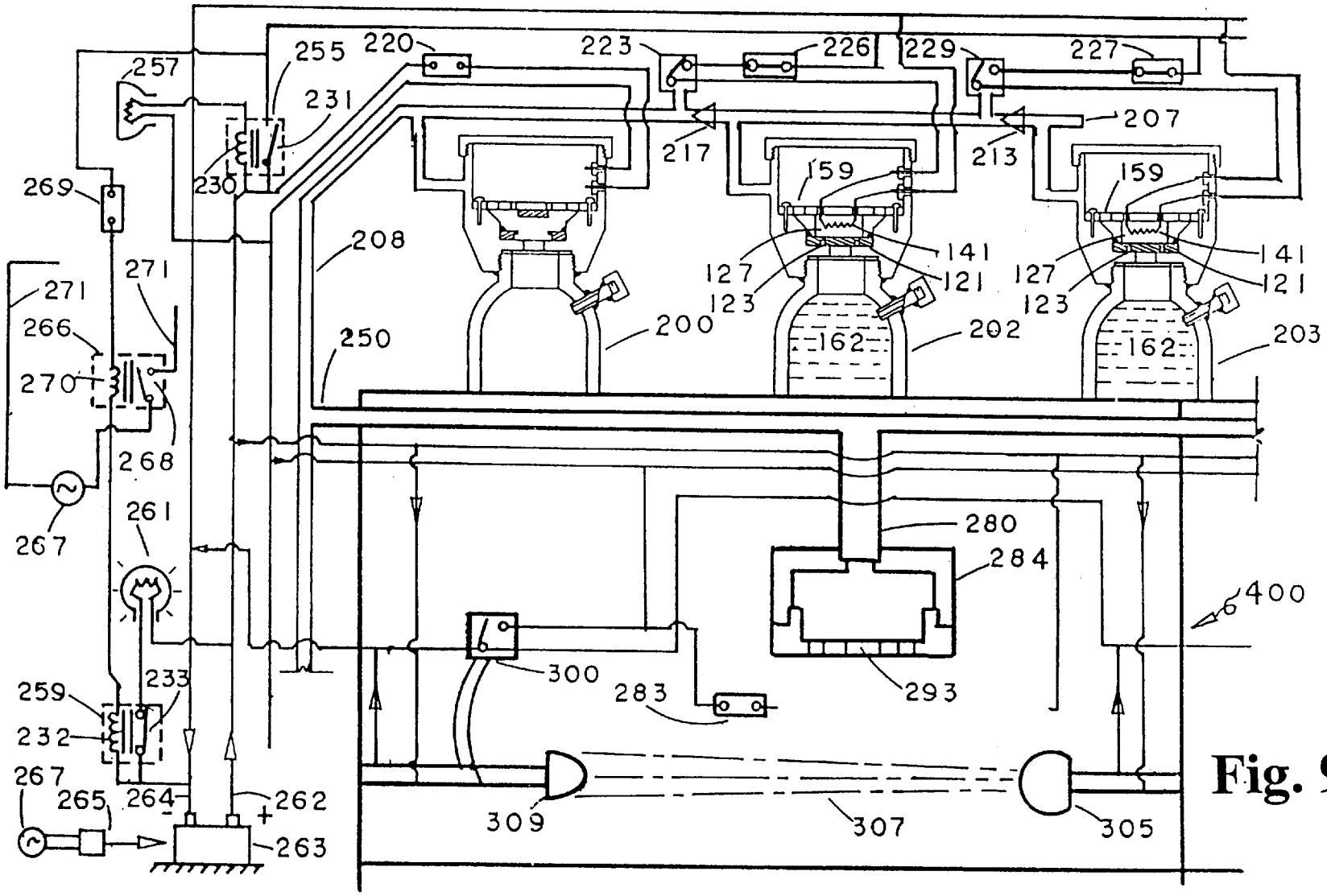
FIG. 91 shows, how all components operate in a reference room after fire was put out in automatic fire extinguishing system.

While fire extinguishing agent 162 of fire extinguisher 200 is ejected to put out fire in the room, as shown in FIG. 91 there are events occuring as follows:

1. had fire been put out, and intensity of smoke built up is not enough to obscure the light beam 307, threshold of light-sensitive device 309 is not crossed and thus control relay 300 is not actuated. Control relay 300 is then back to 'OFF' position.

Control relay 300 when being back to 'OFF' position, causes 2. no electric current flows in inducting coil 230, siren 257 then stops making loud noise,
3. Switch 231 is back to 'OFF' position,
4. fire extinguishing agent 162 is being continuously ejected out from fire extinguisher 200 to make the pressure inside shell drop from 500 psi to 30 psi, where pressure inside pipe 207 and within pressure switch 223 also decrease simultaneously to 30 psi, thus causes
5. pressure switch 223 to be in 'ON' position. However, since switch 231 of control relay 255 is 'OFF', there will be no electric current in pressure switch 223 and heating coil 141 of fire extinguisher 202, fire extinguisher 202 thus is not activated.

Figure 92:
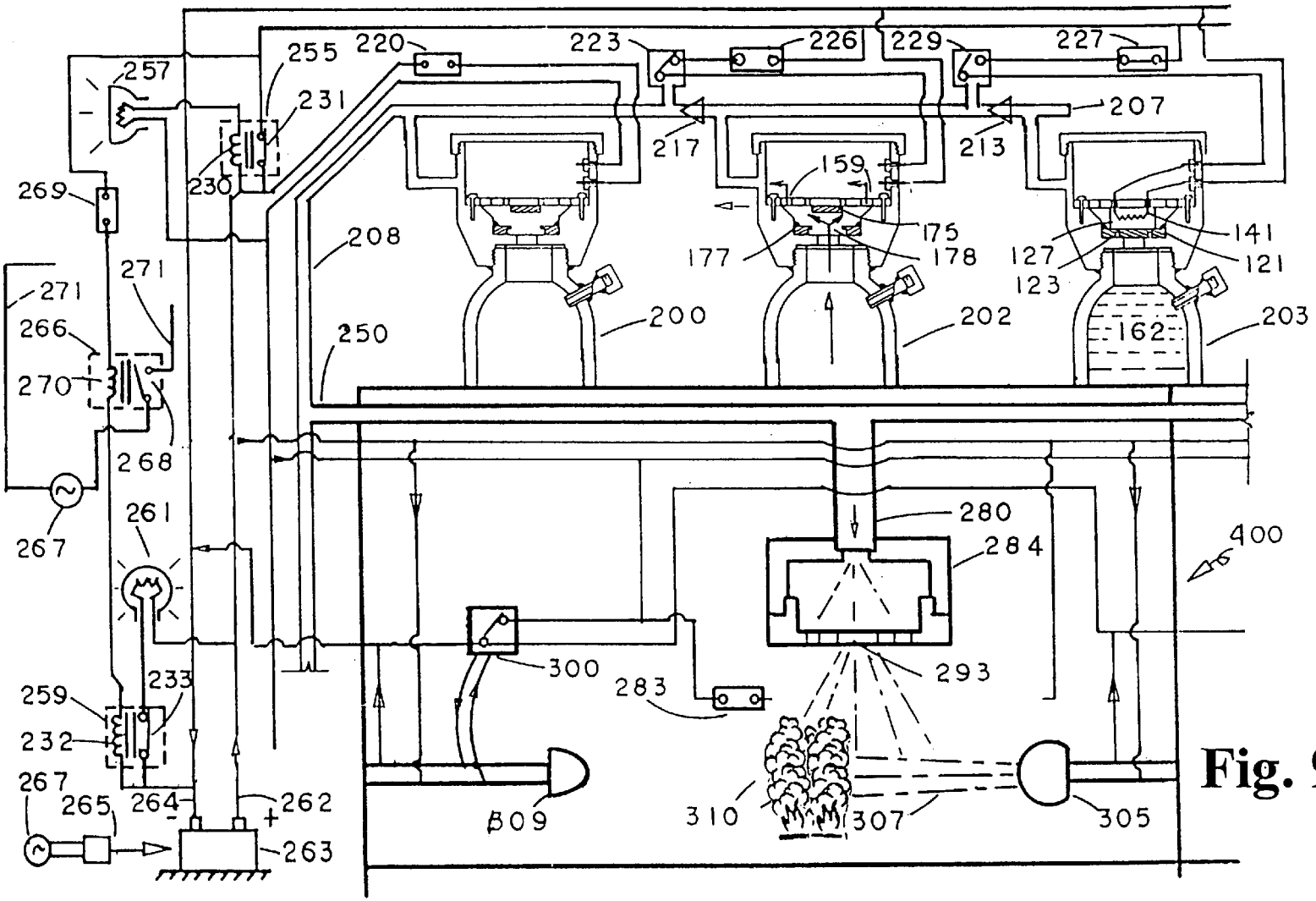
FIG. 92 shows how all components operate further if fire has not yet been put out even fire extinguishing agent in one fire extinguisher is used up and a next fire extinguisher has to be used.

In case that fire is still burning, as shown in FIG. 92 even pressure inside shell 21 of fire extinguisher 200 has been dropped down to 30 psi, smoke is still of great intensity and thus obscures the light beam 307 and causes control relay 300 to be yet in 'ON' position. Switch 231 of control relay 255 is thus still in 'ON' position and allows electric current to flow through and to pressure switch 223 which is already in 'ON' position. Electric current then flows through heating coil 141 of fire extinguisher 202. Heat built up then melts plastic plate 127 of fire extinguisher 202 and fire extinguishing agent 162 is thus being ejected to put out fire in a similar manner as what has been described.

Figure 93:
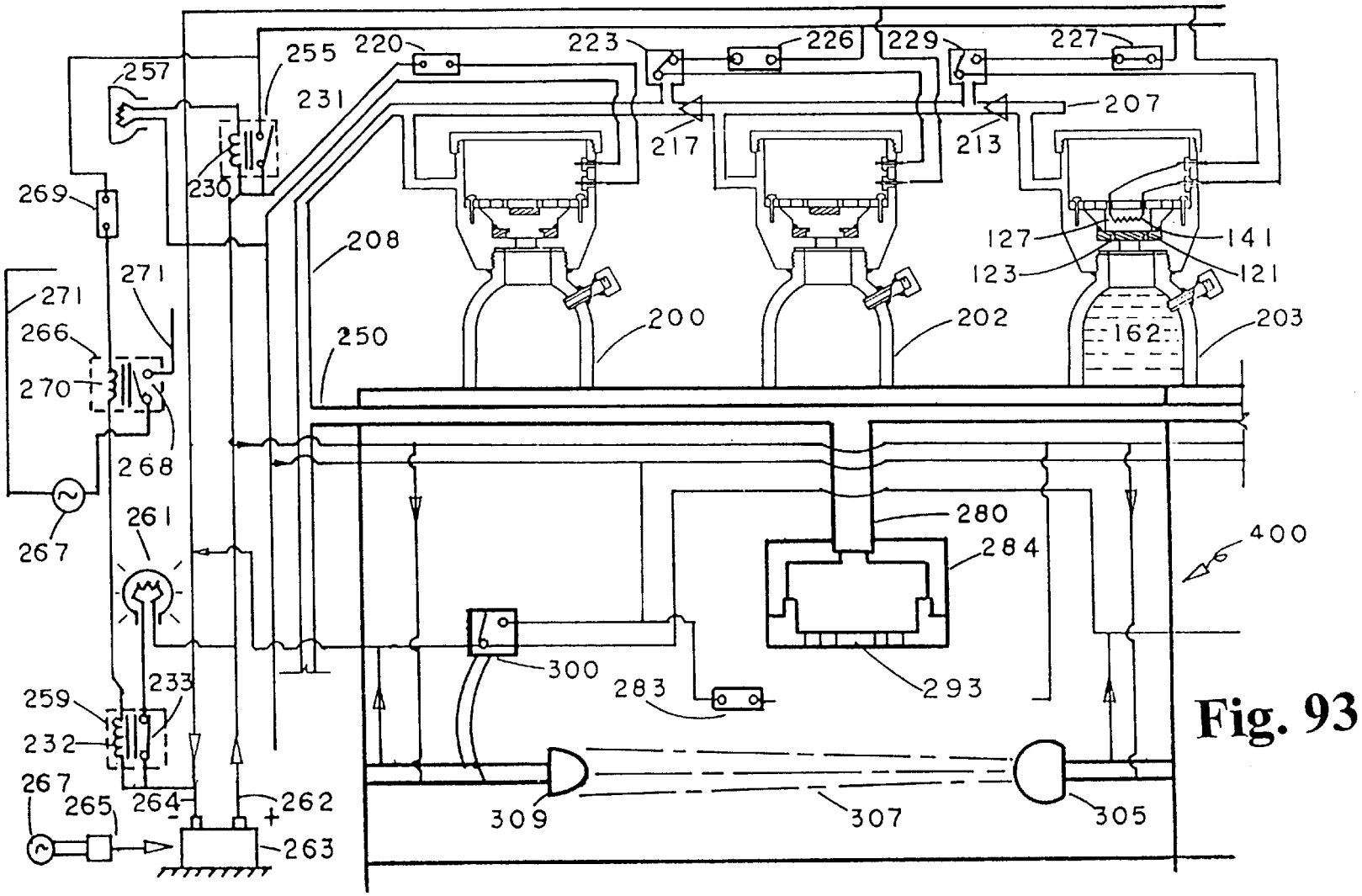
FIG. 93 shows how all components operate after fire has been put out while fire extinguishing agent in fire extinguisher has not been used up that a next fire extinguisher needs not be used.

As shown in FIG. 93, if fire was put out before pressure in shell 21 of fire extinguisher 202 drops to 30 psi, smoke is not enough to obscure light beam 307 and control relay 300 is then back to 'OFF' position. Pressure switch 229 has not yet been actuated, thus there will not be actuation of fire extinguisher 203.

Figure 94:
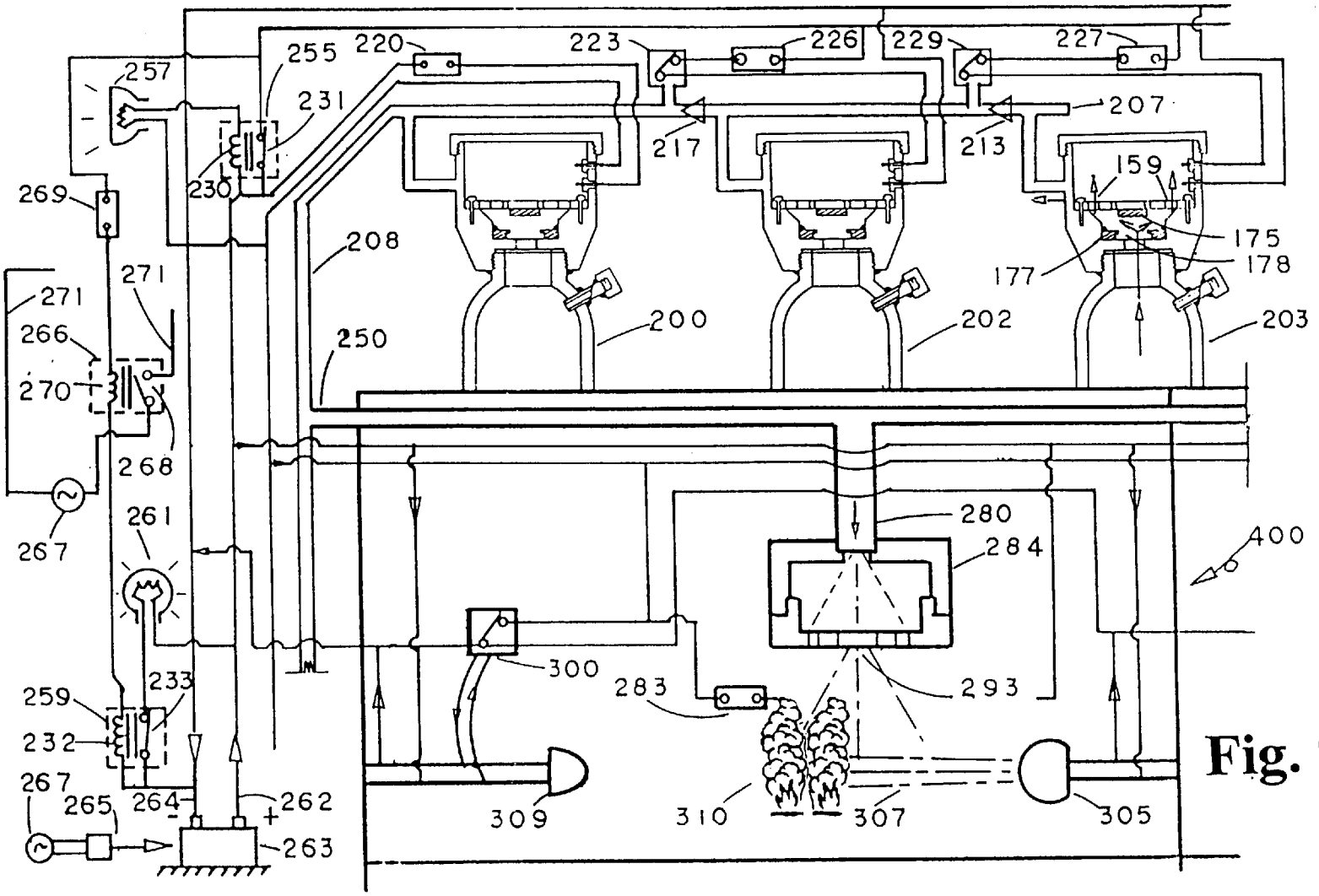
FIG. 94 shows how a third fire extinguisher needs to operate if fire can not yet be put out that a next fire extinguisher needs to be used.

As shown in FIG. 94, while pressure inside fire extinguisher 202 drops down to 30 psi, yet fire is still burning, then there will be electric current flows through pressure switch 229 and heating coil 141 in fire extinguisher 203. Plastic plate 127 melts down and fire extinguishing agent 162 is thus being ejected to put out fire.

In case there have been fire breaking out in more than one room at the same time like in the situation of fire-bomb or intentionally setting up fire, all automatic fire extinguishing components in each room can start putting out fire at the same time and in the same way for every room which fire breaks out.

Figure 95:
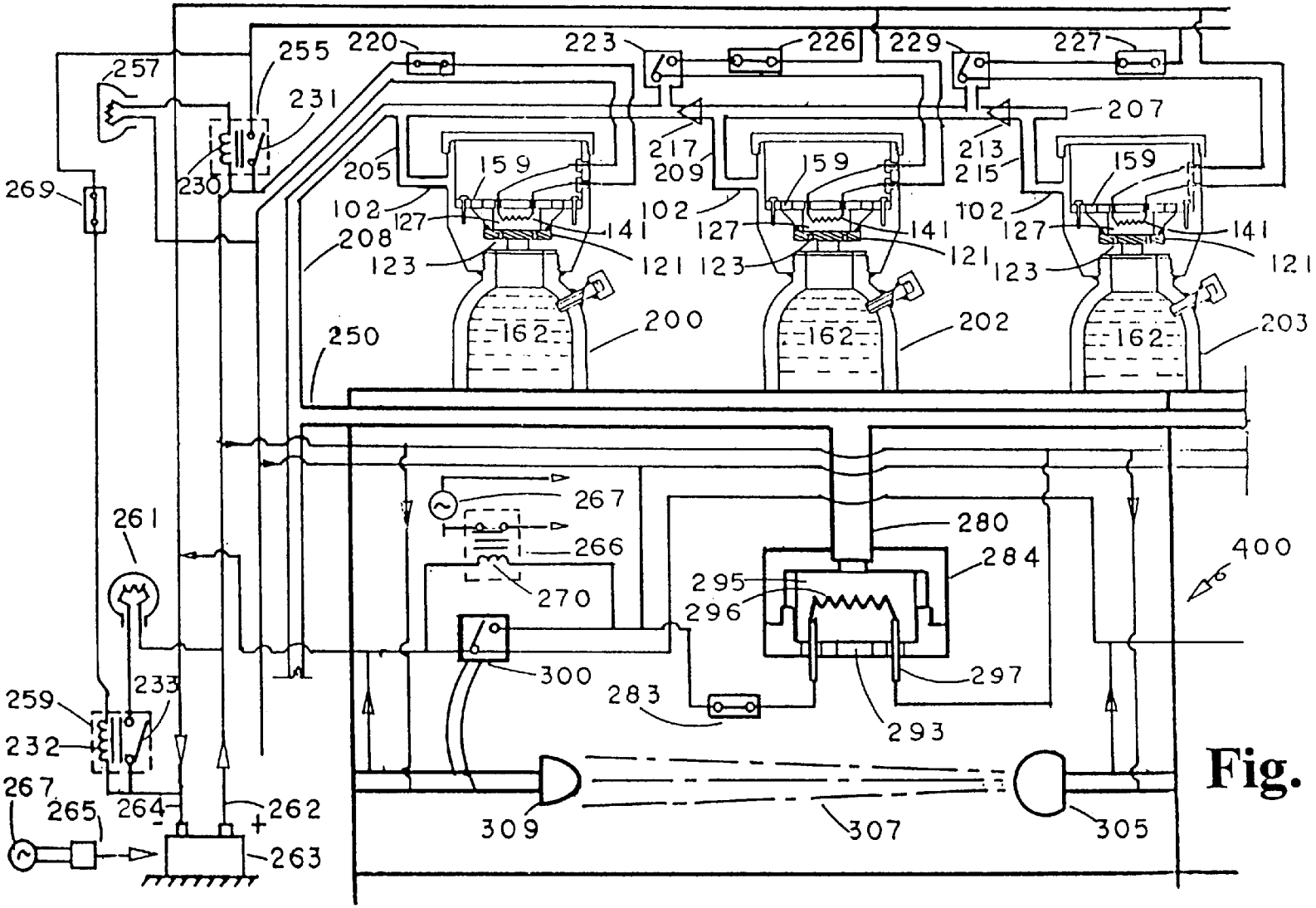
FIG. 95 shows installation of a control relay to turn off electricity only in a particular room that fire breaks out.

If while fire is breaking out, AC current is designed not to flow into only the burning room, FIG. 95 shows how a control relay 266 is installed in each room by connecting inducting coil 270 of control relay 266 paralelly to control relay 300 and thus control relay 266 which was installed outside the building is not required. In normal situation, control relay 266 is in 'ON' position that AC current flows into each individual room. After a fire breaks out, when control relay 300 is 'ON' control relay 266 will be 'OFF' and thus disconnects AC current not to flow into the burning room.

Fire extinguishers can be installed in series as many units as possible to be sufficient for each building.

Room Ejection Set 284 (as in FIG. 78) can be alternatively equipped with an automatic fire extinguishing agent on-off set 800 to allow or to stop ejection of fire extinguishing agent into a room having fire broke out.

Figure 96:
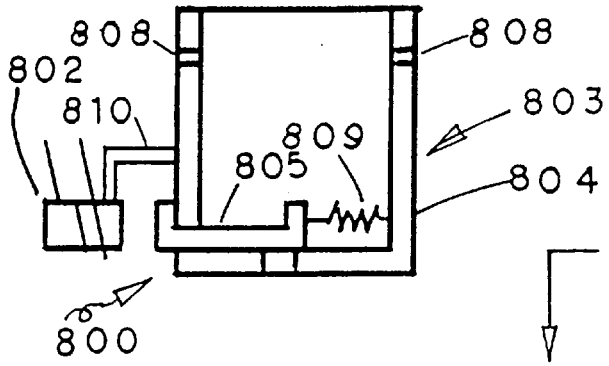
FIG. 96 is a sectional view of an automatic fire extinguishing agent on-off set.
Figure 99:
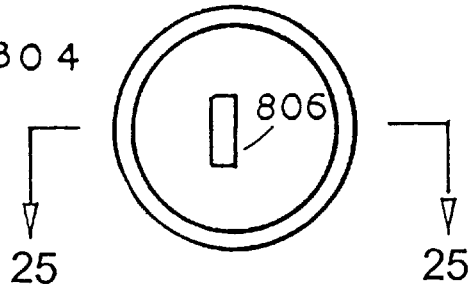
FIG. 99 is a top view of ejection chamber of an automatic fire extinguishing agent on-off set.
Figure 97:
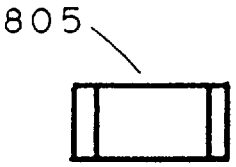
FIG. 97 is a top view of a slidable component of an automatic fire extinguishing agent on-off set.
Figure 100:
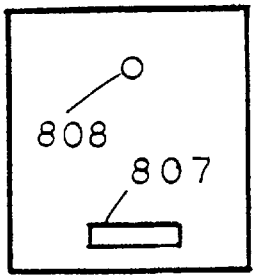
FIG. 100 is a side view of ejection chamber of an automatic fire extinguishing agent on-off set.
Figure 98:
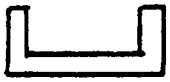
FIG. 98 is a side view of a slidable component of an automatic fire extinguishing agent on-off set.
Figure 101:
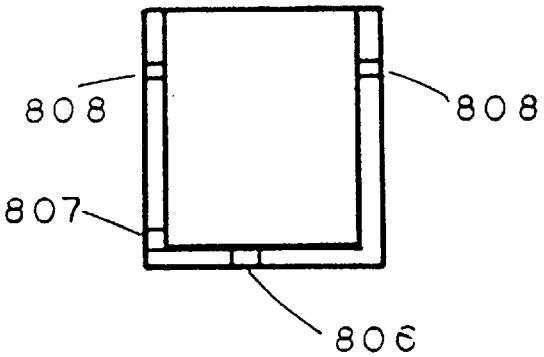
FIG. 101 is a sectional view of ejection chamber of an automatic fire extinguishing agent on-off set along line 25—25 of FIG. 99.

Automatic fire extinguishing agent on-off set 800 as shown in FIG. 96 consists of:

an electromagnet 802 is connected to cylinder 803 through an arm 810, where cylinder 803 consists of 1. a slidable component 805 made of duraable stainless steel of considerable thickness, where
   FIG. 97 is a top view,
   FIG. 98 is a side view; and
2. an ejection chamber 804 where
   FIG. 99 is a top view,
   FIG. 100 is a left-side view; and
   FIG. 101 is a sectional view along line 25—25 of FIG. 99;

is a cup where just slightly below its upper edge there are 2 holes 808 for inserting the electric wire through to connect to electrodes 297. Through the bottom of chamber 804 is a hole 806 which can be closed or opened by slidable component 805 which can slide to-and-fro through a rectangular hole 807 in the chamber wall at a position facing electromagnet 802.

This slidable component 805 has one of its end connected to the inner wall of chamber 804 through a tension spring 809.

When there is no fire breaking out, there is no DC current in electromagnet 802. Tension spring 809 keeps hole 806 closed by pulling slidable component 805 to close hole 806. Fire extinguishing agent is thus not ejected from chamber 804. However, once a fire breaks out, DC current is supplied and electromagnet 802 is actuated to draw slidable component 805 to open hole 806. Fire extinguishing agent is then ejected through hole 806.

After fire has been put out, circuit is then disconnected that there is no DC current in electromagnet 802, tension spring 809 once again draws slidable component 805 to close hole 806.

Figure 102:
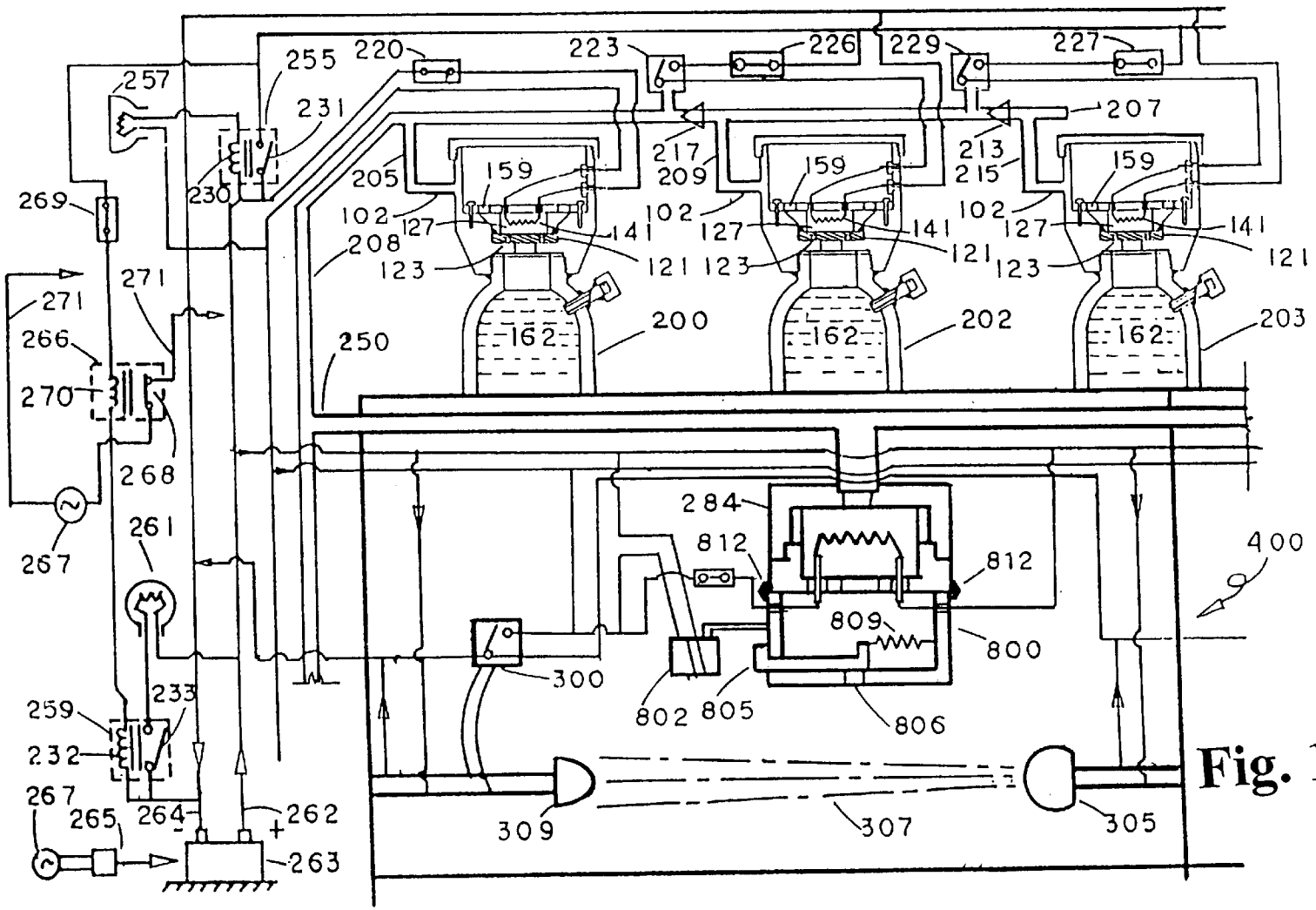
FIG. 102 shows how an automatic fire extinguishing agent on-off set is installed to a room ejection set.

As shown in FIG. 102, after automatic fire extinguishing agent on-off set 800 is installed to room ejection set 284 with fillet weld 812 and coil of electromagnet 802 is connected serially with control relay 300.

Figure 103:
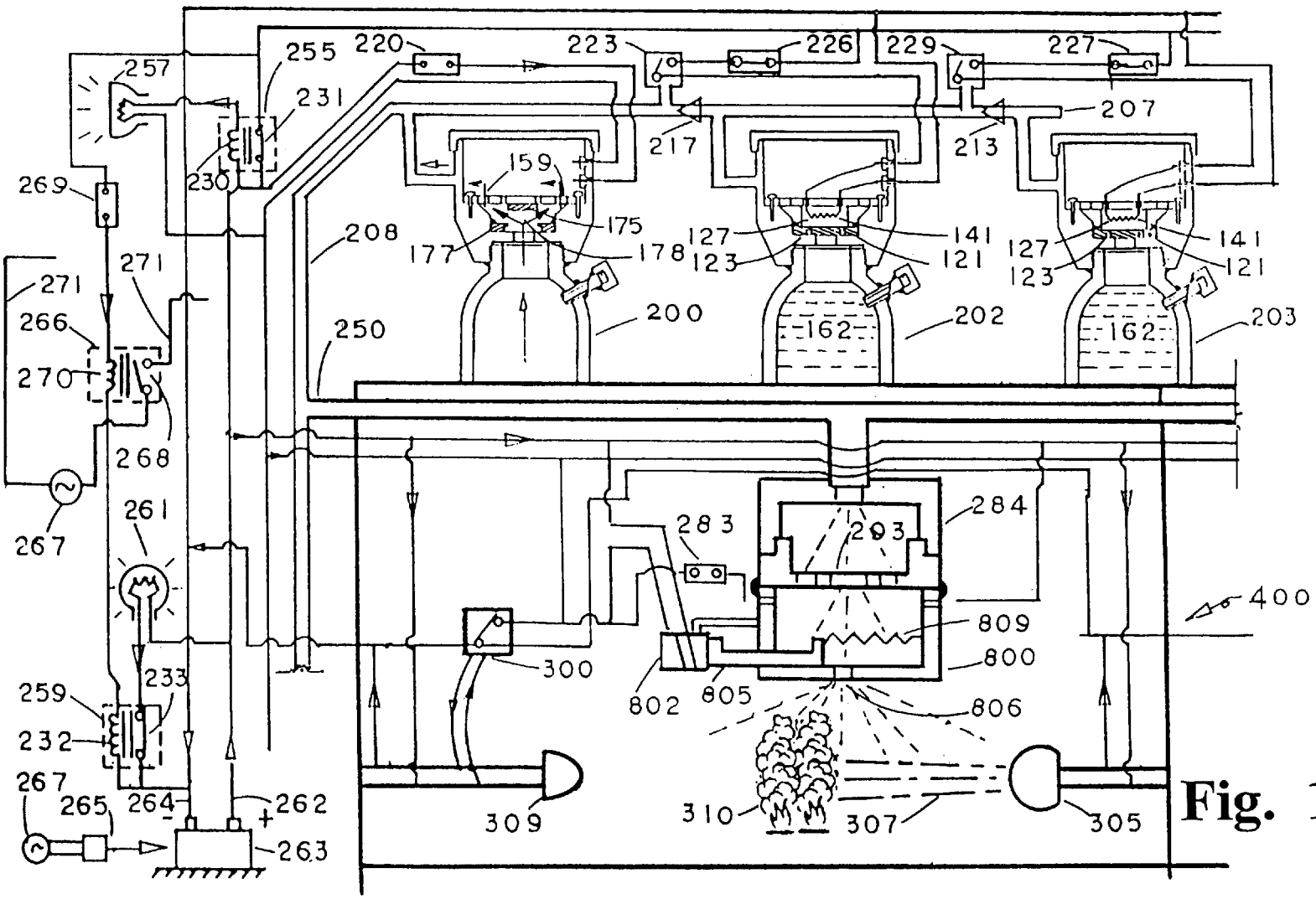
FIG. 103 shows how an automatic fire extinguishing agent on-off set operates when fire breaks out.

As shown in FIG. 103, when a fire breaks out, control relay 300 will be 'ON' and fire extinguishing agent is ejected out through holes 293.

Simutaneously, electromagnet 802 draws slidable component 805 to open hole 806 and allow fire extinguishing agent to be ejected out.

Figure 104:
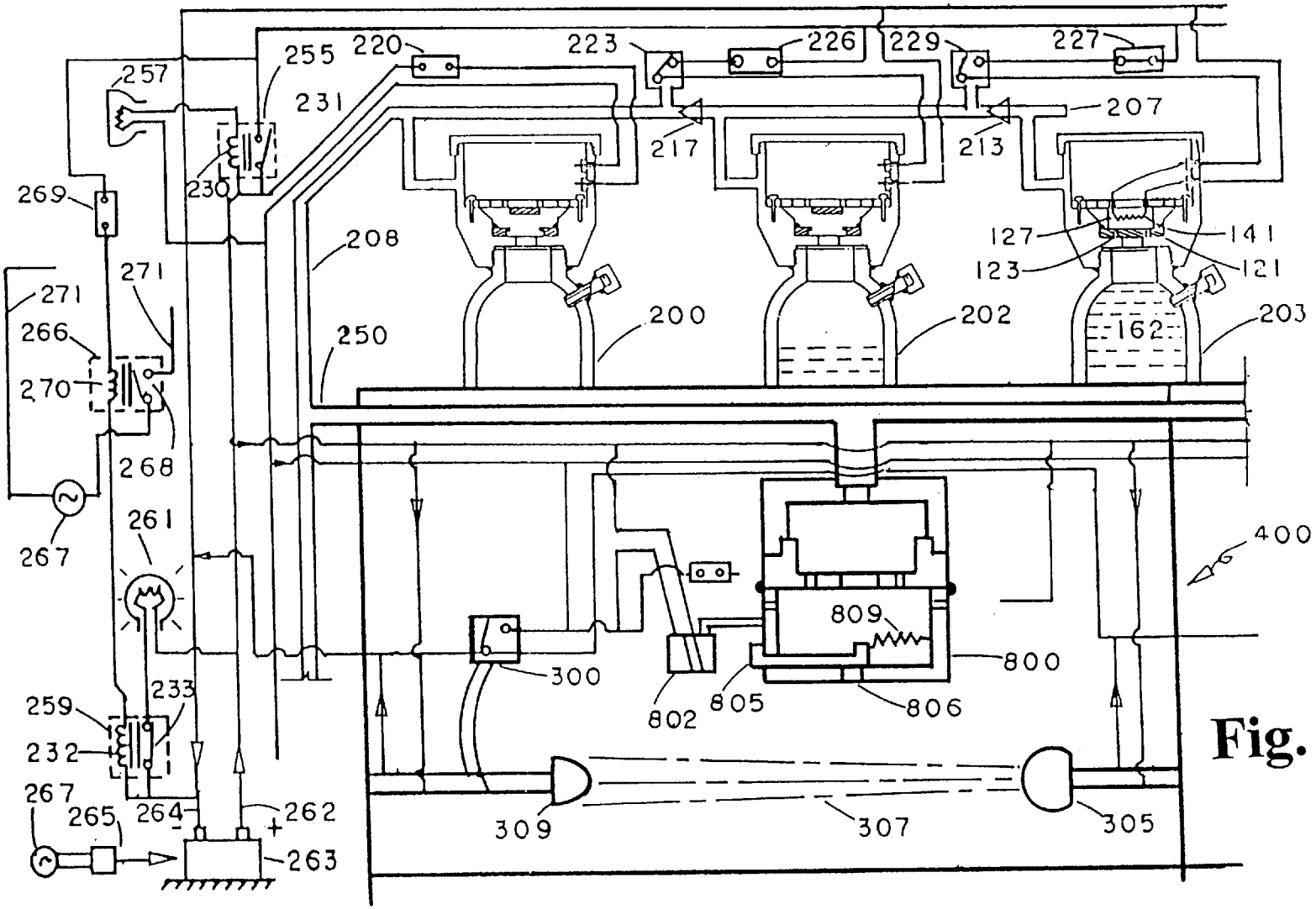
FIG. 104 shows how an automatic fire extinguishing agent on-off set operates when fire has been put out.

FIG. 104 shows that after fire is put out, control relay 300 will be back to 'OFF' position. There will not be electric current through electromagnet 802. Tension spring 802 draws the slidable component 805 to close hole 806 once again.

Figure 105:
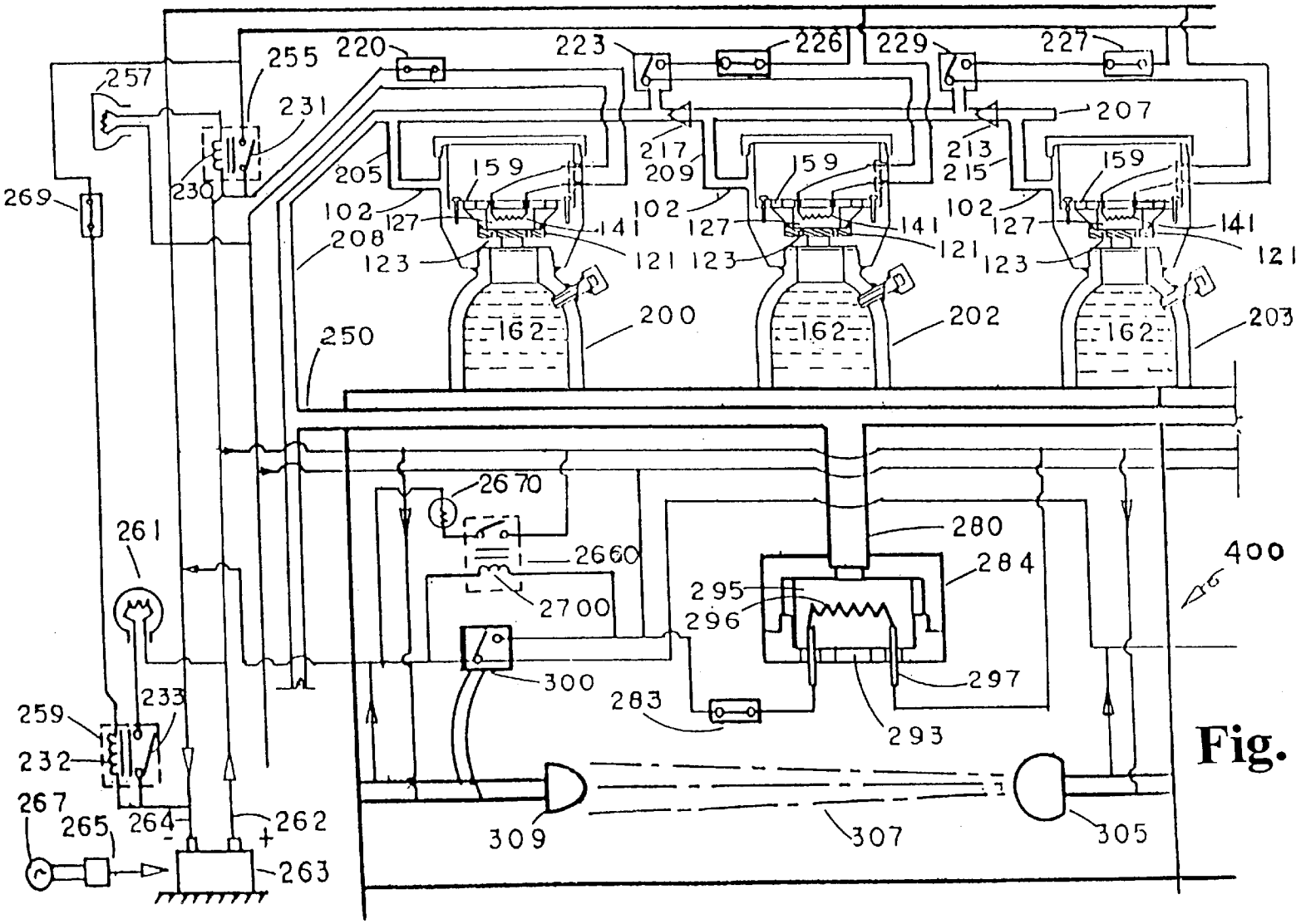
FIG. 105 shows how an alarm is installed operates when fire breaks out.

As in FIG. 105, if alarm is designed to warn only from room which fire breaks out, a control relay 2660 is to be installed in each particular room and its inducting coil 2700 is connected parallelly to control relay 300.

In a standby situation, control relay 2660 is in 'OFF' position. When fire breaks out, control relay 300 turns 'ON' and control relay 2660 also turns to 'ON' position at all time thus actuates a voice alarm 2670 to give out warning sound continuously only in room which fire breaks out and warning sound continues even after fire has been put out. In this case, a light blinking signal can substitute for siren 257 which is installed outside the building that it will not interfere warning sound of voice alarm 2670 installed in the burning room.

Figure 106:
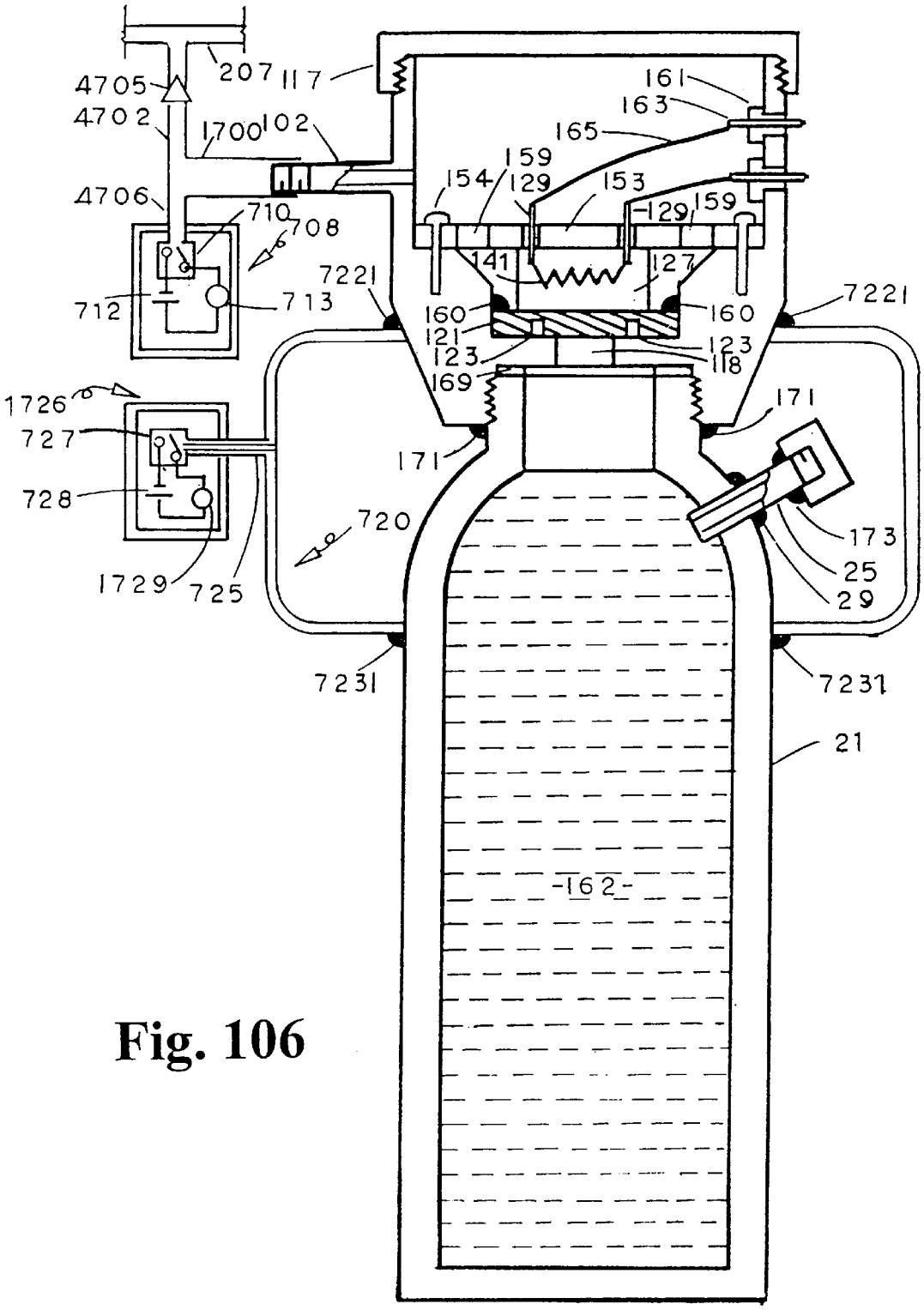
FIG. 106 shows how a leakage-detecting device is installed to a fire extinguisher.

In the present invention, had leakage occurred at any fillet welds, the leakage can be detected by installing a leakage-detecting device to fire extinguisher as shown in FIG. 106:

1. If leakage at fillet weld 160 is to be detected, a voice alarm set 708 is to be mounted to discharge tube 102 of fire extinguisher 98.

Alarm set 708 consists of a pressure switch 710 connected serially to a battery 712 and a voice alarm 713.

Pressure switch 710 is mounted to piping 4706 which is connected to piping 1700 extended from discharge tube 102 where a piping 4702 connects piping 4706 and piping 1700 to main pipe 207 of the present automatic fire extinguishing system having a check valve 4705 inside piping 4706.

If leakage occurs at fillet weld 160, fire extinguishing agent then leaks out and increases pressure inside alarm set 708 and thus causes actuation of pressure switch 710 and alarm 713 to give out a warning sound and notify a system attendant of leakage.

2. If leakages at fillet welds 29, 171 and 173 are to be detected, an apron set 720 is to be mounted to lower member of ejection chamber 99 of fire extinguisher 98 to cover fillet welds 29, 171 and 173 as shown in FIG. 106. Apron 720 is mounted to fire extinguisher 98 by fillet welds 7221 and 7231.

A voice alarm set 1726 is connected sidewise to apron 720. Voice alarm set 1726 consists of a pressure switch 727 connected to apron 720 through piping 725 and connected serially to a battery 728 and a voice alarm 1729. Once there is leakage in any fillet welds, the pressure inside apron 720 increases as fire extinguishing agent leaks out. Increase in pressure actuates pressure switch 727 and thus voice alarm 1729 gives out warning sound. FIG. 106 shows all the components for detection of leakage of fire extinguisher 98.

Figure 107:
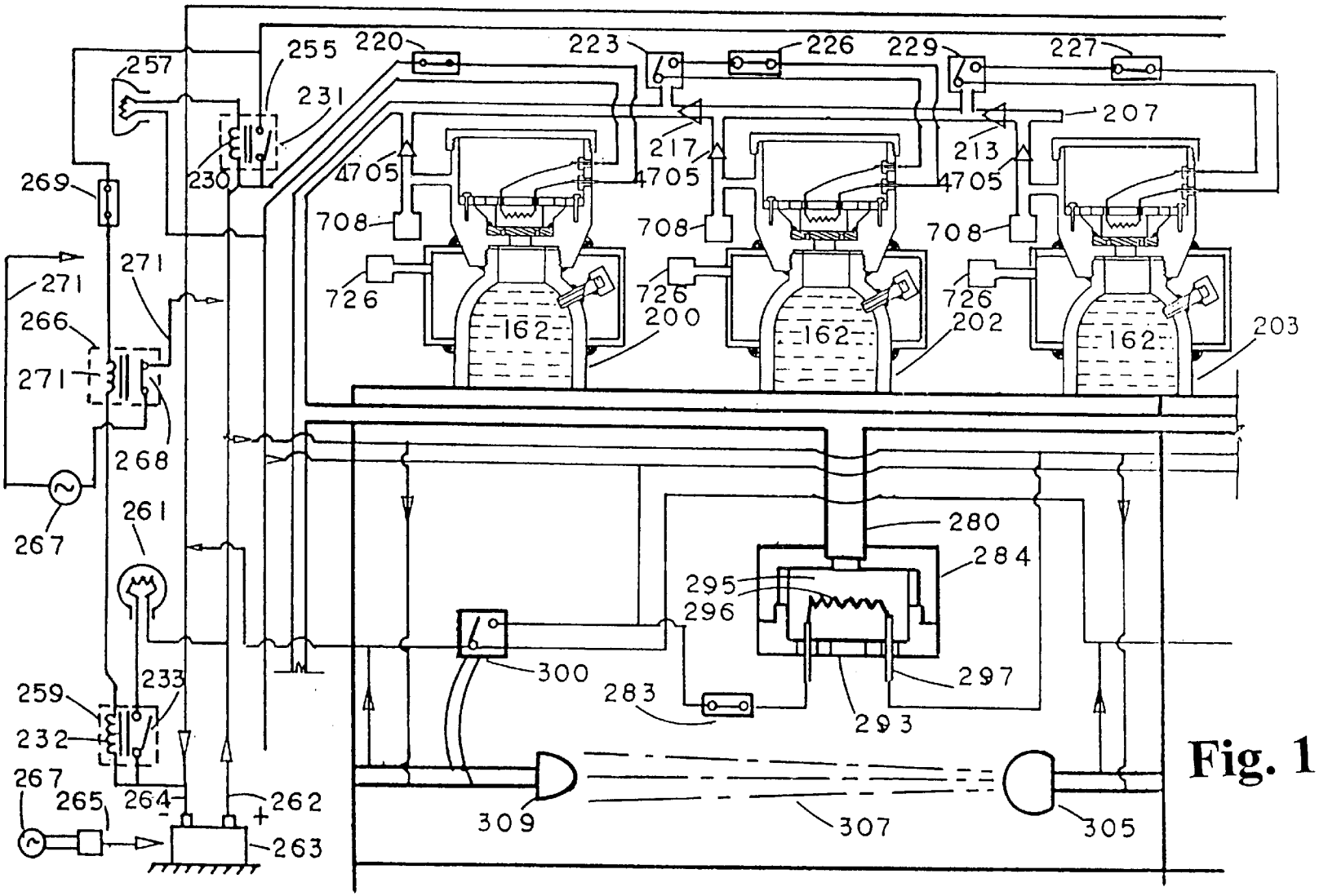
FIG. 107 shows how a fire extinguisher having a leakage-detecting device is installed in automatic fire extinguishing system.

FIG. 107 shows how the leakage-detecting devices and fire extinguisher 98 are installed in the present automatic fire extinguishing system.

All the components of automatic fire extinguishing system installed in each room, e.g. electrical cord, control relay 300, and etc. are shielded in fireproof protecting material.

Moreover, the present automatic fire extinguishing system can also be applied to those oil storage tanks as to be described.

Application of Automatic Fire-Extinguishing System for Burning Oil Storage Tank

At present, there is no effective way to put out a burning oil storage tank. It was left to burn all fuel down by itself. This is a great loss in the country. The present invented automatic fire-extinguishing system can help to put out such fire effectively.

Figure 108:
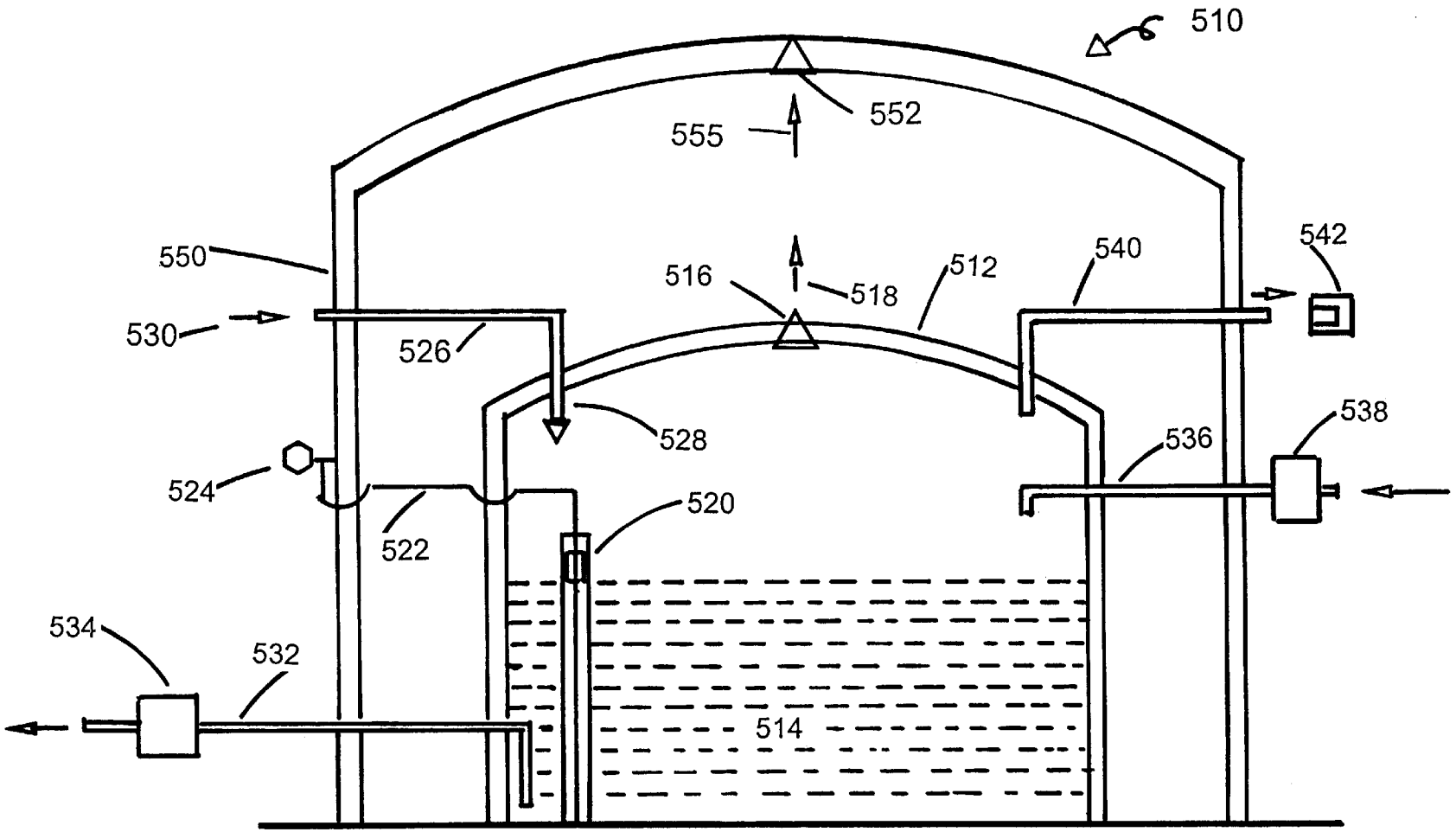
FIG. 108 shows sectional view of a double-layer oil storage tank designed to make fire extinghuishing possible instantaneously.

The present oil storage tank has certain features as follow:

as shown in FIG. 108, oil storage tank 510 consists of 2 parts:

1. Main Oil Tank 512 made of stainless steel or metal of thickness at least 2 cm. contains huge amount of oil where there must be a space between top inner surface of the oil tank and surface of oil of at least 1 meter.

There is an adjustable automatic check valve 516 installed at the topmost position of tank 512 to relief pressure built-up from burning oil inside tank 512. When pressure inside tank 512 increases to a level greater than safety limit, check valve 516 will release pressure out in the direction of arrow 518 where in the opposite direction is not possible. For example, if the pressure inside tank 512 is over 100 psi the tank will burst out; then this check valve 516 has to be set to have a threshold not greater than 90 psi. Thus, at pressure inside tank 512 of 90 psi and up, check valve 516 starts relief pressure to outside when pressure inside tank 512 reaches 90 psi and up and thus prevents oil tank from bursting.

At bottom of tank 512, there installed an electronic oil-leveling meter 520 having all the features similar to a conventional electronic gasoline-leveling meter in those automobile gasoline reservoir. Yet instead of measuring the volume in liter of gasoline remains inside gasoline reservoir, this electronic oil-leveling meter 520 measures as height in meter of oil in oil tank 512.

2. An outer tank 550 is also made of stainless steel or metal to cover the whole oil tank 512 with sufficient room inbetween. A metal pipe 526 connects from inside tank 512 through space between the two tanks to outside tank 550. Its inner end inside tank 512 locates at a level above the highest oil level having a check valve 528 installed thereto. When oil is used and oil level goes down, volume of oil pumped out is replaced by air from outside which flows into space at top of main tank 512 only in one-way direction as shown by arrow 530 and never in opposite direction.

Another metal pipe 532 is installed at a lower level also extending from inside tank 512 through wall of tank 550 to outside to connect to an oil-pump for pumping out oil for usage.

At a level above the highest oil level in tank 512, there is a metal pipe 536 extends from inside tank 512 through wall of tank 550 to outside to connect to an oil-pump for pumping in oil for storage.

At a level slightly above metal pipe 536, there is a metal pipe 540 extends from inside tank 512 through wall of tank 550 to outside where at external end of pipe 540 are external threads to mate tightly with internal threads of a seal cap 542. This cap 542 is taken off while oil is pumped into tank 512 through pipe 536. Air is forced out of tank by oil to flow outside through pipe 540. When oil is filled to a predetermined level and pumping is stopped, external end of pipe 540 is capped tightly with cap 542.

Figure 109:
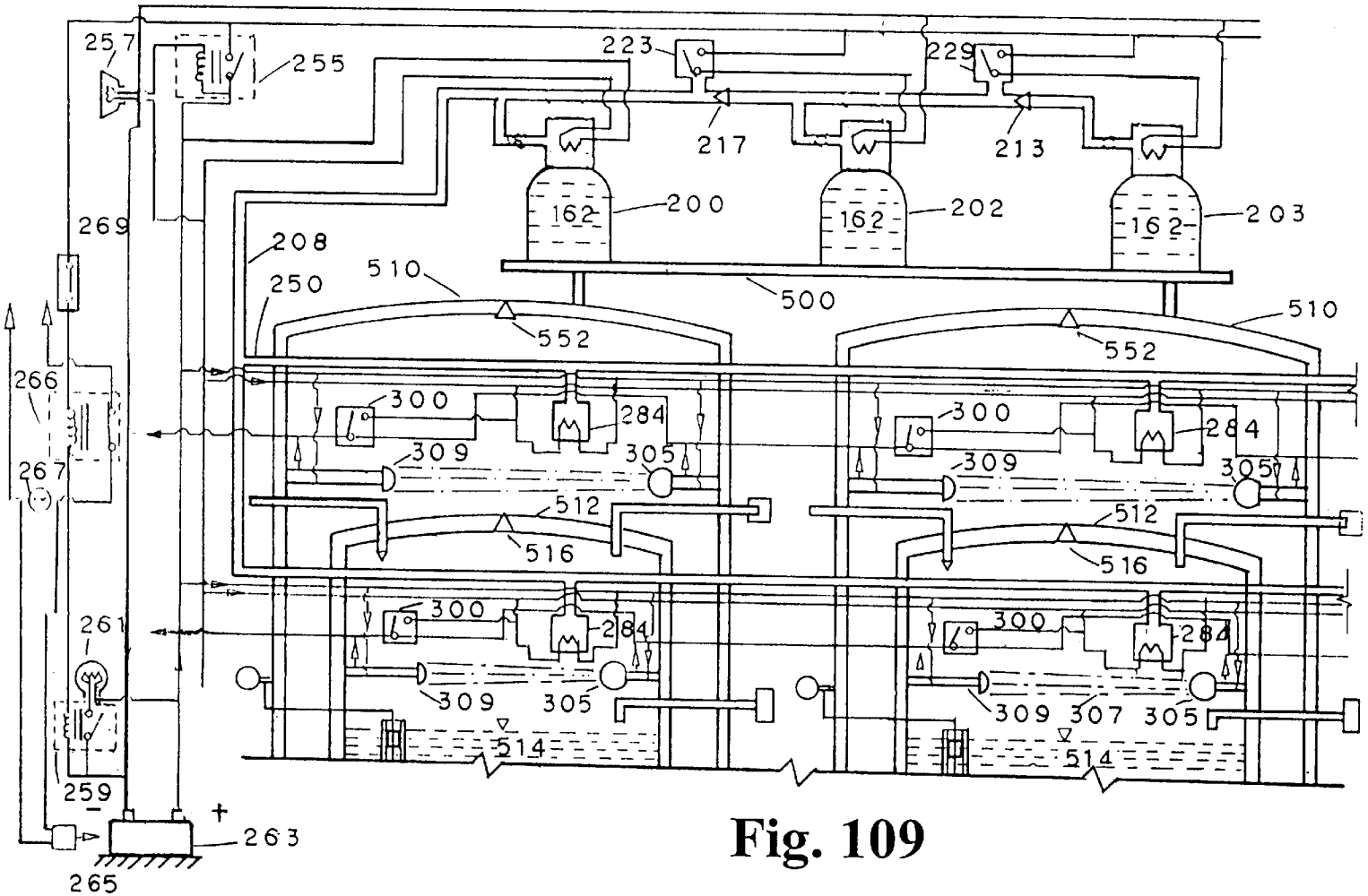
FIG. 109 shows how an automatic fire extinghuishing system is installed in an oil storage tank.
Figure 110:
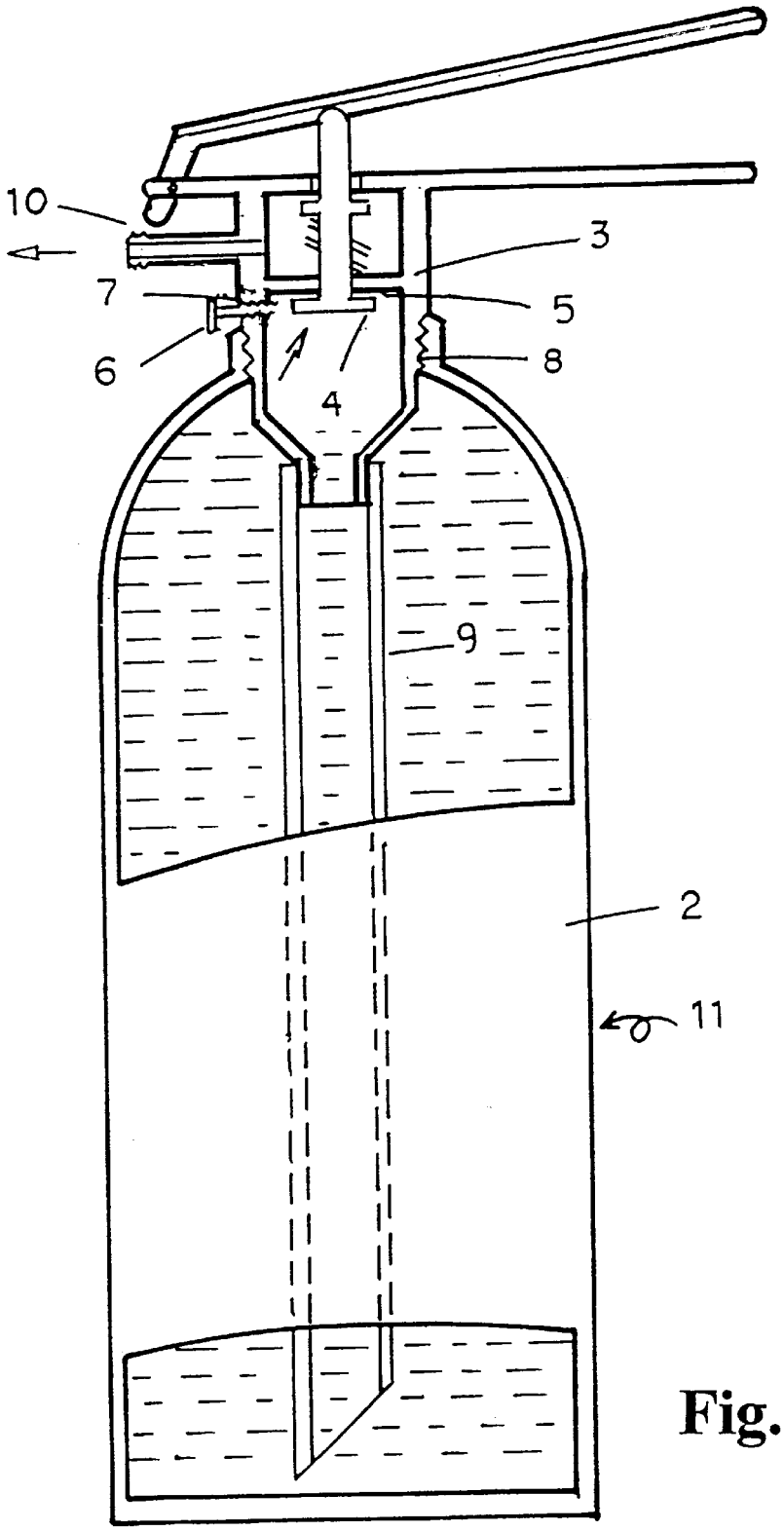
FIG. 110 is a conventional fire extinguisher showing arrows indicating leakage of fire extinghuishing agent even in a standby situation.

FIG. 109 shows how an automatic fire-extinguishing system for burning oil storage tank is installed. Fire-extinguishers are installed on a platform 500 levels above oil storage tank 510. All the components of automatic fire-extinguishing system for burning oil storage tank are the same as automatic fire-extinguishing system described above and function in similar manner, i.e., once fire breaks out, smoke or heat built up actuates the system to eject out fire extinguishing agent instantaneously from fire extinguishers 200–203 through main pipe 208 and branch pipes 250 out ejection set 284 installed in a space between tank 512 and tank 550 and a space above oil level in tank 512 to put out fire. Alarm is also actuated. FIG. 110 shows a conventional fire extinguisher which leakage of fire extinghuishing agent occurs at all time.

It will be apparent that changes may be made within the scope of this invention by one of ordinary skill in the art without departing from the spirit thereof. It is accordingly intended that all matter contained in the above description or shown in the accompanying drawings be interpreted as illustrative rather than in a limiting sense.

What is claimed is:

1. A fire extinguisher which maintains a constantly high pressure inside a shell of the fire extinguisher throughout a shelf-life of the fire extinguisher comprising an ejection chamber having internal threads at its lower edge and a shell having external threads at its upper edge to mate tightly with said internal threads of said ejection chamber where said shell contains fire extinguishing agent in an absolutely closed system by means of fillet welding the threaded connection between said ejection chamber and said shell, to thoroughly prevent any possible leakage of fire extinguishing agent from said fire extinguisher, and whereof there is a pressing element which presses on top of a plate fillet welded to an inner lower wall of said ejection chamber;

whereupon lifting up or destroying said pressing element, pressure inside said shell forces to cause a hole being formed in said plate allowing said fire extinguishing agent to flow out to put out a fire.

2. An automatic fire extinguishing system comprising the fire extinguisher of claim 1 and wherein a fire extinguishing agent is ejected out to extinguish fire immediately when a smoke detector or a heat detector is actuated by any substances built-up during a fire to cause melting down or exploding or hybrid combination of both of a plastic stopper cartridge at an end of a pipe to deliver said fire extinguishing agent into each room in a building resulting in opening up said pipe end and also resulting in destroying said pressing element by melting down or exploding or hybrid combination of both of said pressing element pressing on top of said plate filet welded to said inner lower wall of said ejection chamber to cause said hole being formed in said plate of said fire extinguisher by the force of pressure inside the shell of said fire extinguisher to allow ejecting of the fire extinguishing agent into the rooms of the building to put out a fire and wherein a number of said fire extinguishers can be connected in series with a pressure sensor installed in a pipe between each one of said number of fire extinguishers whose fire extinguishing agent can be ejected out from one extinguisher at a time and when fire extinguishing agent is almost used up said pressure sensor installed in said pipe between a first fire extinguisher of said number of fire extinguishers and a second fire extinguisher of said number of fire extinguishers is actuated to cause ejection of fire extinguishing agent from said second fire extinguisher, fire extinguishing agent can be successively ejected out until fire is completely put out whereupon said automatic fire extinguishing system is automatically turned off and next fire extinguisher in said series is left unused.

3. An automatic fire extinguishing system for an oil storage tank comprising the fire extinguisher of claim 1 and a two-layer tank made of fire resistant material, wherein a fire extinguishing agent from said fire extinguisher is ejected out to extinguish fire immediately when a smoke detector or a heat detector is actuated by any substances built-up during a fire to cause melting down or exploding or hybrid combination of both of a plastic stopper cartridge at an end of a pipe to deliver fire extinguishing agent into space between the two layers of said tank and space above oil level stored in inner unit of said tank resulting in opening up said pipe end and also resulting in destroying said pressing element by melting down or exploding or hybrid combination of both of said pressing element pressing on top of said plate fillet welded to said inner lower wall of said ejection chamber to cause said hole being formed in said plate of said fire extinguisher by the force of pressure inside the shell of said fire extinguisher to allow ejecting of said fire extinguishing agent into space between outer and inner layers of said tank and space above oil level stored in inner tank to put out fire and wherein a number of said fire extinguishers can be connected in series with a pressure sensor installed in a pipe between each one of said number of fire extinguishers whose fire extinguishing agent can be ejected out from one extinguisher at a time and when fire extinguishing agent is almost used up said pressure sensor installed in said pipe between a first fire extinguisher of said number of fire extinguishers and a second fire extinguisher of said number of fire extinguishers is actuated to cause ejection of fire extinguishing agent from said second fire extinguisher, fire extinguishing agent can be successively ejected out until fire is completely put out whereupon said automatic fire extinguishing system is automatically turned off and next fire extinguisher in said series is left unused.

* * * * *